US011882949B2

(12) United States Patent
Kressin et al.

(10) Patent No.: US 11,882,949 B2
(45) Date of Patent: Jan. 30, 2024

(54) FRAME APPARATUS

(71) Applicant: MCS Industries, Inc., Easton, PA (US)

(72) Inventors: Matthew Scott Kressin, Allentown, PA (US); Changhong Huang, Nanjing (CN); Brad William Huff, Nazareth, PA (US); Weisha Yu, Belvidere, NJ (US)

(73) Assignee: MCS Industries, Inc.

( * ) Notice: Subject to any disclaimer, the term of this patent is extended or adjusted under 35 U.S.C. 154(b) by 226 days.

(21) Appl. No.: 17/336,933

(22) Filed: Jun. 2, 2021

(65) Prior Publication Data

US 2021/0282573 A1 Sep. 16, 2021

Related U.S. Application Data

(63) Continuation-in-part of application No. 17/075,791, filed on Oct. 21, 2020, now Pat. No. 11,517,130, which is a continuation of application No. 16/454,320, filed on Jun. 27, 2019, now Pat. No. 10,842,298, which is a continuation of application No. 15/948,025, filed on Apr. 9, 2018, now Pat. No. 10,376,077, which is a continuation of application No. 15/155,984, filed on May 16, 2016, now Pat. No. 9,962,018.

(Continued)

(51) Int. Cl.
*G09F 1/06* (2006.01)
*A47G 1/06* (2006.01)

(52) U.S. Cl.
CPC ..... *A47G 1/06* (2013.01); *A47G 1/0605* (2013.01); *A47G 2001/0677* (2013.01)

(58) Field of Classification Search
CPC .. A47G 1/065; A47G 2001/0677; A47G 1/10; A47G 1/08
See application file for complete search history.

(56) References Cited

U.S. PATENT DOCUMENTS 1,358,988 A 11/1920 Rindsberger
2,777,232 A 1/1957 Kulicke
(Continued)

FOREIGN PATENT DOCUMENTS

DE 1927833 12/1970
DE 29800052 U1 * 4/1998 ..... A47G 1/0605
(Continued)

OTHER PUBLICATIONS

Klingenberg, Rena, Wire Line Art Pendant (Tutorial), Jewelry Making Journal, 2016.

*Primary Examiner* — Cassandra Davis
(74) *Attorney, Agent, or Firm* — BELLES KATZ LLC

(57) ABSTRACT

A frame apparatus for displaying a flat article and a combined frame apparatus and flat article. In one aspect, the frame apparatus includes a display frame defining a rabbet, a stack positioned in the rabbet, and a spacer apparatus. The rabbet is defined by a floor and a wall. The wall includes an engagement feature which may be a channel. The spacer apparatus is positioned in the rabbet and engagement features thereof extend into the channel in the wall od the rabbet to couple the spacer apparatus to the display frame. The spacer assembly may also be in contact with the stack to hold the stack in the rabbet.

18 Claims, 53 Drawing Sheets

Related U.S. Application Data

(60) Provisional application No. 62/200,184, filed on Aug. 3, 2015.

(56) References Cited

U.S. PATENT DOCUMENTS

| | | | | | |
|---|---|---|---|---|---|
| 2,806,309 | A | | 9/1957 | Goldberg | |
| 3,579,886 | A | | 5/1971 | Hughes | |
| 3,665,628 | A | | 5/1972 | Dammond | |
| 3,745,680 | A | * | 7/1973 | Faust | B44C 5/02 40/792 |
| 3,811,214 | A | | 5/1974 | Tate | |
| 3,865,342 | A | | 2/1975 | Kanzelberger | |
| 4,583,309 | A | | 4/1986 | Kane | |
| 4,736,539 | A | | 4/1988 | Dickinson | |
| 4,850,125 | A | | 7/1989 | Green | |
| 4,949,483 | A | * | 8/1990 | Dobson | A47G 1/06 40/781 |
| 5,012,601 | A | * | 5/1991 | Garland | G09F 1/12 40/781 |
| 5,125,175 | A | | 6/1992 | Huff, Jr. | |
| 5,524,370 | A | | 6/1996 | Roy | |
| 6,354,031 | B1 | * | 3/2002 | Meur | G09F 1/12 40/781 |
| 6,742,296 | B2 | | 6/2004 | Johnson et al. | |
| 7,069,682 | B2 | | 7/2006 | Gatt et al. | |
| 2003/0226302 | A1 | | 12/2003 | Flodin et al. | |
| 2013/0180142 | A1 | | 7/2013 | Kressin et al. | |
| 2017/0035221 | A1 | * | 2/2017 | Huff | A47G 1/0605 |

FOREIGN PATENT DOCUMENTS

| | | | | | |
|---|---|---|---|---|---|
| DE | 20002653 | U1 | * | 5/2000 | A47G 1/0605 |
| EP | 4056079 | A1 | * | 9/2022 | |
| FR | 2707150 | | | 1/1995 | |
| FR | 2828081 | | | 2/2003 | |
| FR | 2860956 | A1 | * | 4/2005 | A23K 20/105 |
| GB | 2114884 | | | 9/1983 | |
| GB | 2598652 | A | * | 3/2022 | A47G 1/0605 |

* cited by examiner

FRAME APPARATUS

CROSS-REFERENCE TO RELATED PATENT APPLICATIONS

The present application is a continuation-in-part of U.S. patent application Ser. No. 17/075,791, filed Oct. 21, 2020, which is a continuation of U.S. patent application Ser. No. 16/454,320, filed Jun. 27, 2019, now U.S. Pat. No. 10,842,298, which is a continuation of U.S. patent application Ser. No. 15/948,025, filed Apr. 9, 2018, now U.S. Pat. No. 10,376,077, which is a continuation of U.S. patent application Ser. No. 15/155,984, filed May 16, 2016, now U.S. Pat. No. 9,962,018, which claims the benefit of U.S. Provisional Patent Application Ser. No. 62/200,184, filed Aug. 3, 2015, the entireties of which are hereby incorporated herein by reference.

FIELD OF THE INVENTION

The present invention relates generally to frames, and specifically to a frame apparatus for displaying an article.

BACKGROUND OF THE INVENTION

People often like to commemorate their achievements by framing diplomas and medals. Furthermore, people enjoy framing photographs, posters and other types of photographic media for display on the wall in their homes. People also frame certain types of memorabilia in order to display the memorabilia and protect it against damage that may occur over time as a result of the memorabilia being exposed to the ambient environment.

There are many different types of frames that currently exist for the purpose of displaying the item retained within the frame and protecting the item against damage. Frames come in a wide variety of sizes, colors, textures and finishes. Furthermore, frames can be used with matting that surrounds a smaller photo or item to enhance the aesthetics of the framed photo or item. Alternately, frames may be constructed such that they have transparent front and rear glazings. This permits a framed photo or item to appear as if it is floating within the frame.

One problem with existing frames is that they generally require a backing and additional mounting clips to retain the backing in the frame. Multiple clips are usually required to adequately secure the backing. These clips require assembly, add manufacturing cost, and are frequently prone to breakage. A simpler frame apparatus that has fewer components, is easier to assemble, and is more robust is therefore desired.

SUMMARY OF THE INVENTION

Exemplary embodiments according to the present disclosure are directed to a frame apparatus for displaying an article, the frame apparatus comprising an annular display frame having an inner surface defining a display opening, the annular display frame comprising a rabbet defined by a floor and a wall of the annular frame, the wall of the rabbet comprising a first engagement portion and a second engagement portion. The frame apparatus further comprises a transparent front panel positioned in the rabbet that encloses the display opening, a rear panel positioned in the rabbet in a stack with the transparent front panel, and an annular spacer frame having an inner surface defining a central opening, the annular spacer frame positioned in the rabbet.

The first and second engagement portions engage the annular spacer frame to lock the annular spacer frame and the stack in the rabbet.

In one aspect, the invention can be a frame apparatus comprising: an annular display frame comprising: a longitudinal axis; an outer wall having an outer surface that defines a periphery of the annular display frame and an inner surface; and a rabbet comprising a floor and a wall, the wall of the rabbet spaced apart from the inner surface of the outer wall to define a channel between the wall of the rabbet and the outer wall, the wall of the rabbet comprising an opening that provides a passageway into the channel; a stack positioned in the rabbet; and a spacer apparatus positioned in the rabbet and detachably coupled to the annular display frame to retain the stack in the rabbet, the spacer apparatus comprising a first engagement feature that nests within at least one of the opening or the channel on a first side of the longitudinal axis and a second engagement feature that nests within at least one of the opening or the channel on a second side of the longitudinal axis.

In another aspect, the invention can be a frame apparatus comprising: a display frame comprising a rabbet comprising a floor and a wall, the wall of the rabbet comprising an engagement feature; a stack positioned in the rabbet; and a spacer apparatus positioned in the rabbet and detachably coupled to the annular display frame to retain the stack in the rabbet, the spacer apparatus comprising: a plurality of corner pieces; first and second sets of components each comprising a first short elongated piece, a hanger piece, and a second short elongated piece, each of the first and second sets of components coupled together and extending between and coupled to two adjacent ones of the corner pieces to form first and third sides of the spacer apparatus; and first and second long elongated pieces each extending between and coupled to two adjacent ones of the corner pieces to form second and fourth sides of the spacer apparatus.

In yet another aspect, the invention can be a frame apparatus comprising: a display frame comprising a rabbet comprising a floor and a wall, the wall of the rabbet comprising an engagement feature; a stack positioned in the rabbet; and a spacer apparatus positioned in the rabbet and detachably coupled to the display frame to retain the stack in the rabbet, the spacer apparatus comprising a first side, a second side opposite the first side, and third and fourth sides extending between the first and second sides, each of the first, second, third, and fourth sides comprising an elongated protuberance that nests within the engagement channel to couple the spacer apparatus to the display frame, and wherein the first and third sides further comprise at least one flexible tab that nests within the engagement channel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The following detailed description of the exemplary embodiments will be better understood when read in conjunction with the appended drawings. It should be understood, however, that the invention is not limited to the precise arrangements and instrumentalities shown in the following figures.

DETAILED DESCRIPTION OF THE INVENTION

Figure 1:
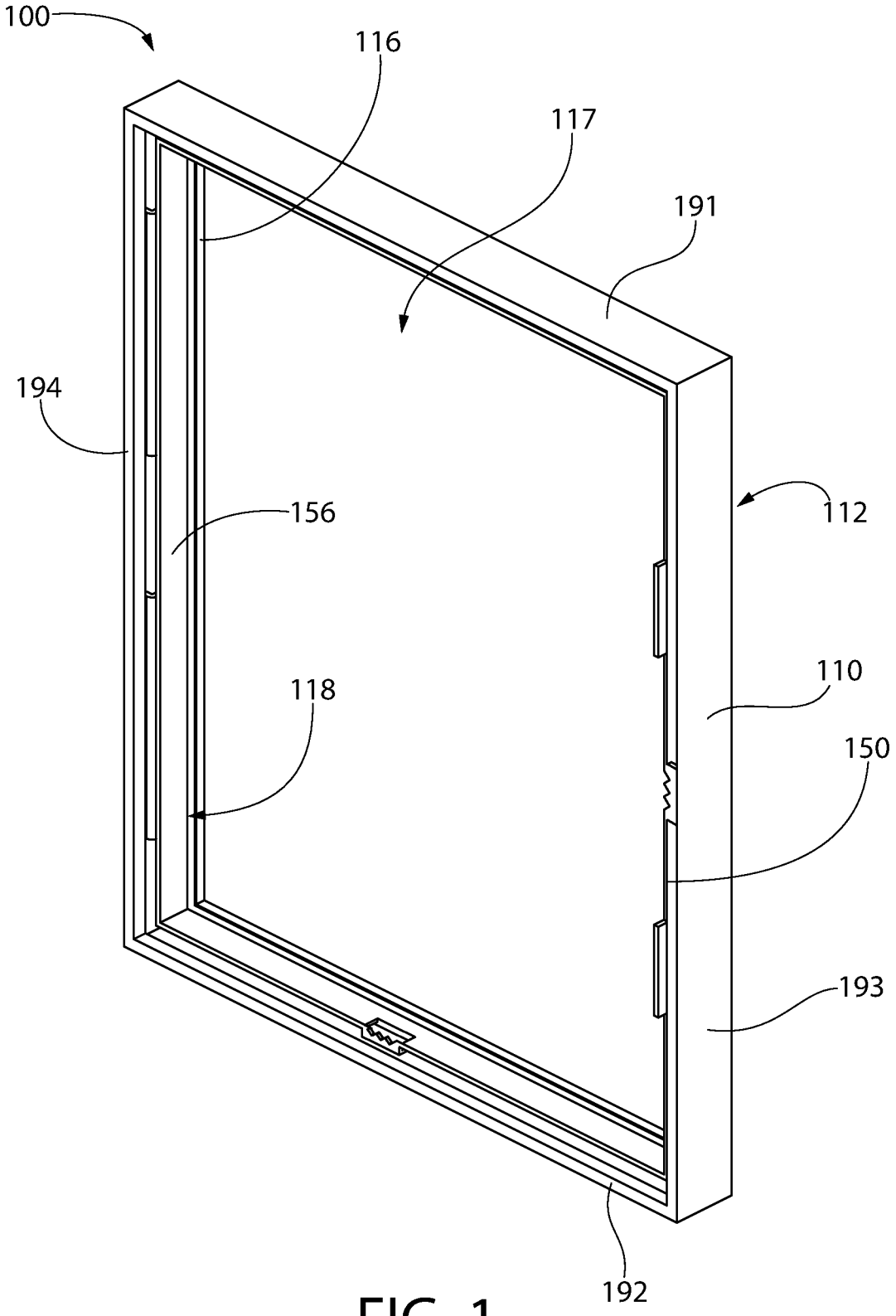
FIG. 1 is a rear perspective view of a frame apparatus in accordance with an embodiment of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

Figure 2:
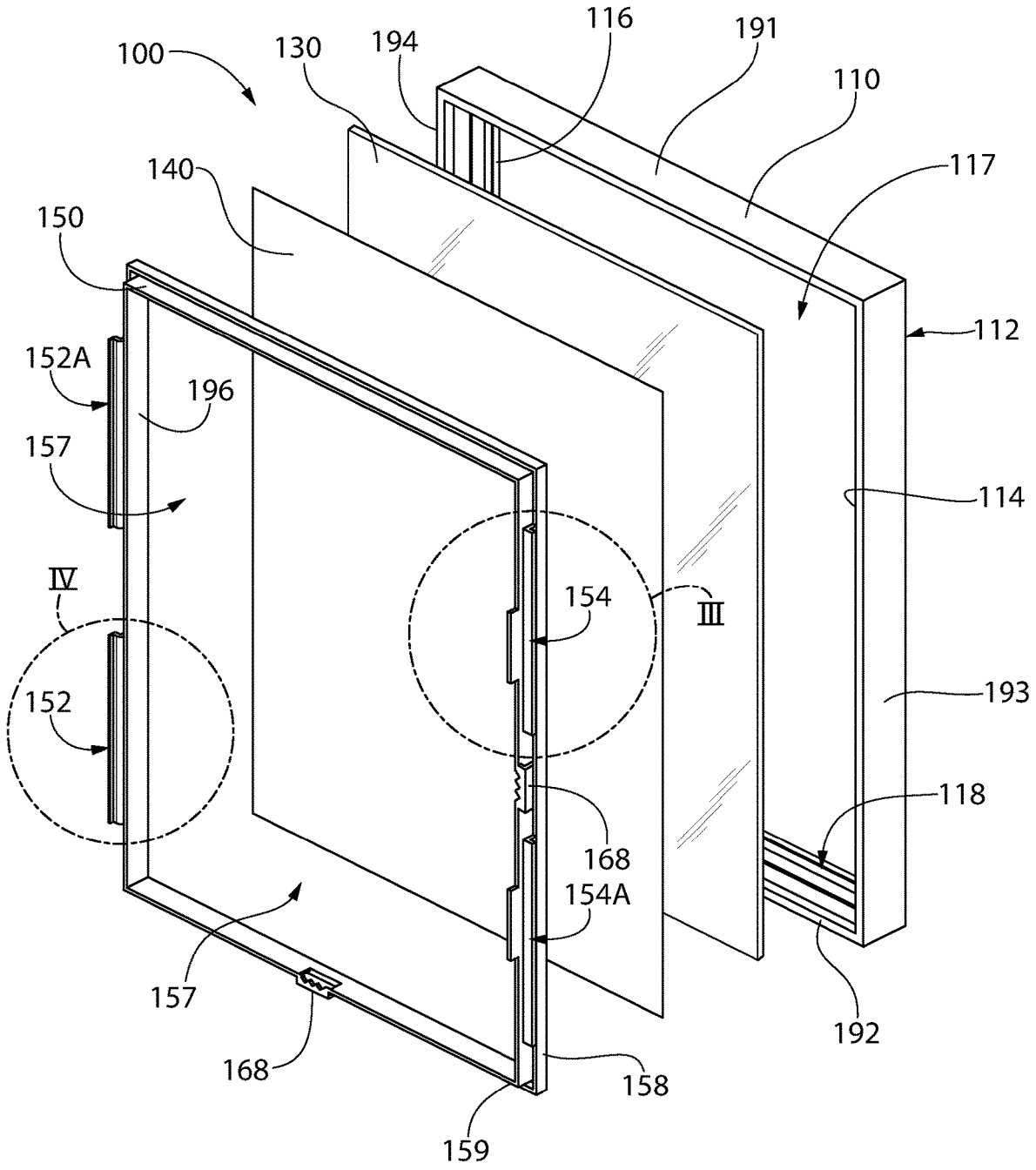
FIG. 2 is an exploded view of the frame apparatus of FIG. 1.

Referring to FIG. 1, a rear perspective view of a frame apparatus 100 according to a first embodiment of the invention. The exemplary embodiment may be a so-called "float frame" or may be a conventional picture frame. As best shown in FIG. 2, the exemplary embodiment comprises an annular display frame 110, a transparent front panel 130, a rear panel 140, and an annular spacer frame 150. A display article, such as a photograph, a piece of paper, a poster, a sports jersey, or another article that is sought to be displayed, may be placed between the transparent front panel 130 and the rear panel 140. As will be described in greater detail below, the annular spacer frame 150 engages the annular display frame 110 and applies pressure to the rear panel 140, forcing the rear panel against the transparent front panel 130, which is in turn forced against the annular display frame 110 such that a display article may be captured between the transparent front panel 130 and the rear panel 140. The combination of the transparent front panel 130 and the rear panel 140 forms a stack. The stack need not be limited to a single transparent front panel 130 and a single rear panel 140, but may also include additional panels. Thus, it is possible to create an embodiment where there are three or more layers in the stack.

In the preferred embodiment, the transparent front panel 130 is clear. The transparent front panel 130 may be composed of any material, but is most preferably made of glass, polystyrene, acrylic, plexiglass, polycarbonate, or any other clear material suitable for framing purposes. The transparent front panel 130 may also be referred to herein or generally known as a glazing. The rear panel 140 may also be made of glass, polystyrene, acrylic, plexiglass, polycarbonate, or any other clear material suitable for framing purposes. In yet other embodiments, the rear panel 140 may be made of an opaque material such as cardboard, cellulosic fiberboard, PVC, aluminum, or other materials known in the art. The rear panel 140 need not be clear, and may be either clear or transparent, or translucent or fully opaque depending on the desired end product. In the event that the rear panel 140 is not desired to be clear, it may also be translucent or painted or finished with other materials such as paint or felt so that a pleasing texture is achieved. If desired, more than two panels may be used as discussed above. It is conceived that three or more panels may be used, and any of them may be transparent, translucent, or opaque. Thus, it is within the scope of the invention to have both the transparent front panel 130 and the rear panel 140 be formed of a transparent material and interpose one or more additional transparent, translucent, or opaque layers between the transparent front panel 130 and the rear panel 140.

As will be discussed in greater detail below, the annular display frame 110 may be constructed from extrusions of aluminum, PVC, steel, or other materials capable of providing a rigid profile and an aesthetically pleasing outward appearance. Generally the annular display frame 110 is rectangular, but in some embodiments, it may be formed as a square, and all four segments would be of equal length. The annular display frame 110 is formed of four segments, each segment being an extruded component having an identical cross-sectional profile. The annular display frame 110 is formed with two short segments 191, 192 and two long segments 193, 194. These four segments 191-194 form a closed perimeter. The segments 191-194 are cut such that each corner has a 45 degree miter or are cut at 90 degrees and one length is butted against the other. Other ways of forming the ends of the segments are also conceived of, as would be apparent to one of skill in the art. The lengths of material may be joined by a corner bracket, which is preferably made of stamped steel and dimensioned such that the corner bracket fits within the extruded profile of the lengths of material. The corner bracket engages two adjacent lengths of material, forming a finished edge without gaps. In alternate embodiments the corner brackets may be made of plastic, aluminum, or the like. In yet other embodiments, such as those discussed in greater detail below, the frame may be formed as a single piece, or may be constructed of wood, medium-density fiberboard (MDF), plastic, or other materials and joined using nails, screws, staples, adhesive, welding, molding, or the like. These embodiments do not require corner brackets. Other processes may be used to form the annular display frame 110, as would be apparent to one of skill in the art. In certain other embodiments the annular display frame 110 may be an oval, a polygon, or any other shape desired.

The annular display frame 110 generally comprises a front surface 112 and a rear surface 114. The front surface 112 is the surface of the annular display frame 110 that is typically visible to a user while the frame apparatus 100 is hanging from a wall or other surface. The rear surface 114 abuts the wall or other surface when the frame apparatus 100 is made to hang therefrom. The annular display frame 110 also has an inner surface 116 which defines a display opening 117. The inner surface 116 extends in a direction substantially perpendicular to the front surface 112, but may also be at an angle such that the inner surface 116 has either an inward or outward taper when viewed from the front surface 112 of the annular display frame 110. This may be used to enhance the aesthetic appeal of the frame apparatus 100. The inner surface 116 is adjacent to a rabbet 118 which is defined by a floor 120 and a wall 122 of the annular display frame 110. The rabbet 118 is formed so that the transparent front panel 130 will fit within the rabbet 118 but can only be removed from the rear surface 114 of the annular display frame 110. This provides a pleasing aesthetic appearance when viewed from the front surface 112 and prevents unintended removal of the transparent front panel 130. In yet other embodiments, the inner surface 116 need not be one formed of planes, but instead may consist of castellations, fingers, curves, or any other geometry. This may be desirable to produce an ornamental appearance that is more ornate or fanciful to enhance consumer appeal.

The display opening 117 formed by the inner surface 116 of the annular display frame 110 may be divided into separate display areas by one or more ornamental dividers, which are not shown in the present embodiment. One ornamental divider may be used to provide two separate display areas, or a pair of intersecting ornamental dividers may be used to divide the display opening 117 into four separate display areas. Other configurations would be apparent to one of skill in the art.

Figure 5:
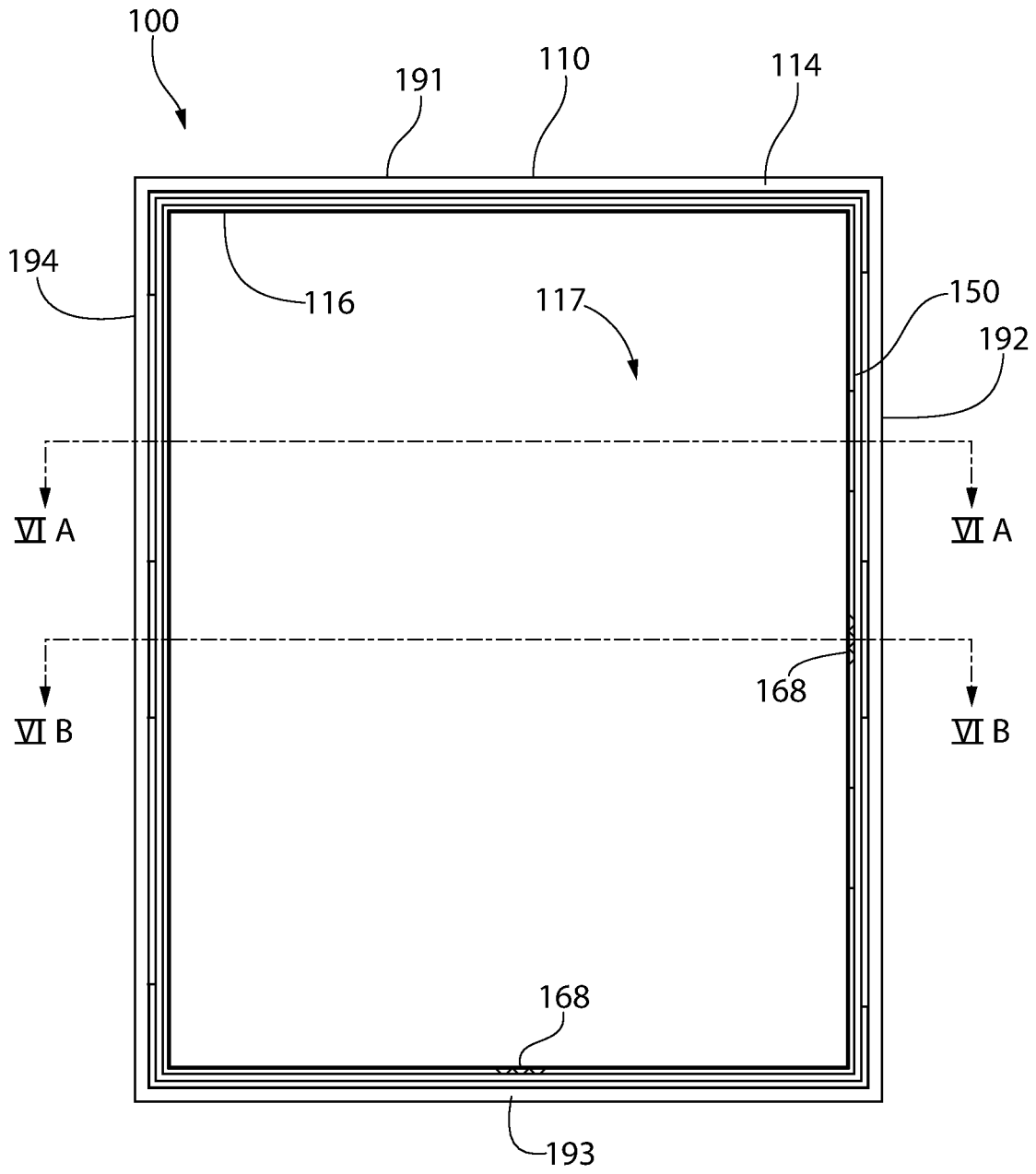
FIG. 5 is a rear view of the frame apparatus of FIG. 1.
Figure 6A:
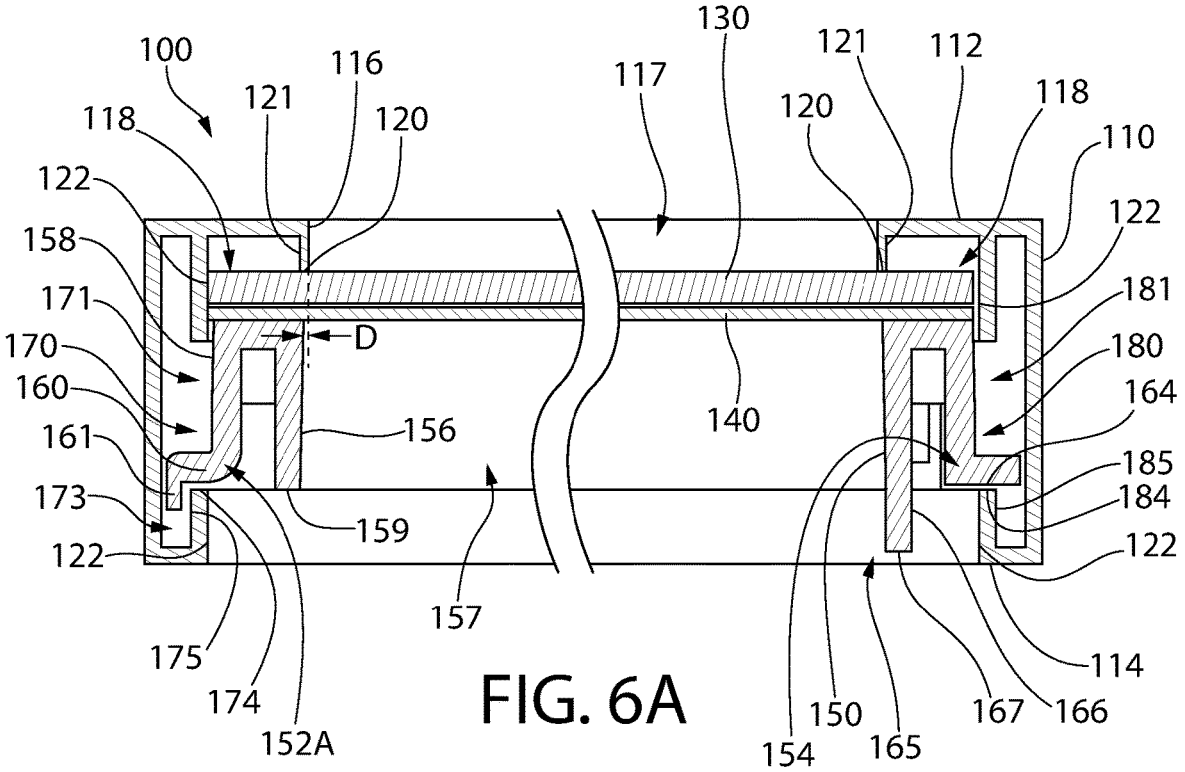
FIG. 6A is a cross-sectional view taken along line VI A-VI A of FIG. 5.
Figure 6B:
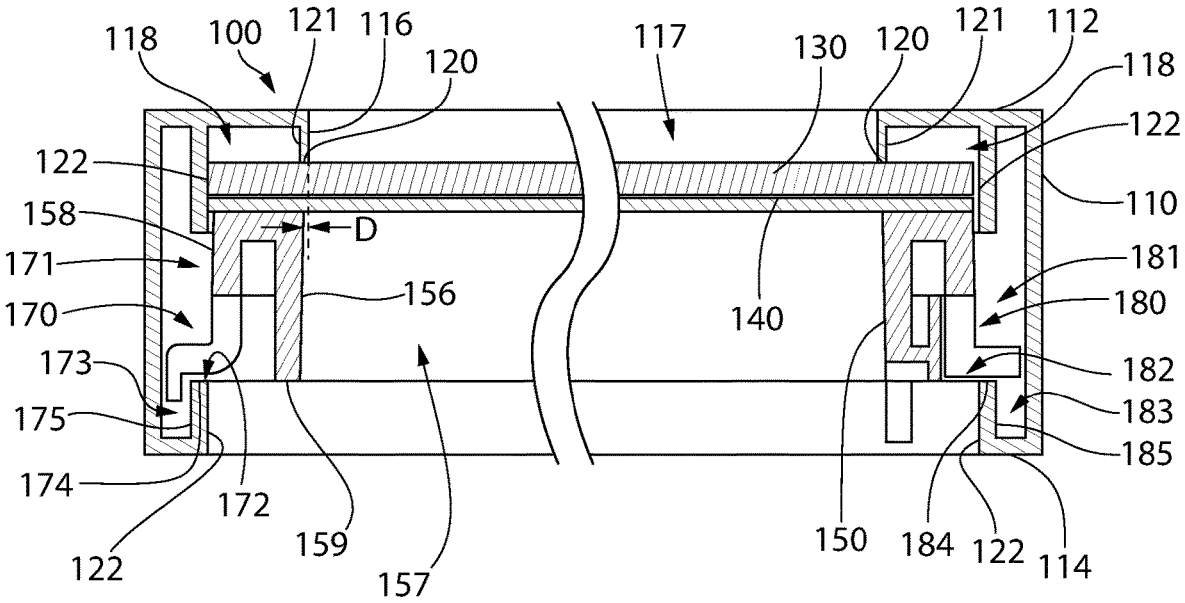
FIG. 6B is a cross-sectional view taken along line VI B-VI B of FIG. 5.

FIG. 5 shows a rear view of the first embodiment of the frame apparatus 100. FIGS. 6A and 6B show cross-sectional views which more clearly show the features of the rabbet 118 of the annular display frame 110. As can be seen in FIGS. 6A and 6B, the inner surface 116 is located inward from the periphery of the annular display frame 110, and the floor 120 is formed in a plane parallel with the front surface 112 of the annular display frame 110. In the present embodiment, the floor 120 is formed by the extrusion of the annular display frame 110. The extrusion profile of the annular display frame 110 has an upturned lip 121 which serves as the floor 120. However, in alternate embodiments, the floor 120 may be formed as a flat surface instead of having the upturned lip 121. Any structure suitable for providing planar contact with the transparent front panel 130 can serve as a floor 120.

Surrounding the floor 120 is a wall 122. The wall 122 is generally perpendicular to the front surface 112 such that it forms the rabbet 118 and contains the transparent panel 130 such that the transparent panel 130 drops into the rabbet 118 and prevents significant in-plane motion of the transparent panel 130. Thus, the transparent panel 130 can only be moved a small distance in a plane parallel with the front surface 112. The wall 122 need not be a continuous surface, and need only contain the transparent panel 130 within the annular display frame 110.

The wall 122 of the rabbet 118 has a first engagement portion 170 and a second engagement portion 180 to retain the annular spacer frame 150. In the present embodiment, the engagement portions 170, 180 are formed as first and second grooves 171, 181 which are formed into the wall 122. The first groove 171 has a first entry section 172 and a first receiving section 173. The first entry section 172 extends generally parallel with the front surface 112 of the annular display frame 110, while the first receiving section 173 extends generally perpendicular to the front surface 112. The first entry section 172 may extend at an angle to the front surface 112, but may not be perpendicular to the front surface 112. Similarly, the first receiving section 173 may extend at an angle other than perpendicular to the front surface 112, but may not be parallel to the front surface 112. The engagement portions 170, 180 extend along the entirety of the length of their respective segments. However, in alternate embodiments the engagement portions 170, 180 may only be formed along part of the length of their respective segments.

The first entry section 172 has a first engagement surface 174 facing toward the floor 120 of the rabbet 118. The first engagement surface 174 forms one wall of the first groove 171, but does not need to be co-planar with the floor 120 of the rabbet 118. The first engagement surface 174 must only face toward the floor 120 of the rabbet 118, so considerable deviations from parallel are permissible. In certain embodiments, an angle may facilitate interlocking and retention of the annular spacer frame 150. The first receiving section 173 has a first locking surface 175 that is non-parallel to the first engagement surface 174. This provides a feature whereby the annular spacer frame 150 can interlock and cannot be easily withdrawn. However, in some embodiments the locking surface 175 may be omitted.

The second groove 181 has a corresponding second entry section 182 and a corresponding receiving section 183 which are identical to the first entry section 172 and the first receiving section 173. The second entry section 182 has a second engagement surface 184 forming one wall of the second groove 181, the second entry section 182 facing the floor of the rabbet 118. Once again, there is no requirement that the second engagement surface 184 be co-planar with the floor 120 of the rabbet 118. The second receiving section 183 has a second locking surface 185 that is non-parallel to the second engagement surface 184. In other embodiments the first and second grooves 171, 181 are not identical. As can be seen in FIGS. 6A and 6B, the grooves 171, 181 are formed as openings in an extruded material rather than milled out of a solid block of material. In yet other embodiments, there may be three or more grooves, and these grooves may be identical or some grooves may be configured differently from other grooves to prevent assembly in an incorrect orientation or to enhance cost reduction or ease of assembly.

Turning to the annular spacer frame 150, which is shown in the exploded view of FIG. 2, the annular spacer frame 150 engages the annular display frame 110 so that it is positioned within the rabbet 118 and secures the stack formed by the transparent front panel 130 and the rear panel 140 in place. The annular spacer frame 150 prevents any rearward motion of the transparent front panel 130 or the rear panel 140, so that the display article is securely held within the frame apparatus 100. The annular spacer frame 150 has an inner surface 156 which defines a central opening 157, the inner surface 156 being arranged substantially perpendicular to the front surface 112 of the annular display frame 110. In alternate embodiments, the inner surface 156 may be arranged at an angle such that it tapers inward or outward from the perimeter of the annular spacer frame 150, or may have a curvature or other non-planar shape. In some embodiments, a groove may be formed into the inner surface 156 to alter the rigidity of the annular spacer frame 150 or reduce manufacturing cost. The annular spacer frame 150 is specifically designed to have a lower rigidity than the annular display frame 110 so that it can be deformed to facilitate assembly. Furthermore, the annular spacer frame 150 is designed to be manufactured separately from the rear panel 140 and is not affixed to the rear panel 140. Instead, the annular spacer frame is placed in surface contact with the rear panel 140 without any physical attachment.

Figure 3:
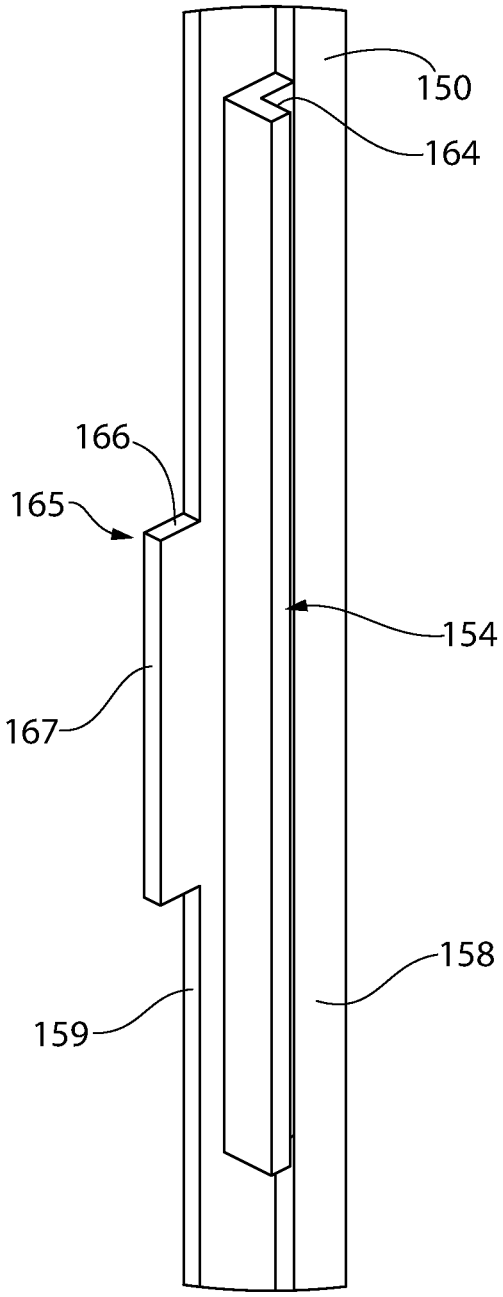
FIG. 3 is an enlarged view of area III of FIG. 2.
Figure 4:
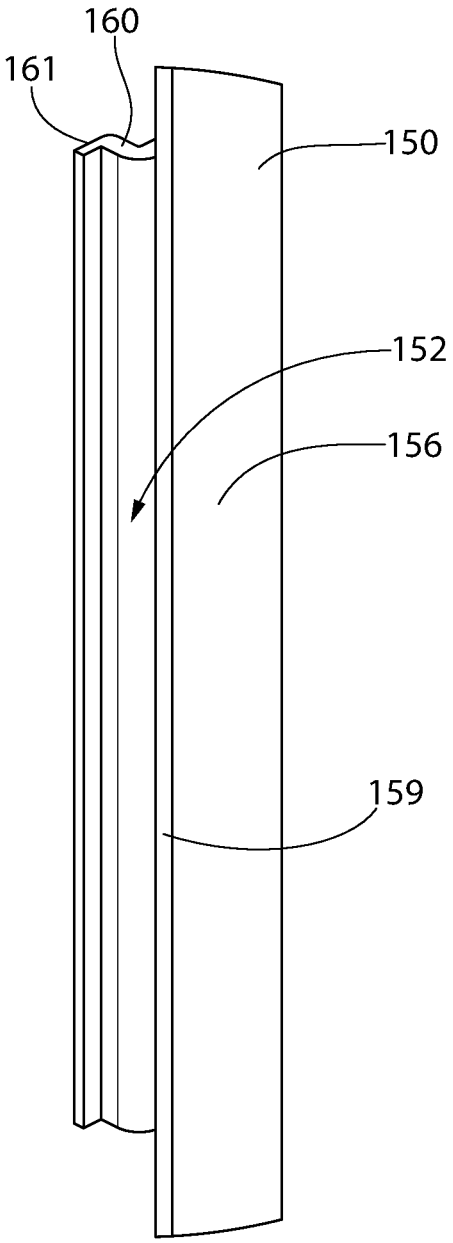
FIG. 4 is an enlarged view of area IV of FIG. 2.

Turning to FIGS. 3 and 4, the annular spacer frame 150 has a first locking tab 152 and a second locking tab 154, the first locking tab 152 being different from the second locking tab 154. The first locking tab 152 is on an opposing side of the annular spacer frame 150 from the second locking tab 154. There is also a third locking tab 152A and a fourth locking tab 154A. In other embodiments, there may be additional locking tabs which provide additional retention for the annular spacer frame 150 or there may be fewer locking tabs if adequate retention of the stack can be obtained with one or two locking tabs. Generally the locking tabs on a single elongate member of the annular spacer frame 150 all have the same profile, but in some embodiments it may be desirable to have locking tabs with different profiles on the same elongate member of the annular spacer frame 150. In some embodiments, only one locking tab is used on each side of the spacer frame 150. In yet other embodiments, there may be locking tabs on three or more sides of the annular spacer frame 150 or only one or two sides of the annular spacer frame 150. It is conceived that locking tabs may be arranged on adjacent sides of the annular spacer frame 150.

The first and third locking tabs 152, 152A of the annular spacer frame 150 engage the first engagement portion 170 of the annular display frame 110. The second and fourth locking tabs 154, 154A of the annular spacer frame 150 engage the second engagement portion 180 of the annular display frame 110. This locks the annular spacer frame 150 and the stack into the rabbet 118 of the annular display frame 110. In the present embodiment, the locking tabs 152, 152A are spaced apart from each other along the elongate member and spaced apart from the ends of the elongate member. Similarly, the locking tabs 154, 154A are spaced apart from each other along the elongate member and spaced apart from the ends of the elongate member. This helps to ensure even pressure is applied to the stack and permits deflection of the annular spacer frame 150 to permit assembly. In embodiments where a single locking tab is used per side, it is generally centered on the elongate member to ensure even distribution of compression force on the stack. However, in yet other embodiments, a single locking tab may be arranged asymmetrically on the elongate member.

The first and third locking tabs 152, 152A protrude from the outer surface 158 of the annular spacer frame 150. The outer surface 158 is the peripheral edge of the annular spacer frame 150, and is opposite the inner surface 156. The first and third locking tabs 152, 152A have a first locking section 160 and a second locking section 161. The first locking section 160 extends from the outer surface 158 in an approximately perpendicular direction. However, in other embodiments the first locking section 160 may extend at any angle from the outer surface 158 that is non-parallel to the outer surface 158. The second locking section 161 extends from the first locking section 160 in a non-parallel direction, facing toward the rear surface 114 of the annular display frame 110 when assembled. In the exemplary embodiment, the second locking section 161 extends perpendicular from the first locking section, but it may extend in any direction that is non-parallel to the first locking section 160.

As can be seen in FIGS. 6A and 6B, the first and third locking tabs 152, 152A extend into the first groove 171 and engage the first engagement surface 174 of the annular display frame 110. Specifically, the first locking section 160 engages the first engagement surface 174 and the second locking section 161 engages the first locking surface 175. The interaction of the second locking section 161 with the first locking surface 175 prevents motion of the annular spacer frame 150 in the plane defined by the central opening 157. The interaction of the first locking section 160 with the first engagement surface 174 retains the annular spacer frame 150 and the stack against the annular display frame 110 in the direction perpendicular to the plane defined by the central opening 157. In other embodiments, the second locking section 161 may be omitted, and movement in the plane defined by the central opening 157 may be avoided by interaction between the outer surface 158 of the annular spacer frame 150 with the wall 122 of the rabbet 118 of the annular display frame 110.

The second and fourth locking locking tabs 154, 154A of the annular spacer frame 150 also protrude from the outer surface 158 of the annular spacer frame 150. The second and fourth locking tabs 154, 154A have a first locking section 164 which extends in a non-parallel direction from the outer surface 158 of the annular spacer frame 150. In the exemplary embodiment, there is no second locking section, but a second locking section may be added to improve retention of the second and fourth locking tabs 154, 154A in the annular display frame 110. The first locking section 164 of the second and fourth locking tabs 154, 154A engages the second engagement portion 180 of the annular display frame 110. Specifically, the first locking section 164 makes contact with the second engagement surface 184. The first locking section 164 may extend perpendicular to the outer surface 158 of the annular spacer frame 150, or may extend at an angle that facilitates assembly or enhances the compression applied by the annular spacer frame 150 against the stack, to prevent the display article from moving when the frame apparatus 100 is handled.

As can be best seen in FIGS. 3, 4, 6A, and 6B, the annular spacer frame 150 is also provided with gripping elements 165. The gripping elements 165 are arranged on the annular spacer frame 150 so that they allow the user to easily flex the annular spacer frame during assembly. The gripping elements 165 comprise a gripping tab 166 protruding from a rear surface 159 of the annular spacer frame 150. Each gripping tab 166 terminates in a distal surface 167, the distal surface 167 being flush or depressed relative to a reference plane defined by the rear surface 114 of the annular display frame 110. In the present embodiment, the gripping elements 165 are located proximate the second and fourth locking tabs 154, 154A. In alternate embodiments, the gripping elements 165 are placed proximate all locking tabs, or placed in any location that permits easy installation and removal of the annular spacer frame 150.

During assembly of the frame apparatus, the user places the transparent front panel 130 into the rabbet 118 of the annular display frame 110. The display article is placed onto the transparent front panel 130, followed by the rear panel 140. Finally, the first and third locking tabs 152, 152A of the annular spacer frame 150 are engaged with the first engagement portion 170 of the annular display frame 110, inserting the second locking section 161 into the first groove 171. The annular spacer frame 150 is then rotated such that the second locking section 161 engages the first locking surface 175 and the first locking section 160 engages the first engagement surface 174. This causes a compression force to be applied to the stack as the annular spacer frame 150 drops into the rabbet 118. The user then deflects the second and fourth locking tabs 154, 154A using the gripping elements 165 and inserts the first locking section 164 of the second and fourth locking tabs 154, 154A into the second engagement portion 180 of the annular display frame 110. As pressure on the gripping elements 165 is released, the annular spacer frame 150 relaxes and the second and fourth locking tabs 154, 154A sit tightly in the second engagement portion 180, with the first locking section 164 engaging the second engagement surface 184. A further compression force is applied by the second and fourth locking tabs 154, 154A as they interact with the second engagement surface 184, which enhances the compression of the stack to retain the display article. The fully assembled state is known as the first state. The second state is achieved when the annular spacer frame 150 is deflected such that the second and fourth locking tabs 154, 154A are disengaged from the second engagement portion 180. In alternate embodiments, the first and third locking tabs 152, 152A may be disengaged from the first engagement portion 170 to release the annular spacer frame 150 instead of the second and fourth locking tabs 154, 154A.

The compression forces applied by the annular spacer frame 150 as it interacts with the first and second engagement portions 170, 180 are the product of the locking tabs 152, 152A, 154, 154A having an elasticity that functions as a spring. In alternate embodiments, a separate spring feature may be formed on the annular spacer frame 150 to provide the desired compression force. In yet other embodiments, a portion of the annular display frame 110 may provide the required compression force. In yet further embodiments, a compressible material may be applied to one of the annular spacer frame 150 or the annular display frame 110 to provide the required compression force.

The annular spacer frame 150 is intended to have a lower rigidity than the annular display frame 110 so that it is capable of being deflected as it is installed into the annular display frame. In this context, a component is said to have greater rigidity when, for a given length, the component deflects less than the component against which it is compared. Thus, the annular spacer frame 150 is capable of deflecting more than the annular display frame 110 when comparing elongate members of equal length. It is intended that the annular spacer frame 150 of the frame apparatus 100 be designed with a lower rigidity so that it can always be deflected for easy assembly. This lower rigidity may be obtained by materials selection (i.e. choosing a material that has a lower stiffness for the annular spacer frame 150 than the stiffness of the material used for the annular display frame 110) or by design. In achieving the desired lower rigidity, it is possible that the annular spacer frame 150 have features that intentionally lower the rigidity of the annular spacer frame 150. This intentional design may be used to selectively lower the in-plane stiffness of the annular spacer frame 150 while not having a lesser effect on the stiffness of the annular spacer frame 150 in a direction perpendicular to the plane formed by the front surface 112 of the annular display frame 110. Thus, the stiffness may be different in orthogonal directions, so that the annular spacer frame 150 is easy to deflect to engage the locking tabs 152, 154, but provides a strong compression force against the stack.

When the annular spacer frame 150 is installed into the annular display frame 110, the floor 120 of the rabbet 118 conceals the annular spacer frame 150 when the frame apparatus 100 is viewed from the front surface 112 of the annular display frame 110. The inner surface 156 of the annular spacer frame 150 is outwardly offset from the inner surface 116 of the annular display frame 110 by an offset distance D. In some embodiments, the inner surface 156 is coplanar with the inner surface 116. In yet other embodiments, the inner surface 156 is inwardly offset from the inner surface 116 of the annular display frame 110.

Furthermore, the annular spacer frame 150 has a thickness which is less than the depth of the rabbet 118 so that the annular spacer frame 150 is recessed from the rear surface 114 of the annular display frame 110. This permits the frame apparatus 100 to be hung on a wall or other vertical surface, with the rear surface 114 of the annular display frame 110 flush against the wall.

In the preferred embodiment, the annular spacer frame 150 is integrally formed as a singular monolithic component. The annular spacer frame 150 is most preferably injection molded, but may be formed by other methods. This provides a sufficiently rigid structure which may be manufactured cheaply, and improves the ease of assembly. The annular spacer frame 150 is formed as a plurality of elongate members which form the periphery of the annular spacer frame 150. In alternate embodiments, the elongate members may be formed as individual elongate members which are individually formed and inserted into the annular display frame 110. In yet further embodiments, the annular spacer frame 150 may be formed in separate portions to avoid the need for unusually large injection mold tools or other fabrication equipment.

In the exemplary embodiment, hanger elements 168 are incorporated into the annular spacer frame 150 to permit hanging on a nail, hook, or other device mounted on a wall or other surface. The hanger elements 168 may be located on two adjacent sides of the annular spacer frame 150 to permit mounting in a landscape or portrait orientation, or may be included on all four sides for user convenience. The hanger elements 168 are generally formed at the midpoint of the elongate members so that the frame apparatus 100 will hang level. In yet other embodiments, the hangers 168 may be omitted.

Figure 7:
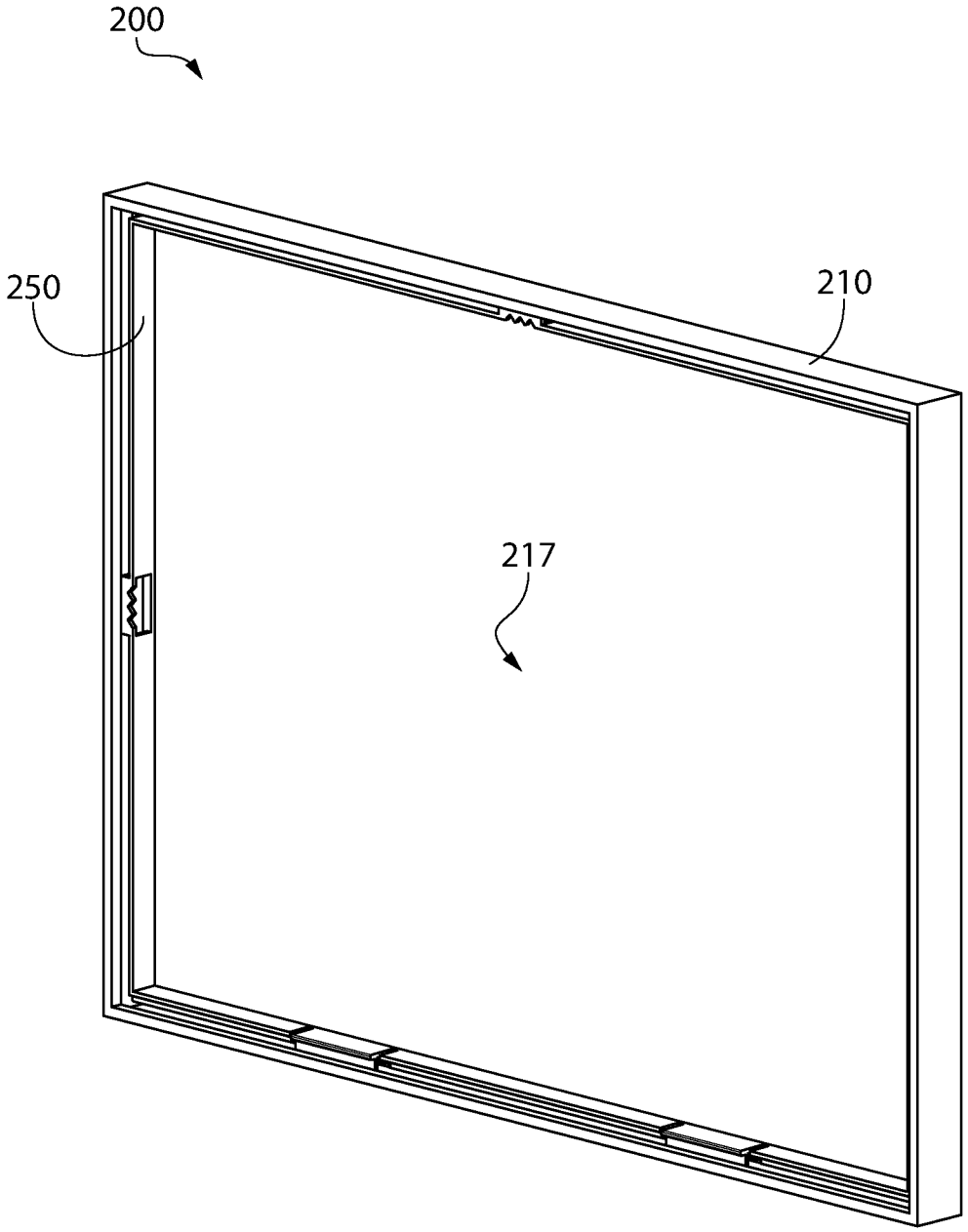
FIG. 7 is a rear perspective view of a frame apparatus according to a second embodiment of the present invention.
Figure 8:
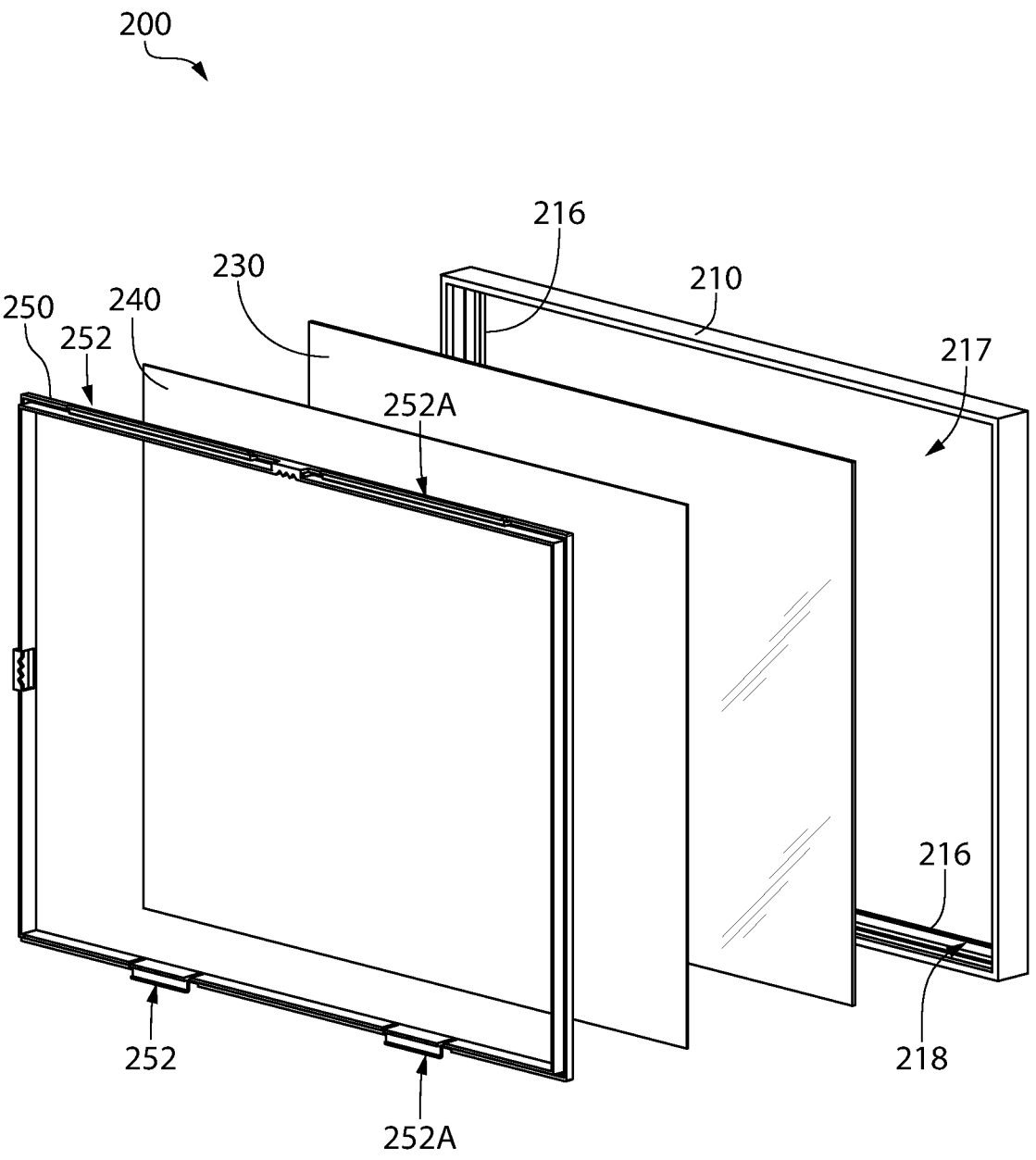
FIG. 8 is an exploded view of the frame apparatus of FIG. 7.
Figure 9:
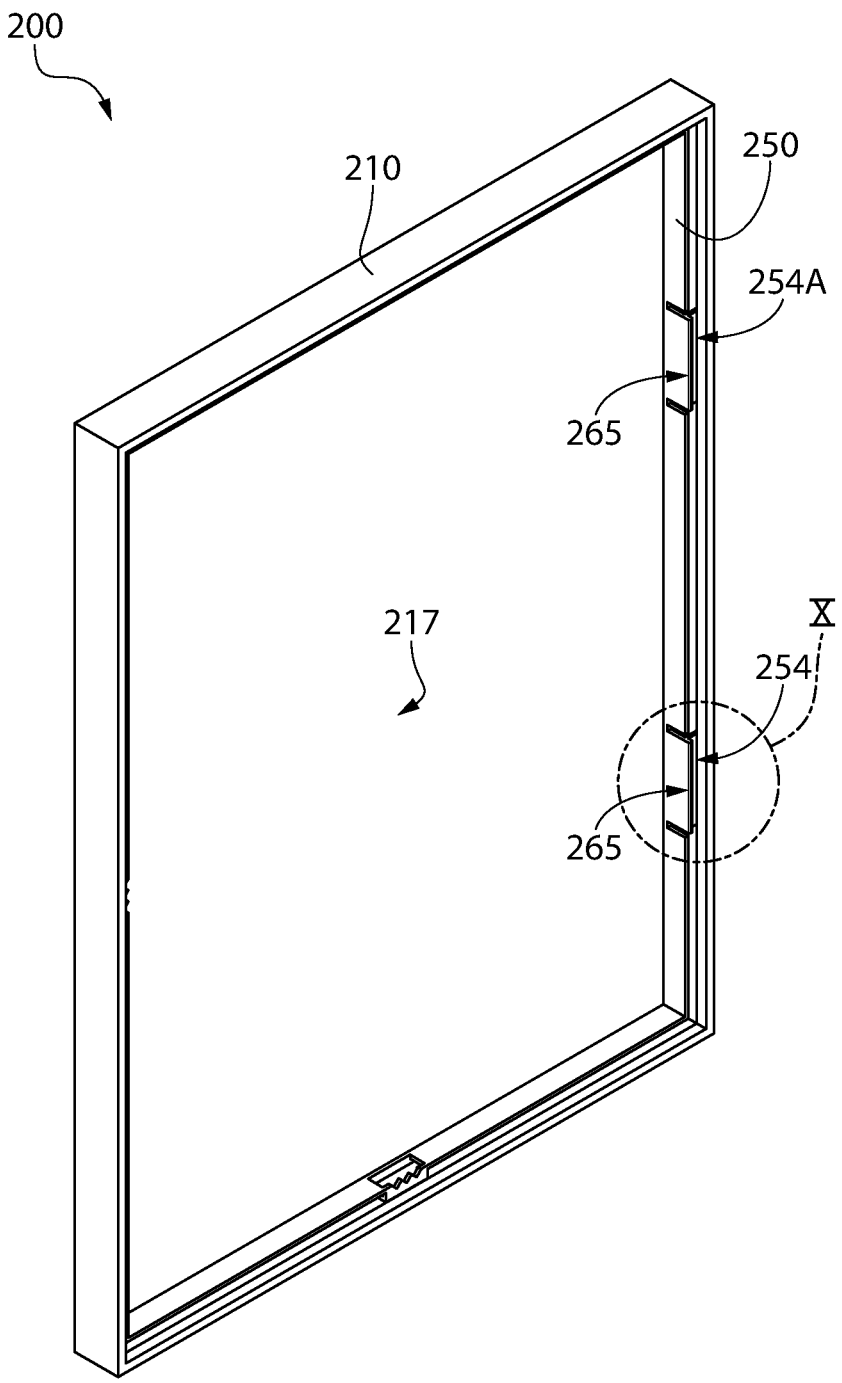
FIG. 9 is another rear perspective view of the frame apparatus of FIG. 7.
Figure 12A:
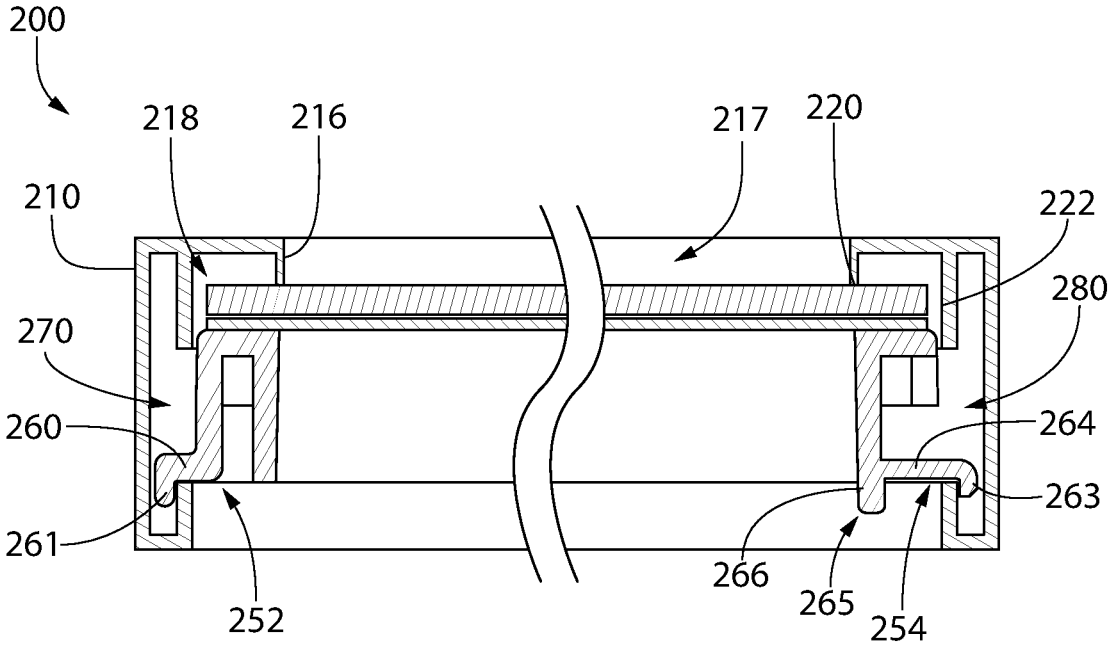
FIG. 12A is a cross-sectional view taken along line XII A-XII A of FIG. 11.
Figure 12B:
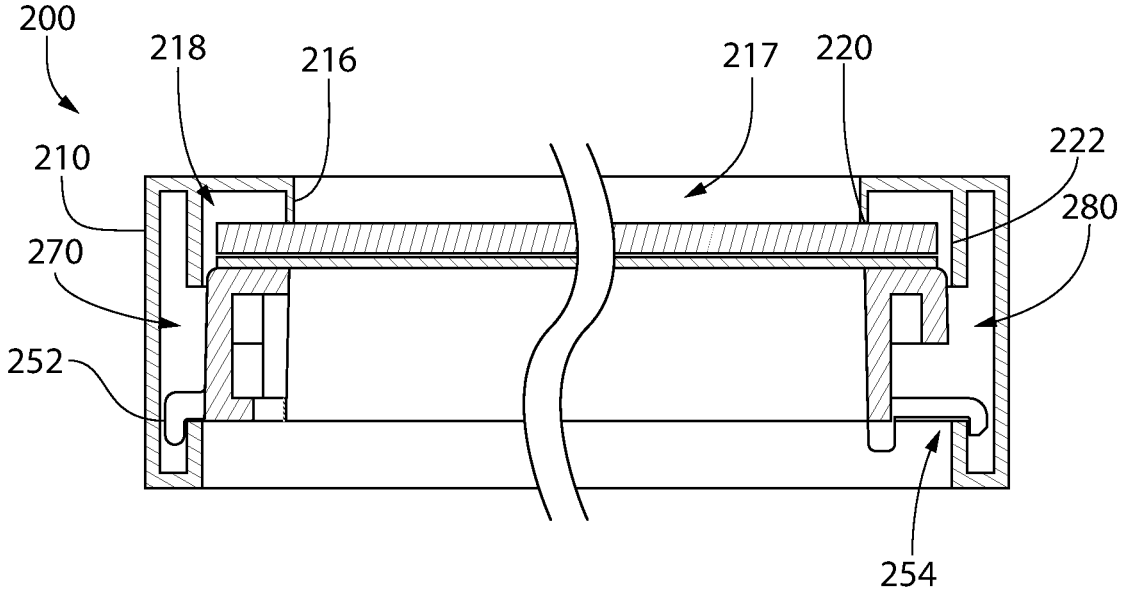
FIG. 12B is a cross-sectional view taken along line XII B-XII B of FIG. 11.

FIGS. 7 and 8 disclose a second embodiment of the frame apparatus of the present invention. In an effort to avoid duplicative disclosure, all features not specifically mentioned are equivalent except as expressly disclosed. The frame apparatus 200 comprises an annular display frame 210, a transparent front panel 230, a rear panel 240, and an annular spacer frame 250. The frame apparatus 200 functions in substantially the same manner as the frame apparatus 100 discussed above. The annular display frame 210 has a display opening 217 formed by the inner surface 216 of the annular display frame 210. As best seen in FIGS. 12A and 12B, the annular display frame 210 also has a rabbet 218 which accepts the transparent front panel 230, the rear panel 240, and the annular spacer frame 250. Once again, the rabbet 218 has a floor 220 and a wall 222. Within the wall 222 is a first engagement portion 270 and a second engagement portion 280.

Figure 10:
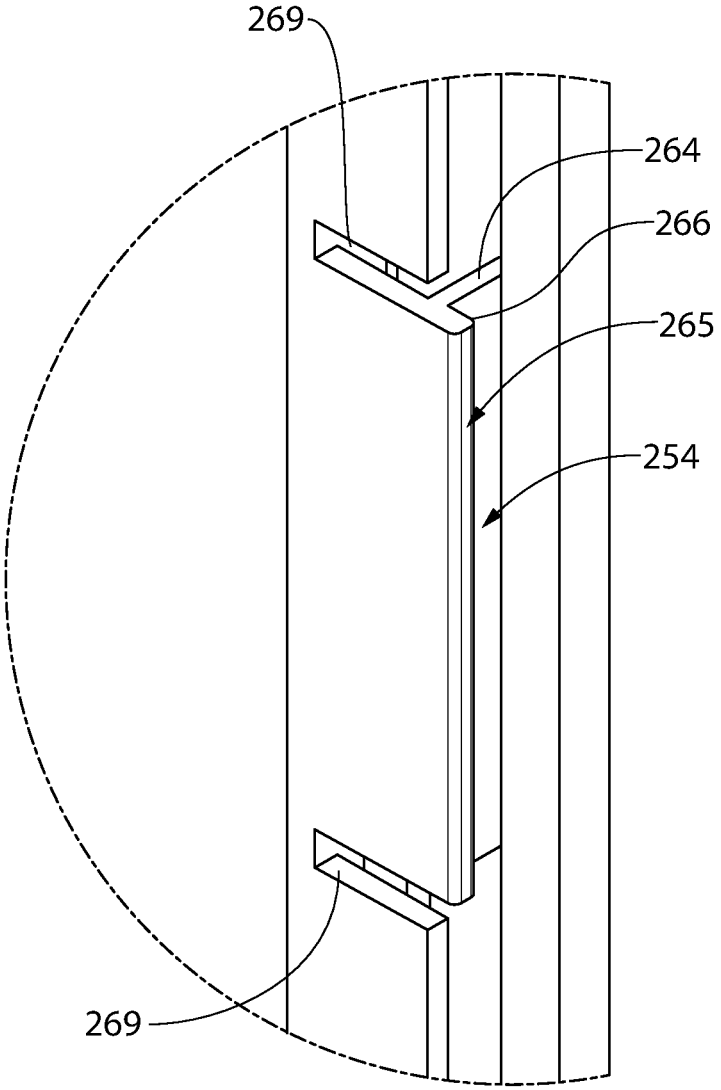
FIG. 10 is an enlarged view of area X of FIG. 9.
Figure 11:
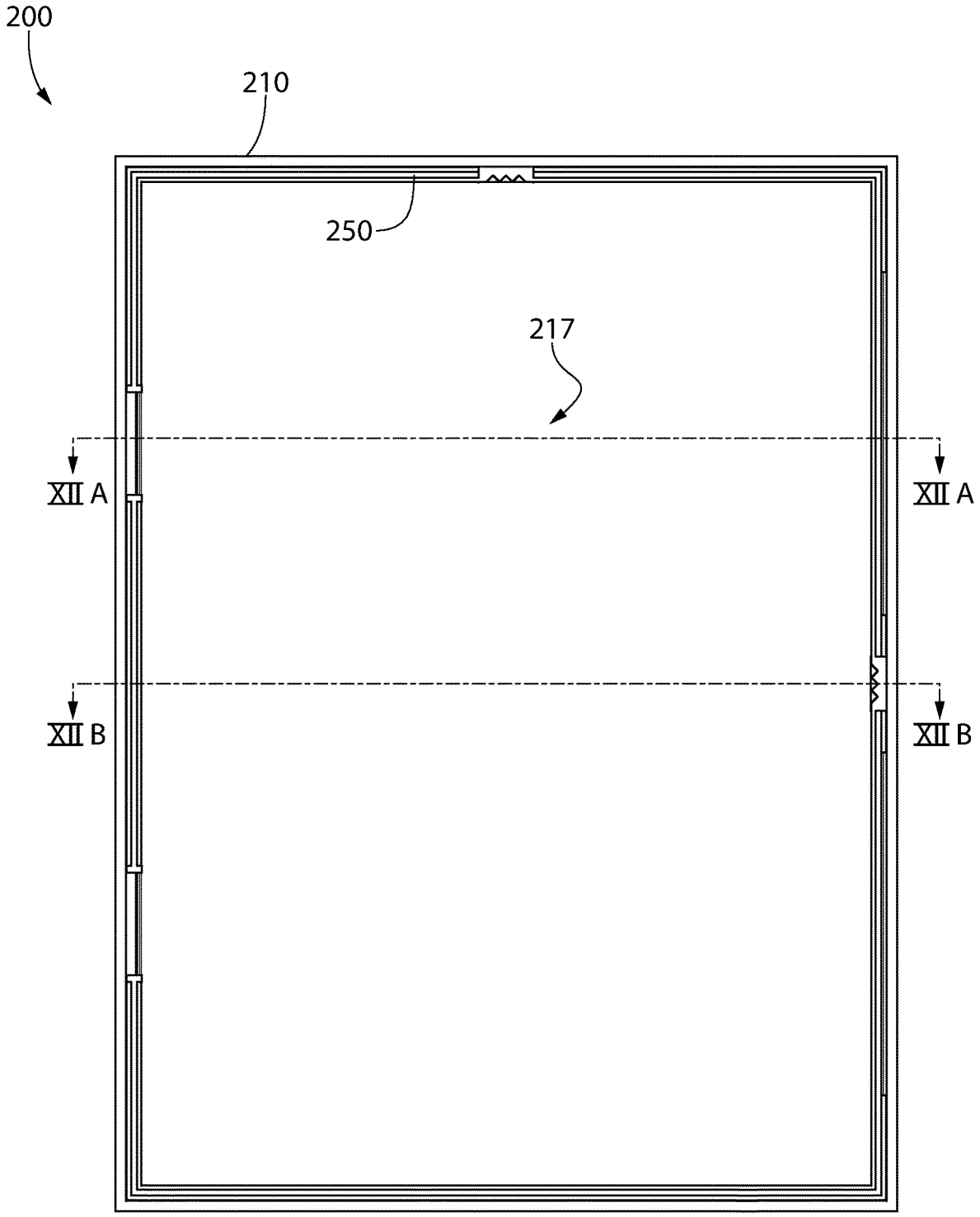
FIG. 11 is a rear view of the frame apparatus of FIG. 1.

As best seen in FIGS. 10, 12A, and 12B, the annular spacer frame 250 has a corresponding set of first and third locking tabs 252, 252A and second and fourth locking tabs 254, 254A which engage the first and second engagement portions 270, 280 of the annular display opening. The first and third locking tabs 252, 252A have a first locking section 260 and a second locking section 261 arranged in a similar configuration to the locking tabs 152 of the annular spacer frame 150 of the first embodiment. The second and fourth locking tabs 254, 254A also have both a first locking section 264 and a second locking section 263, the second locking section extending approximately parallel with the outer surface 258 of the annular spacer frame 250. In other embodiments, the second locking section 263 may extend at any angle which is non-parallel with the first locking section 264. The second locking section 263 increases the retention of the annular spacer frame 250 into the first and second engagement portions 270, 280 to prevent accidental release of the annular spacer frame 250.

The annular spacer 250 also has gripping elements 265 comprising gripping tabs 266 protruding from a rear surface 259 of the annular spacer frame 250. In contrast with the gripping elements 165 of the annular spacer 150 of the frame apparatus 100, these gripping elements 265 also have slots 269 on either side of the gripping tabs 266 which increase the flexibility of the second and fourth locking tabs 254, 254A so that they can more easily be inserted into the second engagement portion 280. Collectively, each of the respective gripping elements 265 and the locking tabs 254, 254A form a latch mechanism when they are bordered by slots 269. This is best shown in FIG. 10, which provides a detailed view of the second locking tab 254. These latch mechanisms permit individual locking of the second and fourth locking tabs 254, 254A due to the additional flexibility afforded by the slots 269.

Turning to the third embodiment of the present invention, the frame apparatus 300 disclosed in FIGS. 13-19 has an annular display frame 310, a transparent front panel 330, a rear panel 340, and an annular spacer frame 350. The annular display frame 310 has a display opening 317 formed by the inner surface 316 of the annular display frame 310. The annular display frame 310 also has a rabbet 318 which accepts the transparent front panel 330, the rear panel 340, and the annular spacer frame 350. Once again, the rabbet 318 has a floor 320 and a wall 322. Within the wall 322 is a first engagement portion 370 and a second engagement portion 380.

Figure 13:
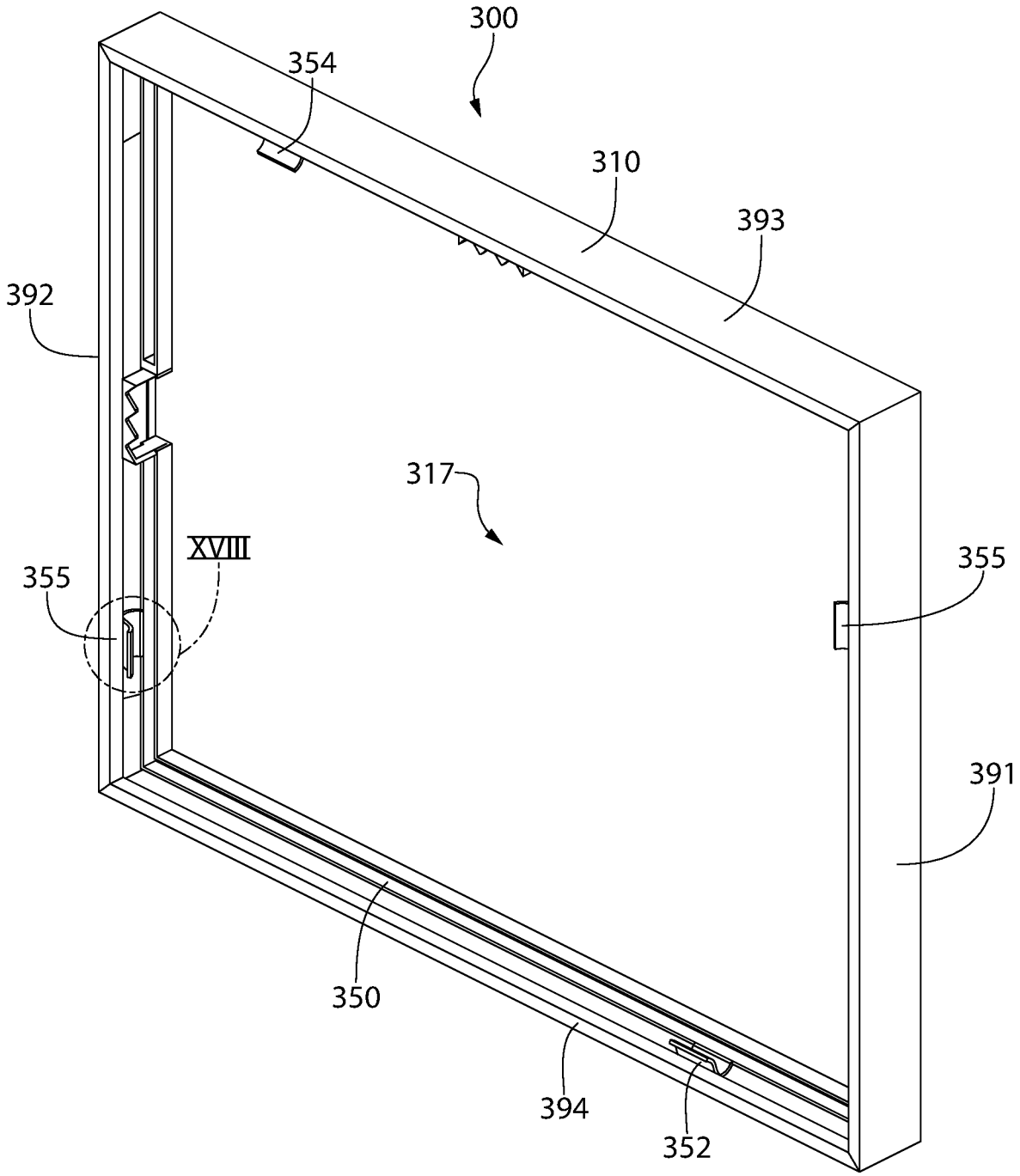
FIG. 13 is a rear perspective view of a frame apparatus in accordance with a third embodiment of the present invention.
Figure 14:
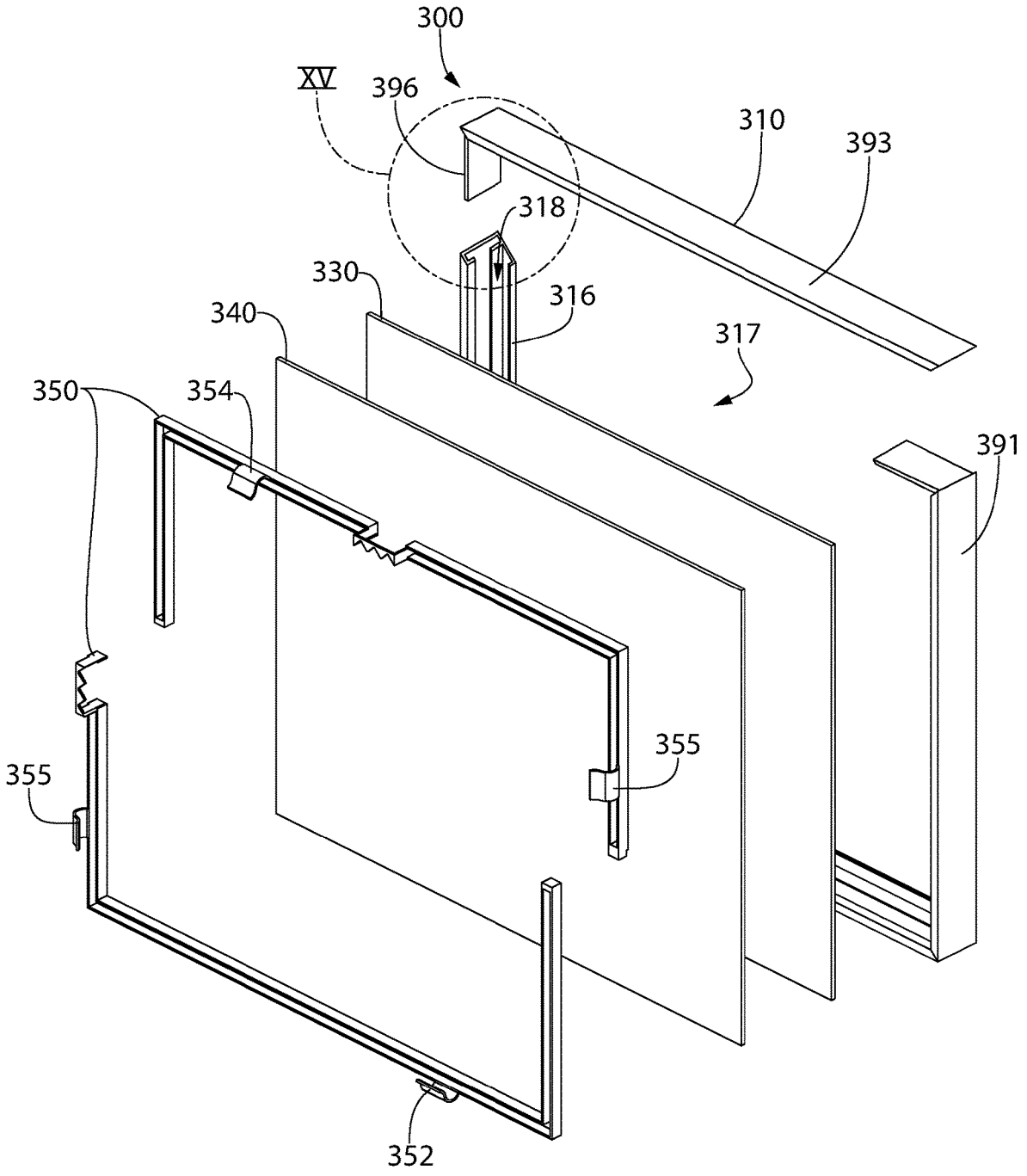
FIG. 14 is an exploded view of the frame apparatus of FIG. 13.
Figure 15:
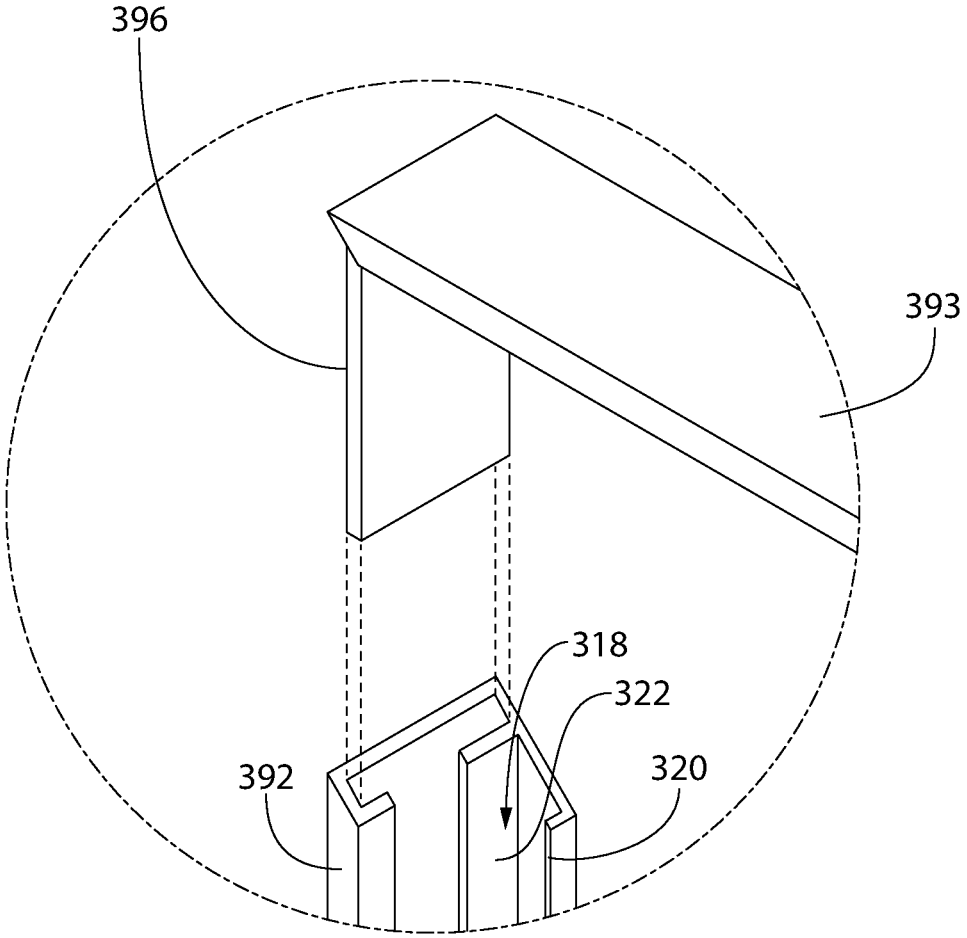
FIG. 15 is an enlarged view of area XV of FIG. 14.
Figure 16:
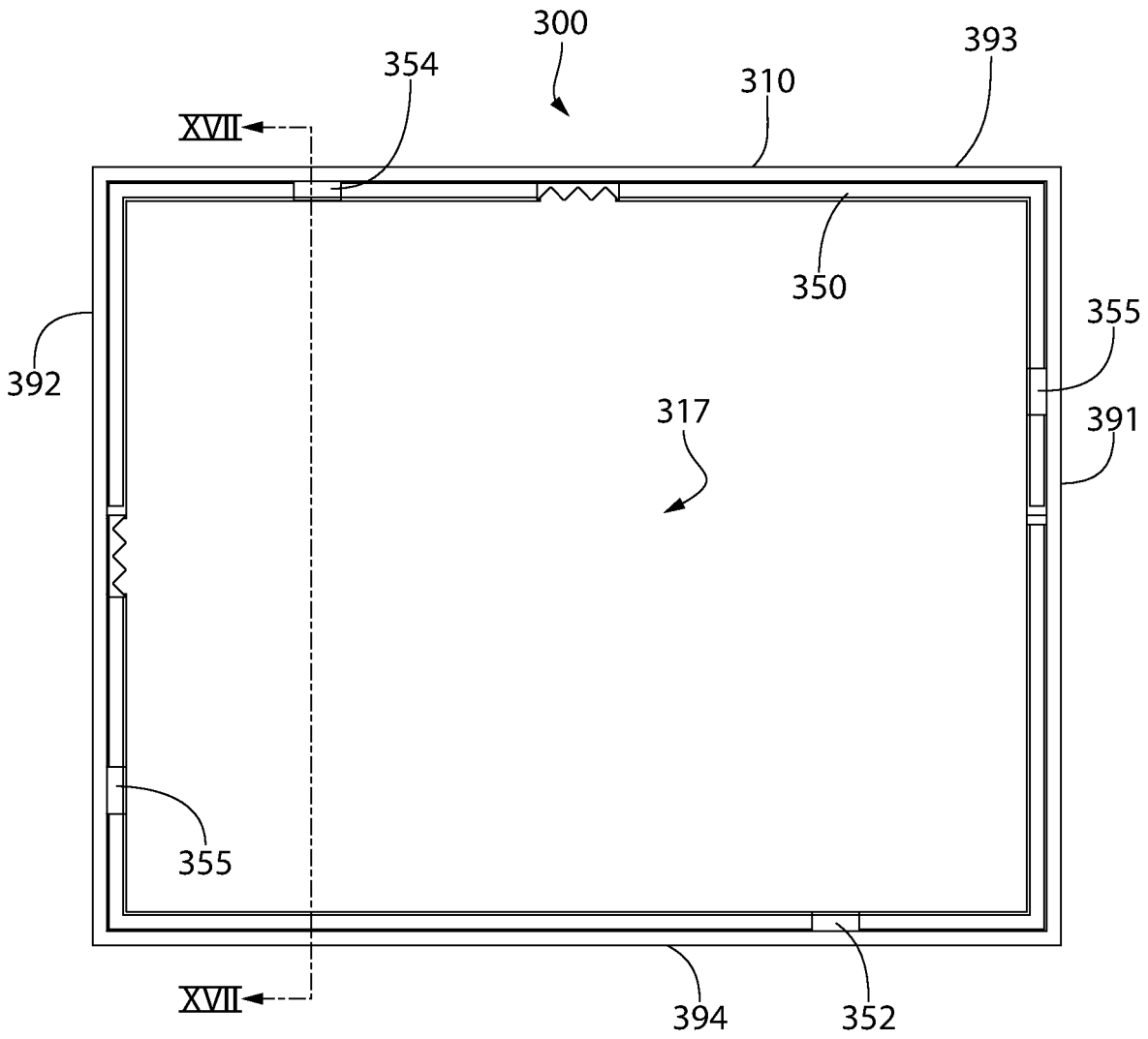
FIG. 16 is a rear view of the frame apparatus of FIG. 13.
Figure 17:
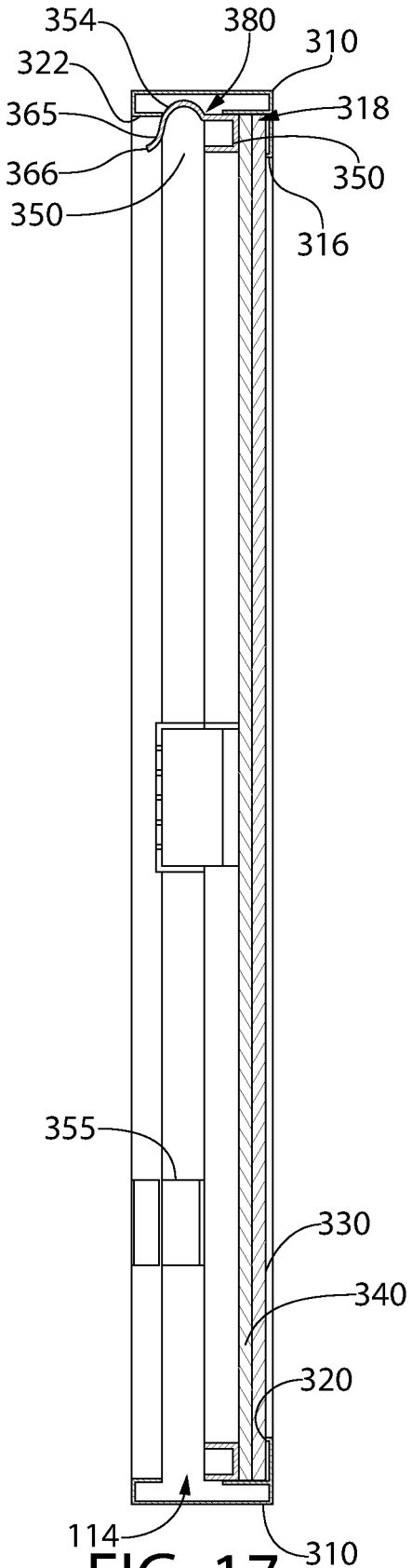
FIG. 17 is a cross-sectional view taken along line XVII-XVII of FIG. 16.
Figure 18:
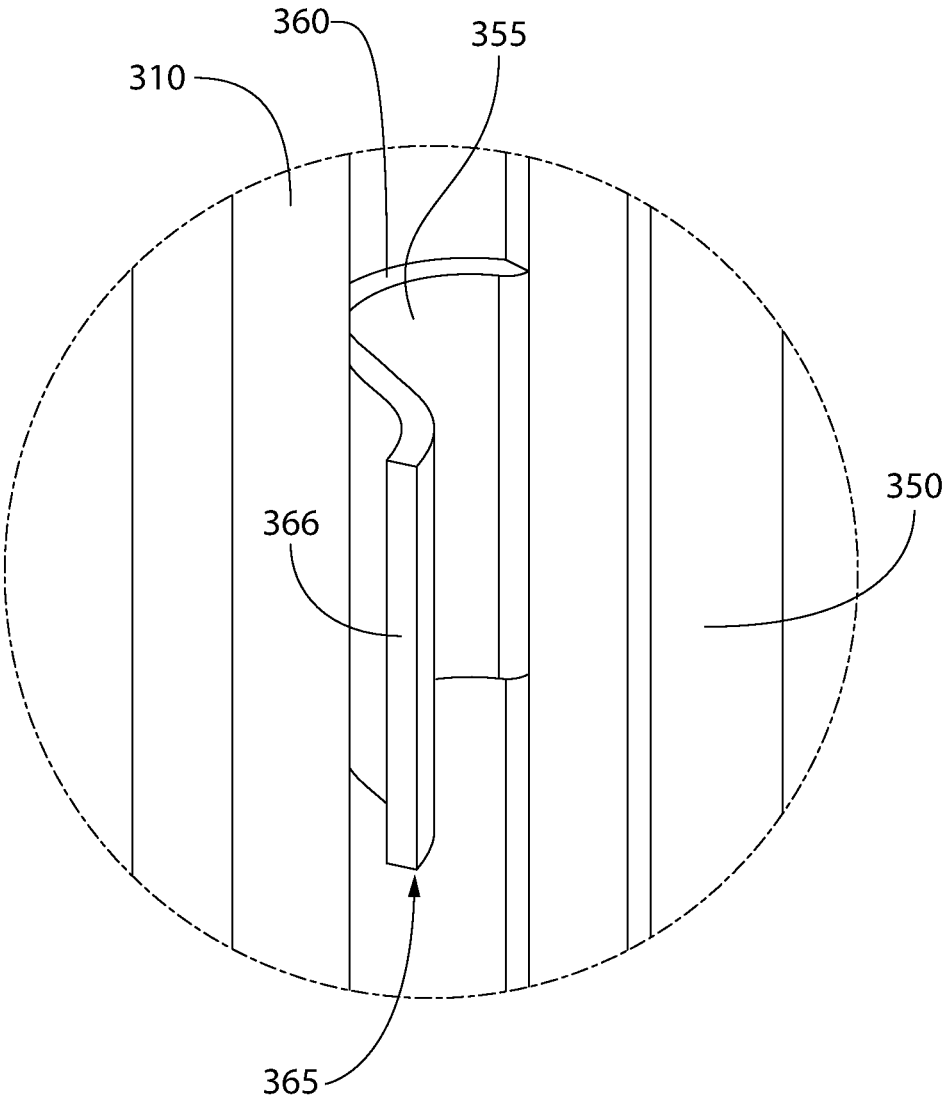
FIG. 18 is an enlarged view of area XVIII of FIG. 13.
Figure 19:
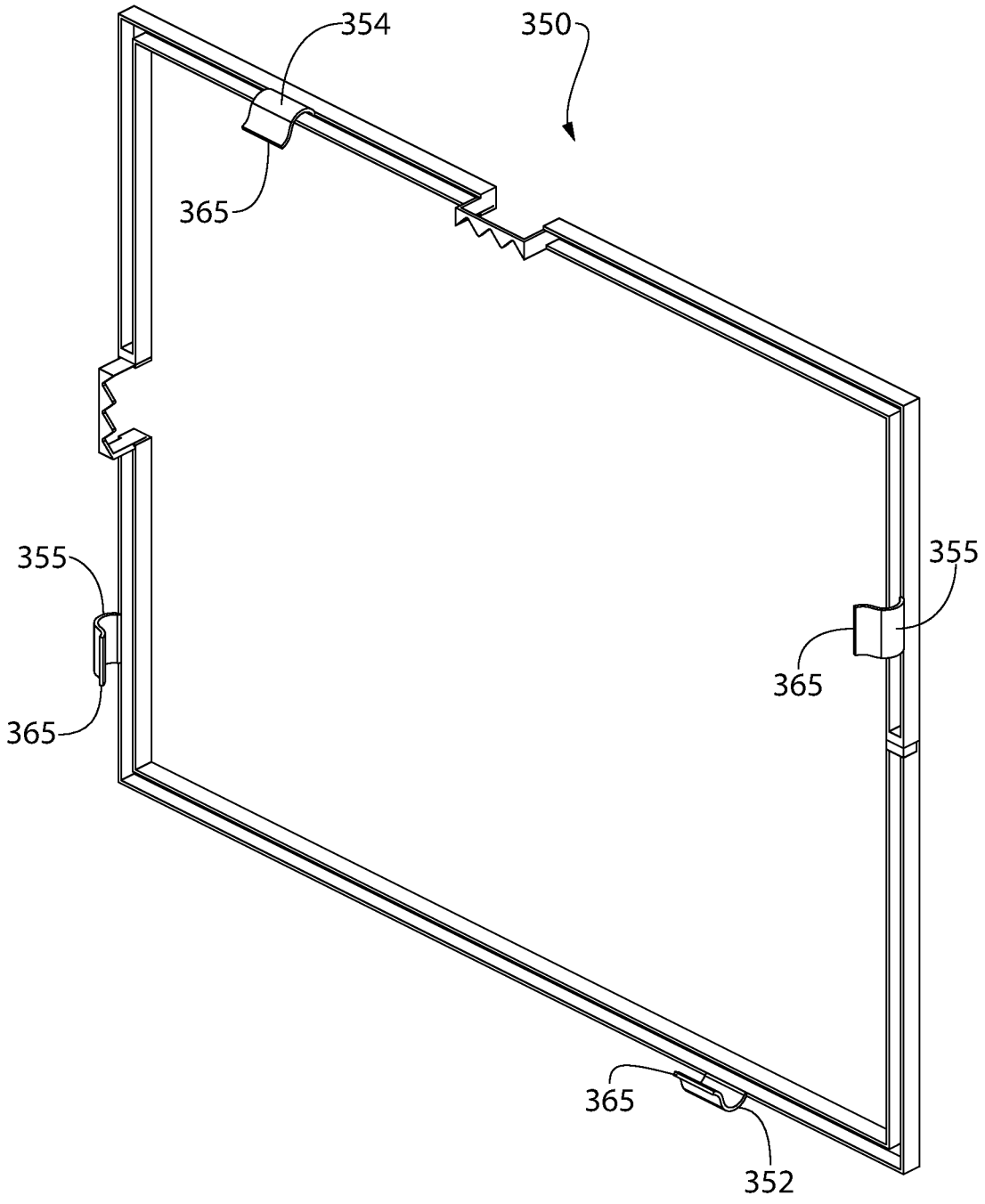
FIG. 19 is a rear perspective view of the annular spacer frame of FIG. 13.
Figure 20:
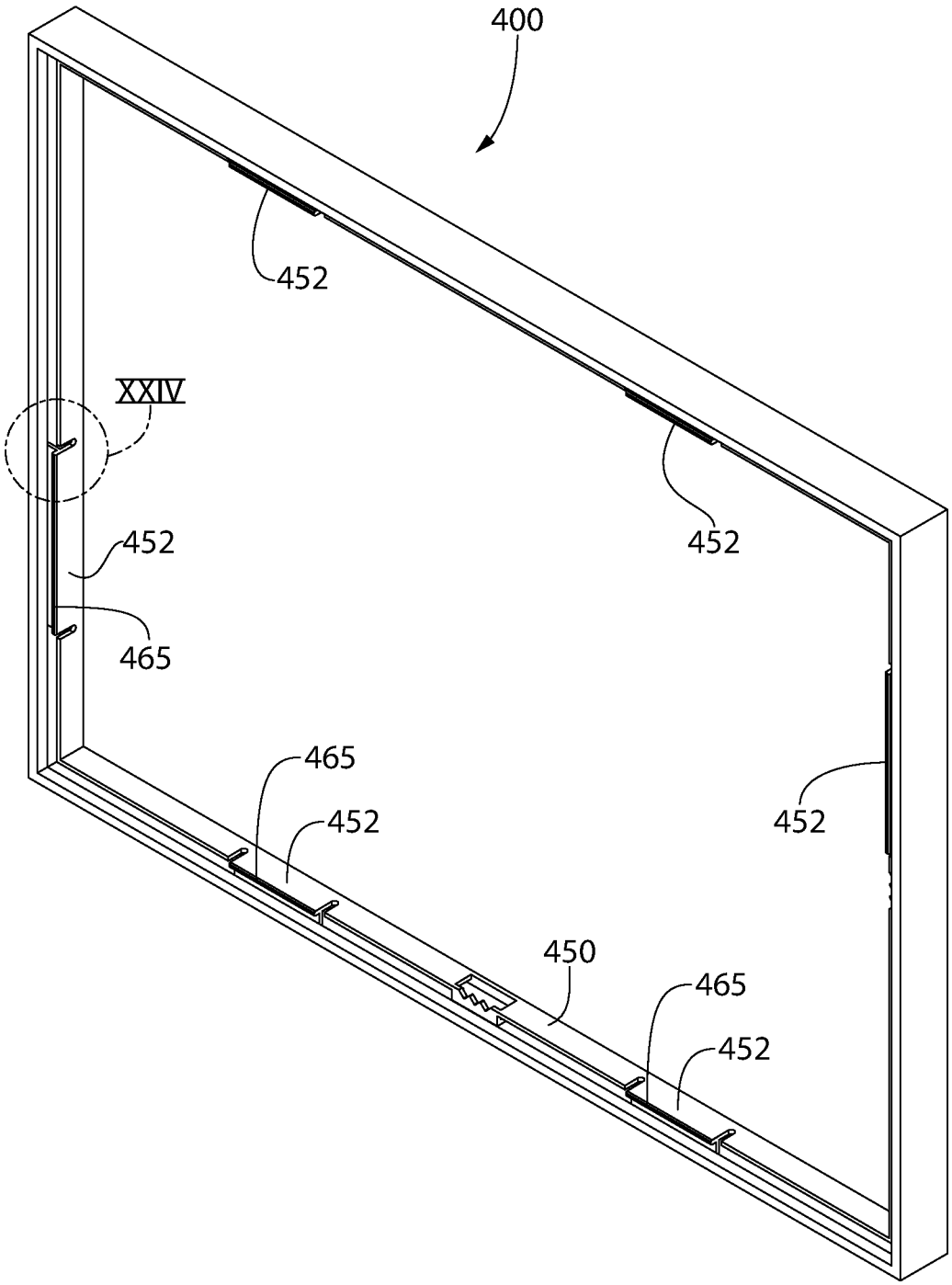
FIG. 20 is a rear perspective view of a frame apparatus according to a fourth embodiment of the present invention.
Figure 21:
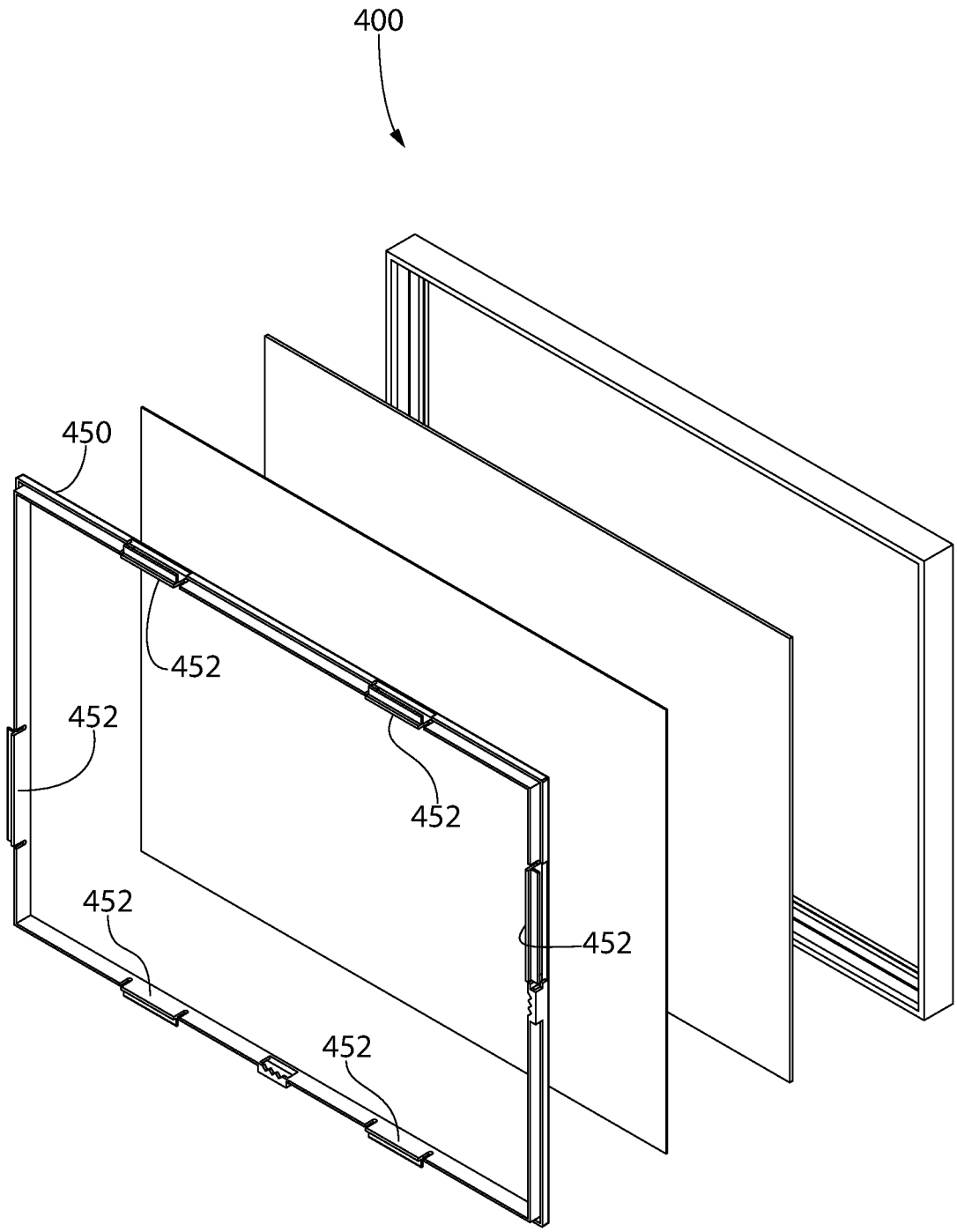
FIG. 21 is an exploded view of the frame apparatus of FIG. 20.
Figure 22:
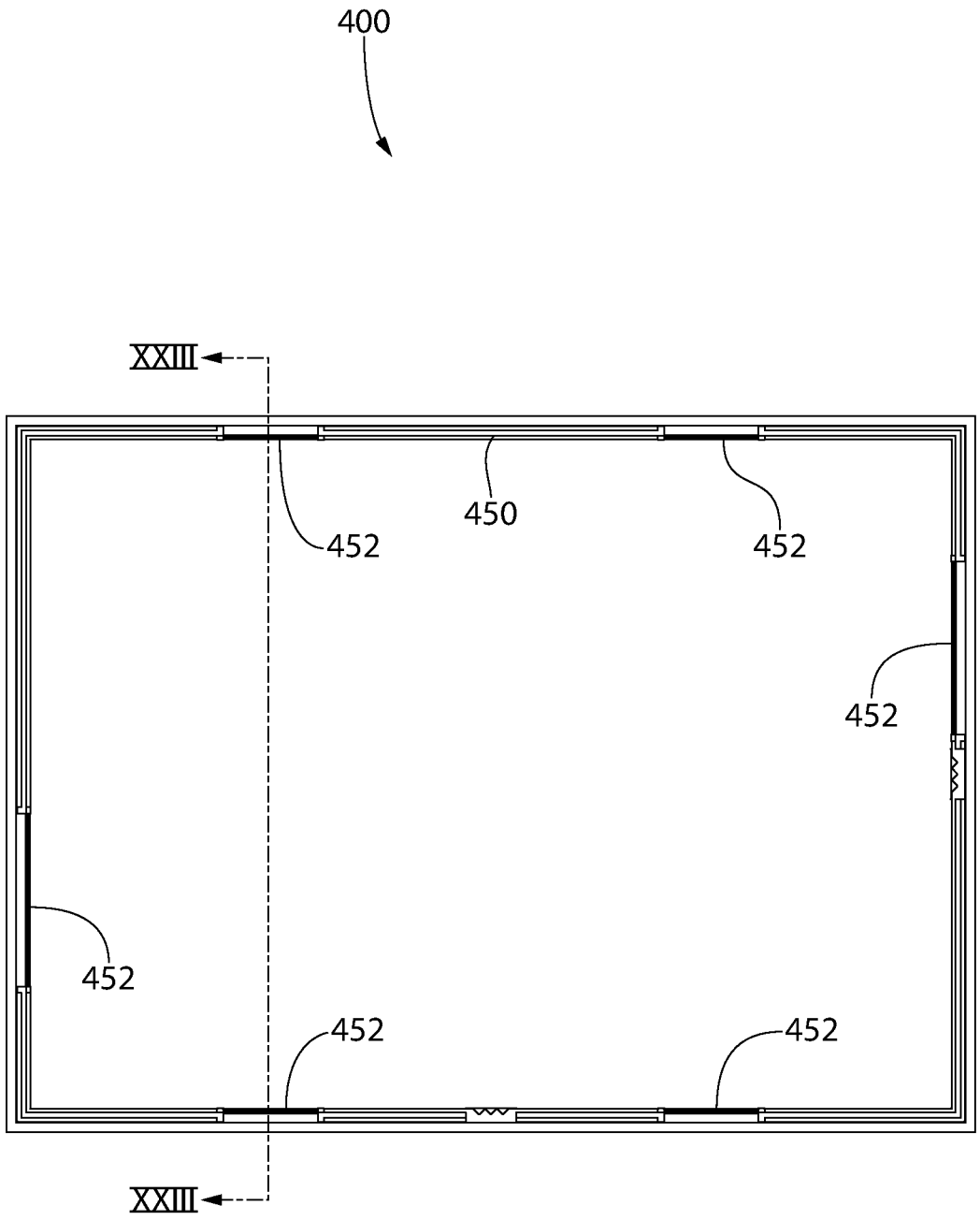
FIG. 22 is a rear view of the frame apparatus of FIG. 20.
Figure 23:
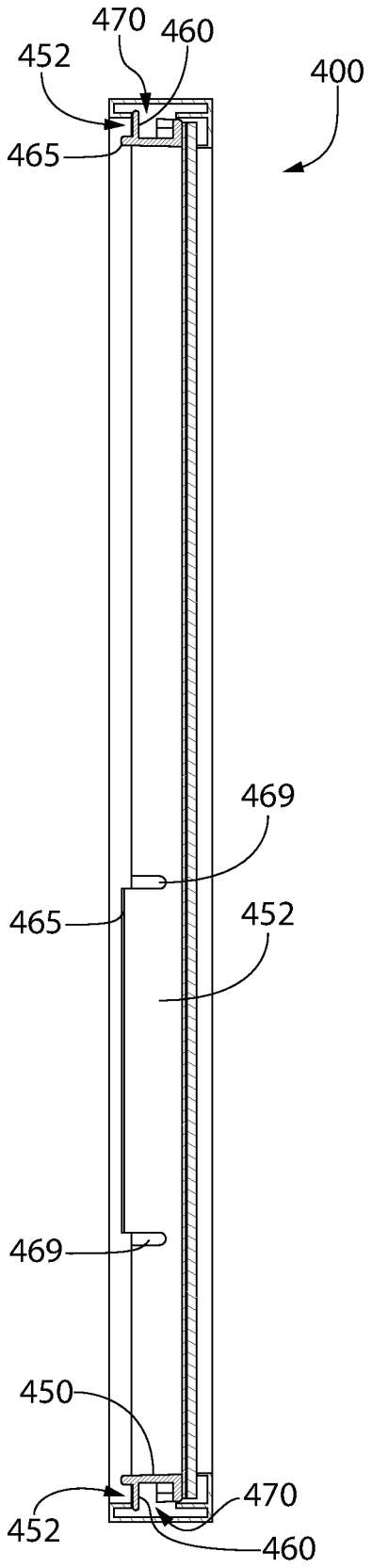
FIG. 23 is a cross-sectional view taken along line XXIII-XXIII of FIG. 22.
Figure 24:
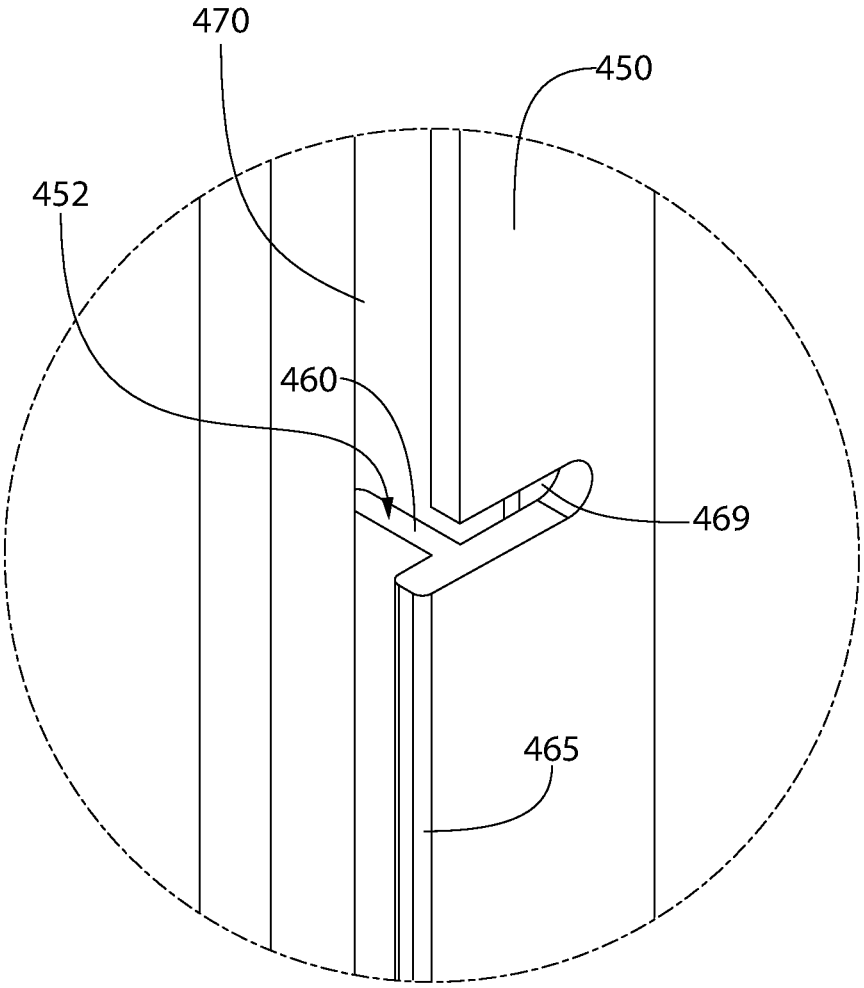
FIG. 24 is an enlarged view of area XXIV of FIG. 20.
Figure 25:
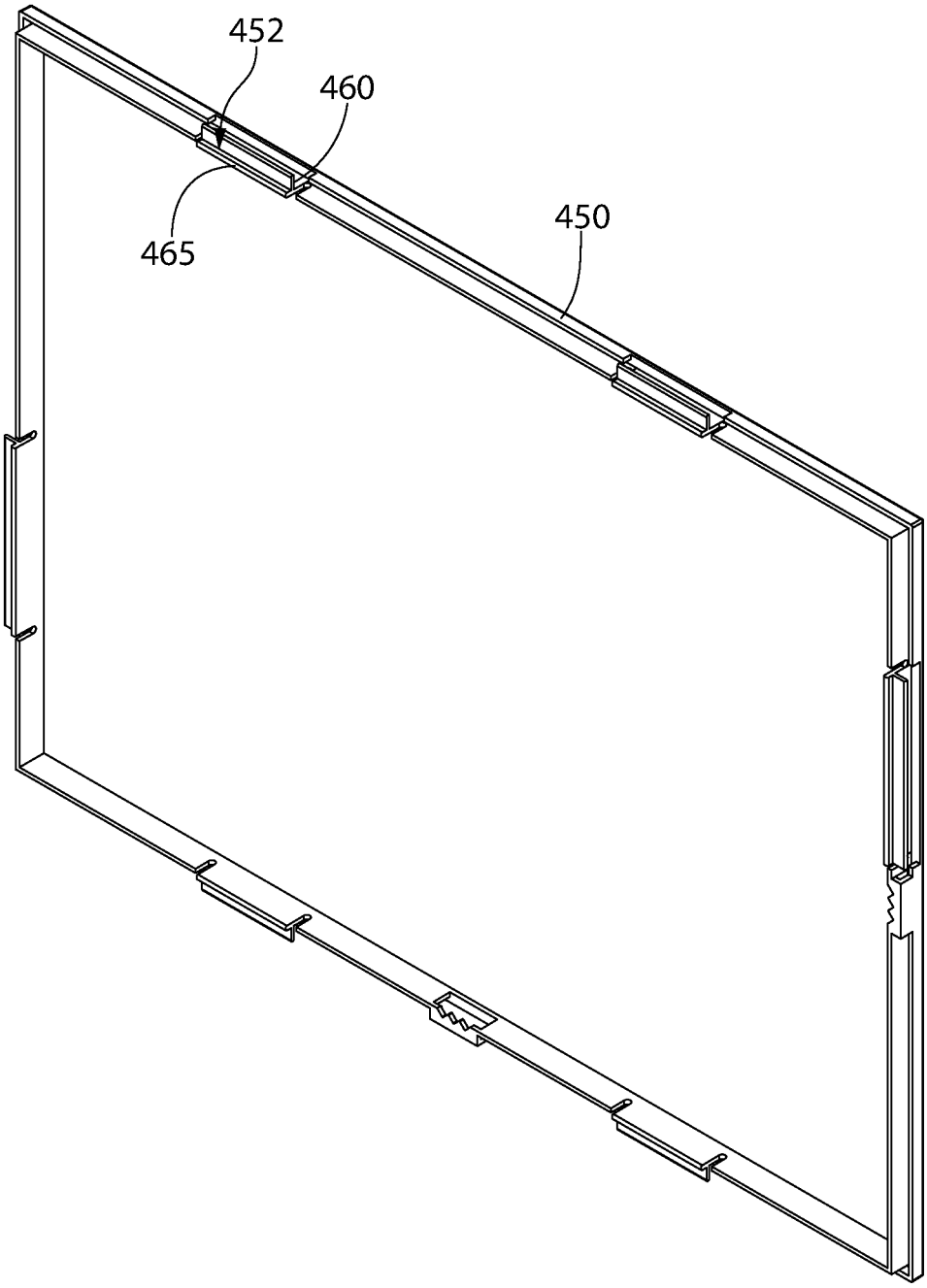
FIG. 25 is a rear perspective view of the annular spacer frame of FIG. 20.
Figure 26:
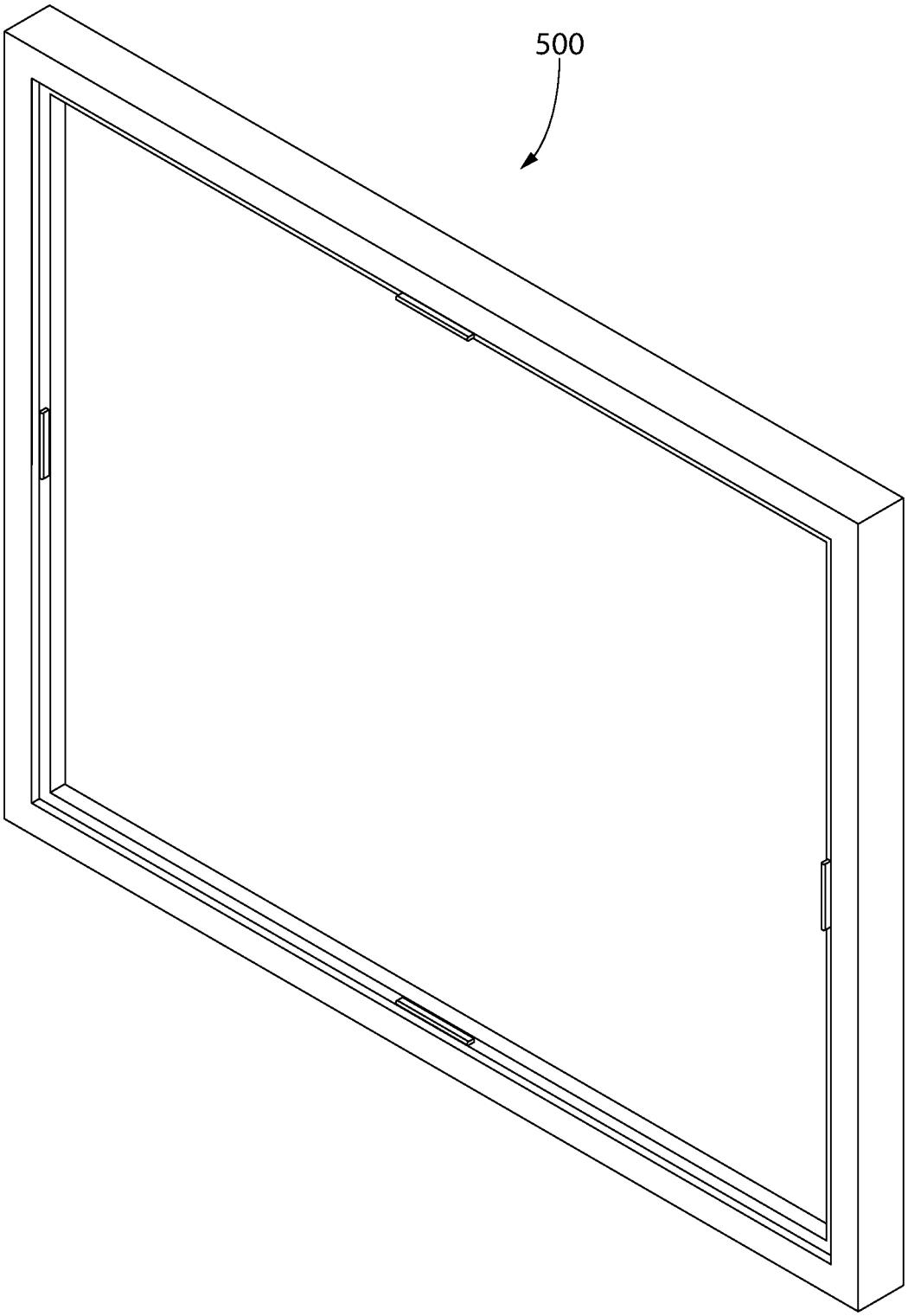
FIG. 26 is a rear perspective view of a frame apparatus according to a fifth embodiment of the present invention.
Figure 27:
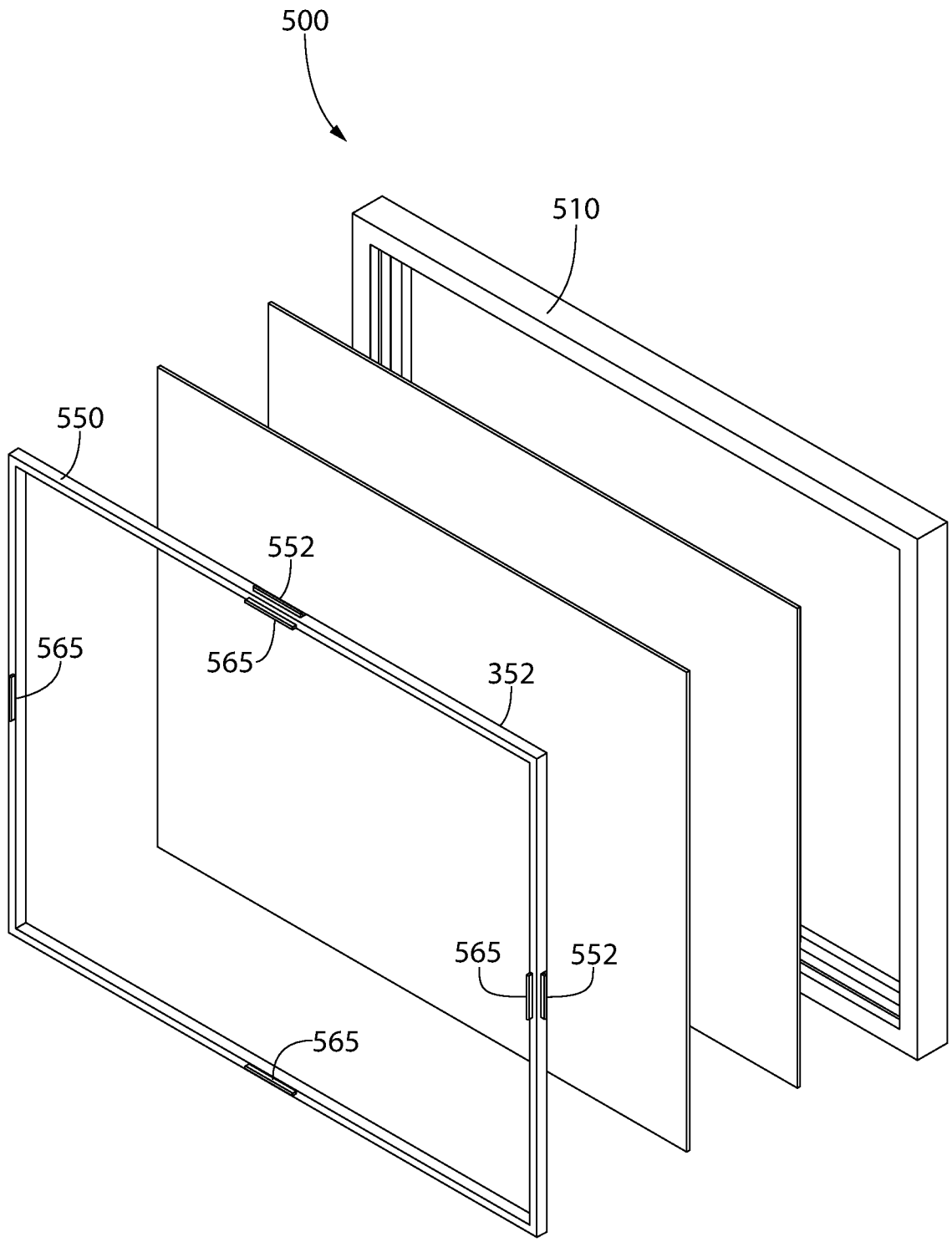
FIG. 27 is an exploded view of the frame apparatus of FIG. 26.
Figure 28:
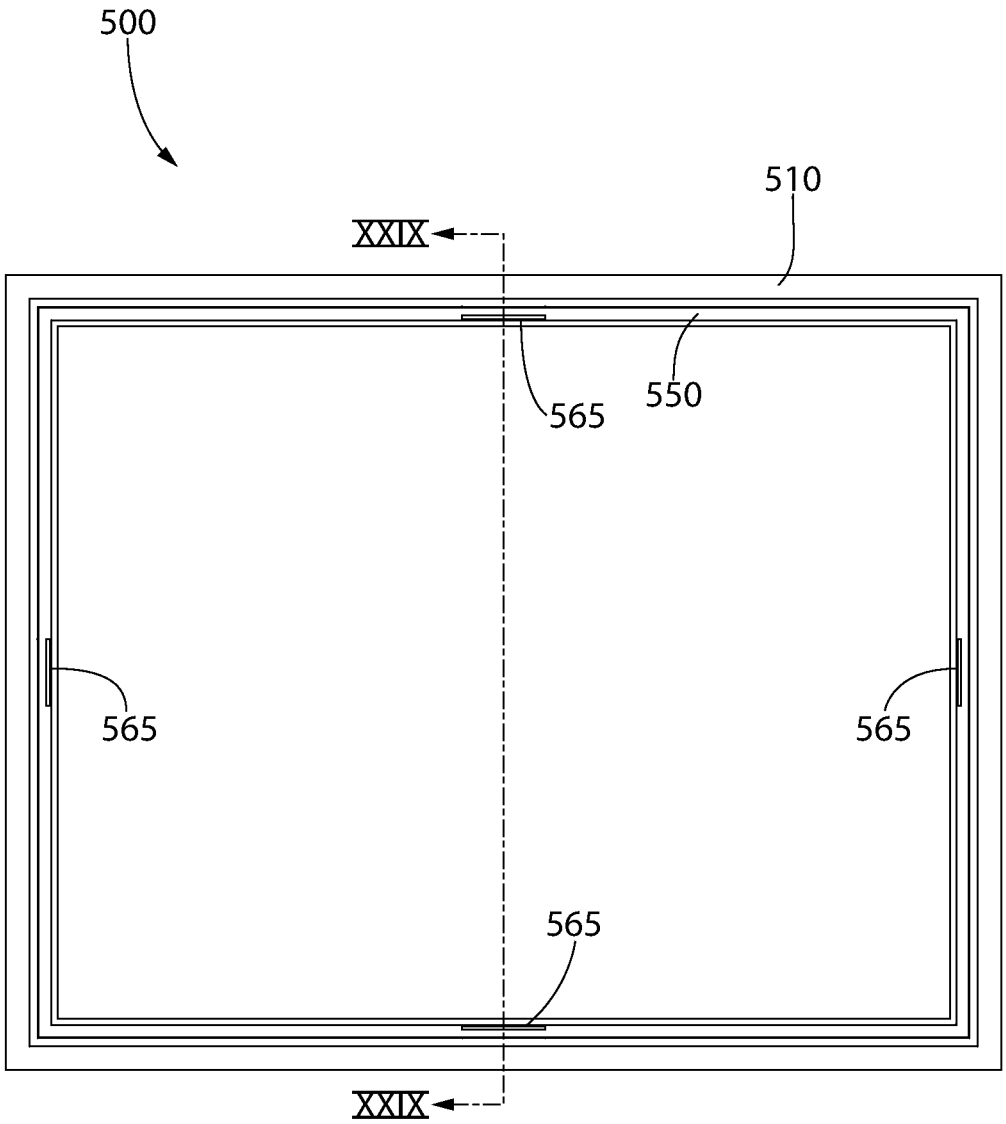
FIG. 28 is a rear view of the frame apparatus of FIG. 26.
Figure 29:
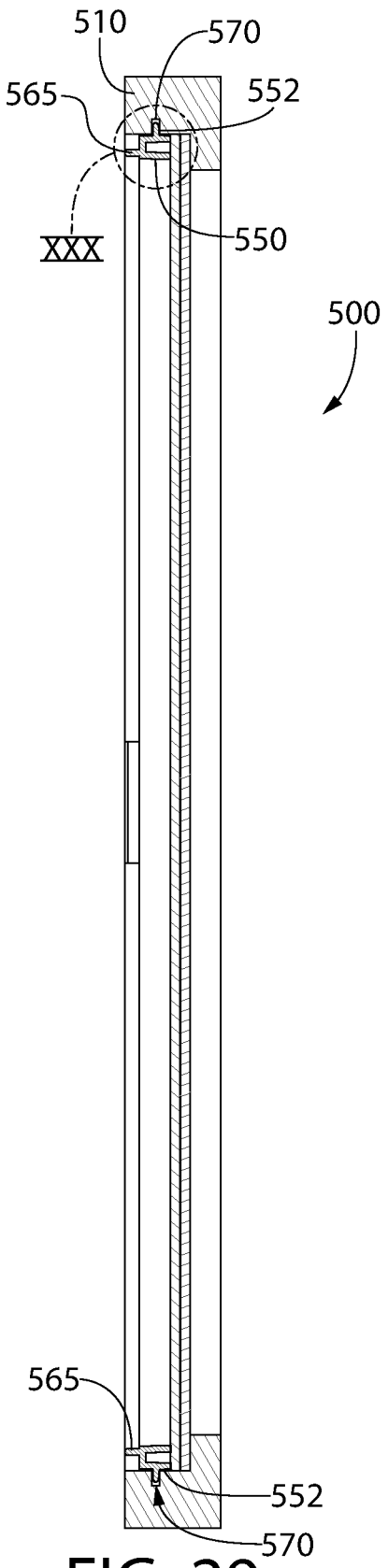
FIG. 29 is a cross-sectional view taken along line XXIX-XXIX of FIG. 28.
Figure 30:
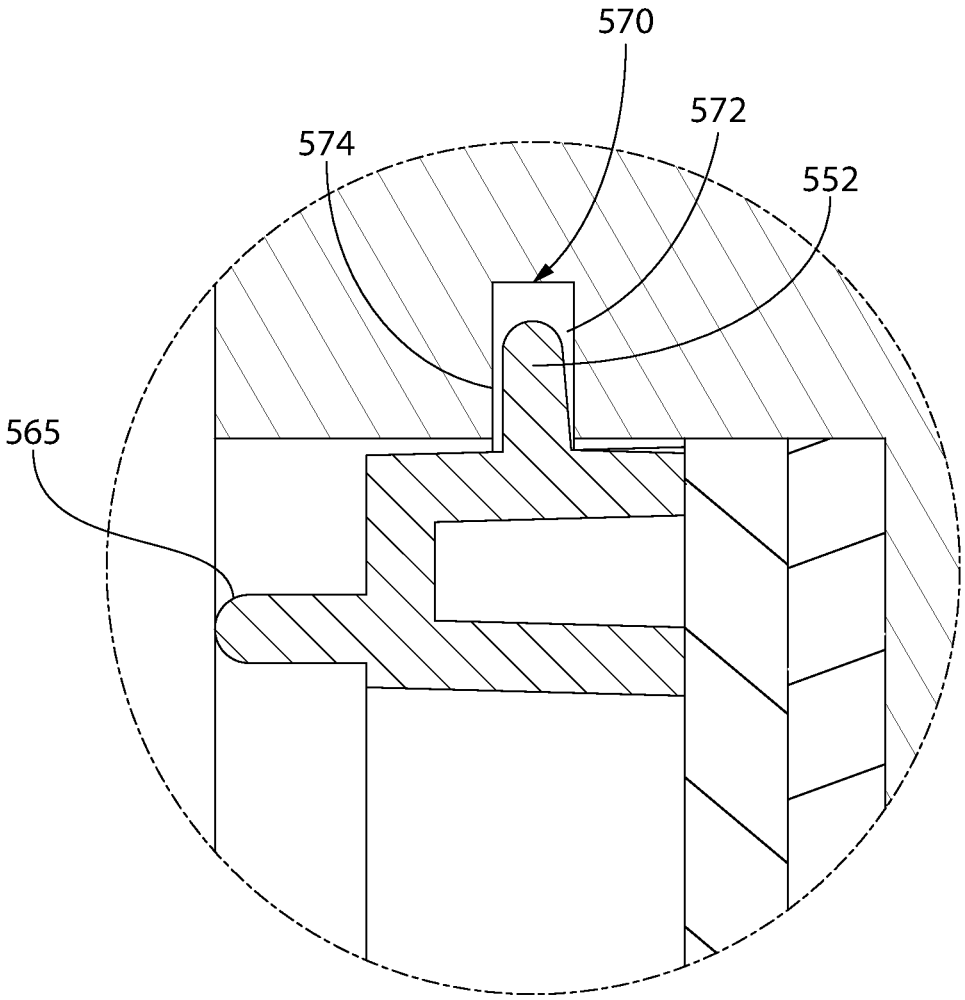
FIG. 30 is an enlarged view of area XXX of FIG. 29.
Figure 31:
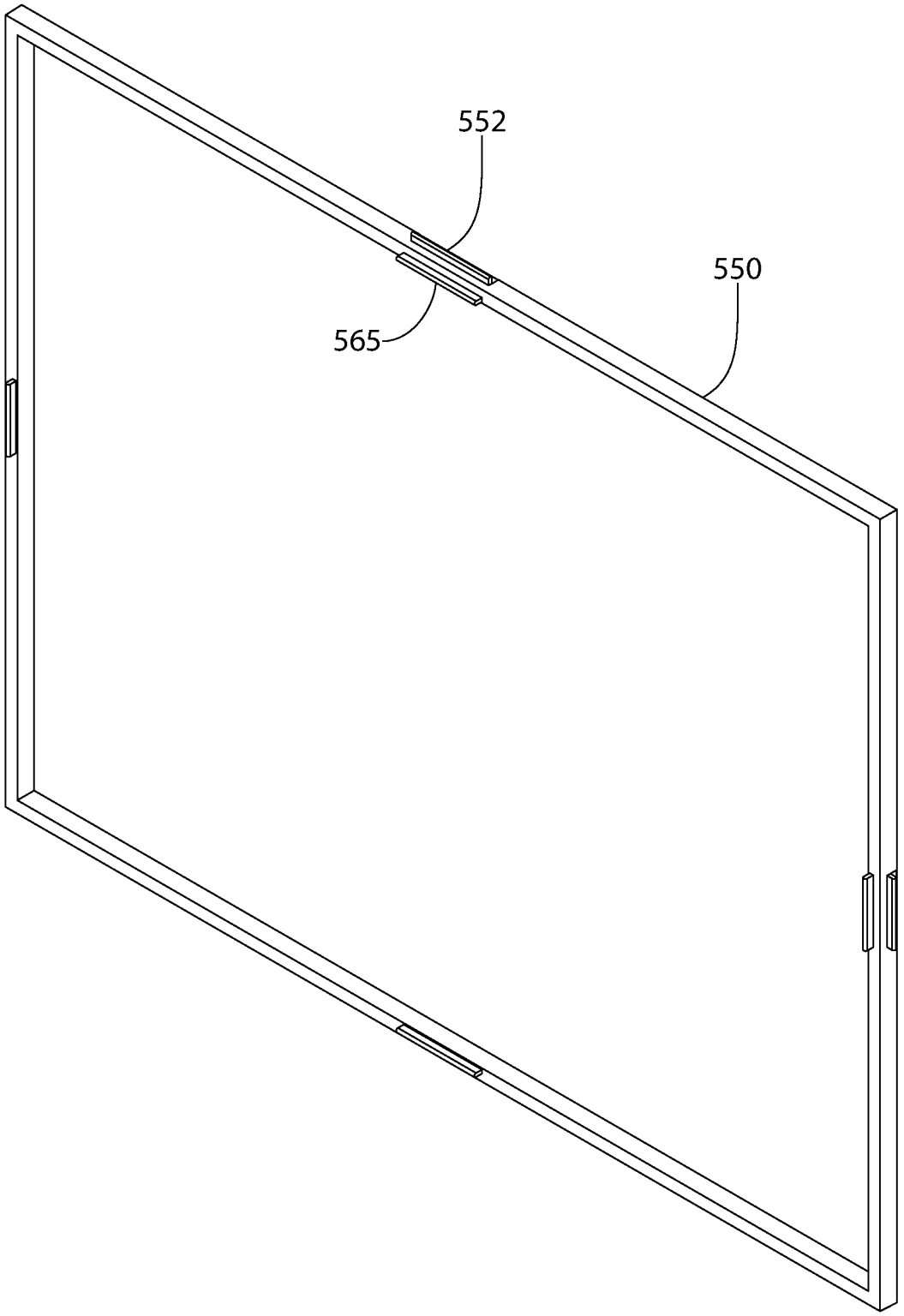
FIG. 31 is a rear perspective view of the annular spacer frame of FIG. 26.

Details of the construction of the annular display frame 310 are shown in greater detail in FIGS. 13-15. The two short sides 391, 392 and the two long sides 393, 394 are connected by a corner bracket 396. The corner bracket 396 may be crimped into place within the extrusion to form a strong connection and results in a very rigid annular display frame 310.

The annular spacer frame 350 is also constructed so that it has a first locking tab 352 and a second locking tab 354 provided on opposite elongate members. The annular spacer frame 350 is constructed in two pieces. In addition, the annular spacer frame has third locking tabs 355 located on perpendicular elongate members, such that all four sides engage the annular display frame 310.

The first, second, and third locking tabs 352, 354, 355 are curved so as to apply a spring pressure on the stack, and may deflect to accommodate differing thicknesses of display articles. The locking tabs 352, 354, 355 of this embodiment are identically formed, and have only a single first locking section 360 which engages the first engagement surface 374 of the engagement portion 370. The gripping elements 365 are integrally formed with the first locking section 360, such that a latch mechanism is formed in by the C-shaped curvature of the locking tabs 352, 354, 355 and the gripping elements 365, and no additional features are required to provide the user with a gripping area to engage or disengage the latch mechanism. This design also provides the necessary compression force, requiring no additional geometry. Individual engagement of each of the locking tabs 352, 354, 355 is possible due to the flexibility inherent in the C-shaped curvature.

Turning to FIGS. 20-25, a fourth embodiment of the frame apparatus 400 is shown. The present embodiment differs from the first embodiment in that it has a different design for the annular spacer frame 450. The annular spacer frame 450 has locking tabs 452 having a first locking section 460 which are formed with a straight profile. Furthermore, not all of the locking tabs 452 are identical, with some having a greater length than others. The first locking section 460 protrudes at a slight upward incline to pre-load the annular spacer frame 450 against the stack when assembled. The first locking section 460 may also incorporate ribs or other features designed to crush to enhance assembly. In other embodiments, there may be serrations designed to catch on the engagement portions 470 and permit adjustment of the desired compression. As with the frame apparatus 200, the locking tabs 452 are bordered by slots 469 which reduce the amount of force required to deflect the locking tabs 452 during installation. These may be omitted in alternate embodiments. In the present embodiment, six locking tabs 452 and six gripping elements 465 are used to ensure adequate pressure against the stack with a sufficiently even distribution to prevent movement of the display article.

In a fifth embodiment of the frame apparatus 500 as shown in FIGS. 26-31, the annular spacer frame 550 is constructed with four locking tabs 552 and four gripping elements 565. Further, there are no slots because the annular spacer frame 550 has been designed to permit deflection during installation without requiring excessive force. This embodiment is directed toward smaller frames that require fewer locking tabs 552 to apply even pressure to the stack. In some embodiments the number of locking tabs 552 and the number of gripping elements 565 may not be equal, and they may not be located proximate each other along the elongate members.

Of particular note, the annular display frame 510 has an engagement portion 570 which is formed a simple groove having only an entry section 572 having a first engagement surface 574. There is no locking section because it is not required to provide the desired level of retention and compression force. Furthermore, the annular display frame 510 is formed of a solid material rather than an extrusion.

Figure 32:
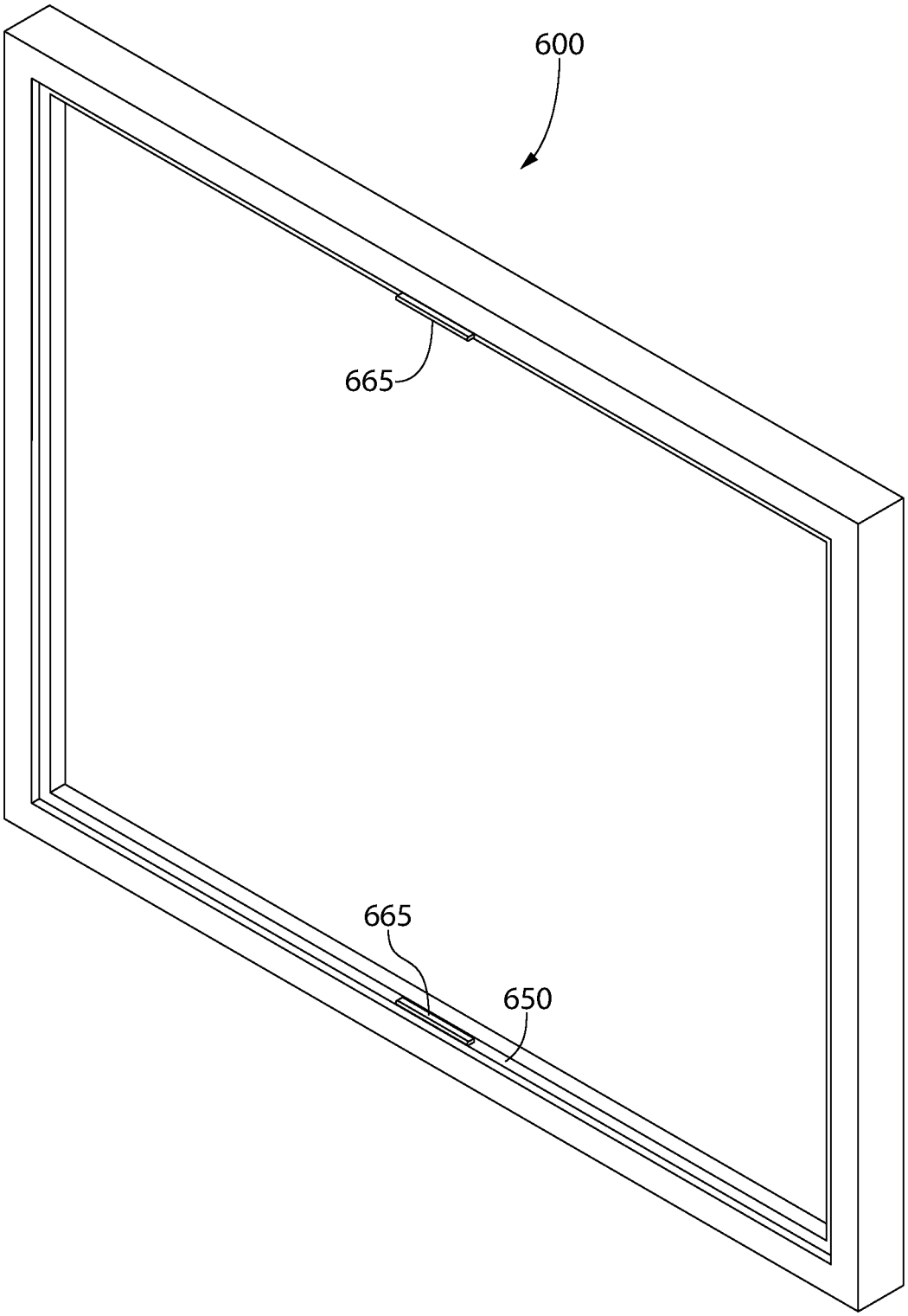
FIG. 32 is a rear perspective view of a frame apparatus according to a sixth embodiment of the present invention.
Figure 33:
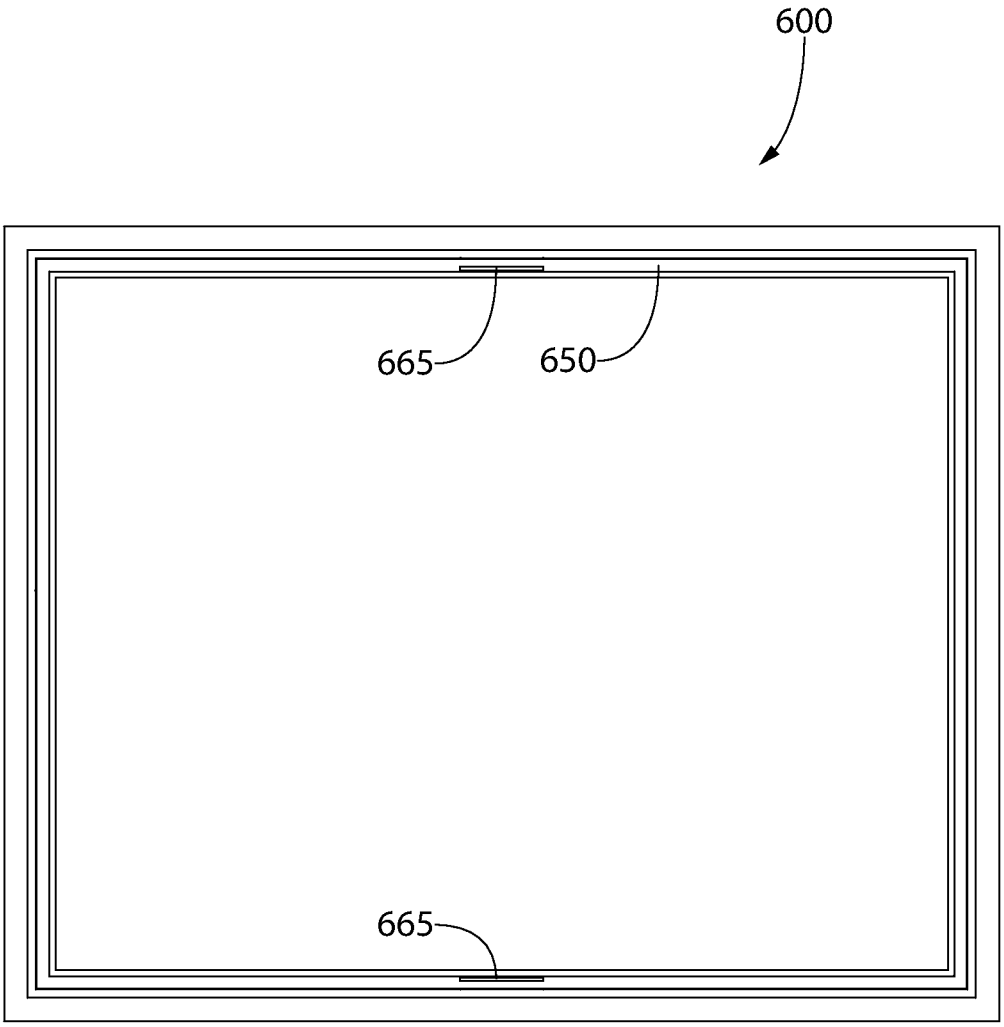
FIG. 33 is a rear view of the frame apparatus of FIG. 32.
Figure 34:
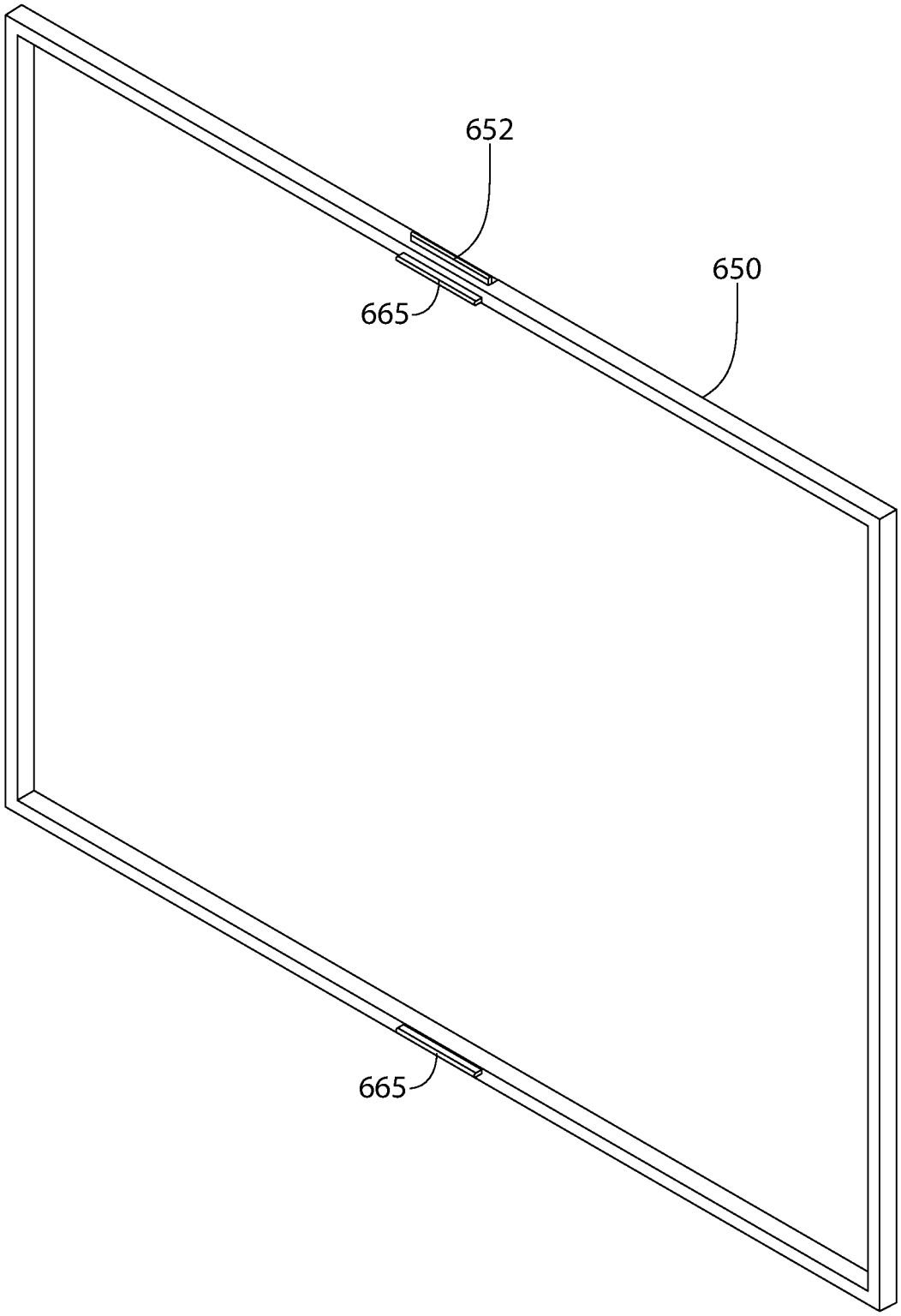
FIG. 34 is a rear perspective view of the annular spacer frame of FIG. 32.
Figure 35:
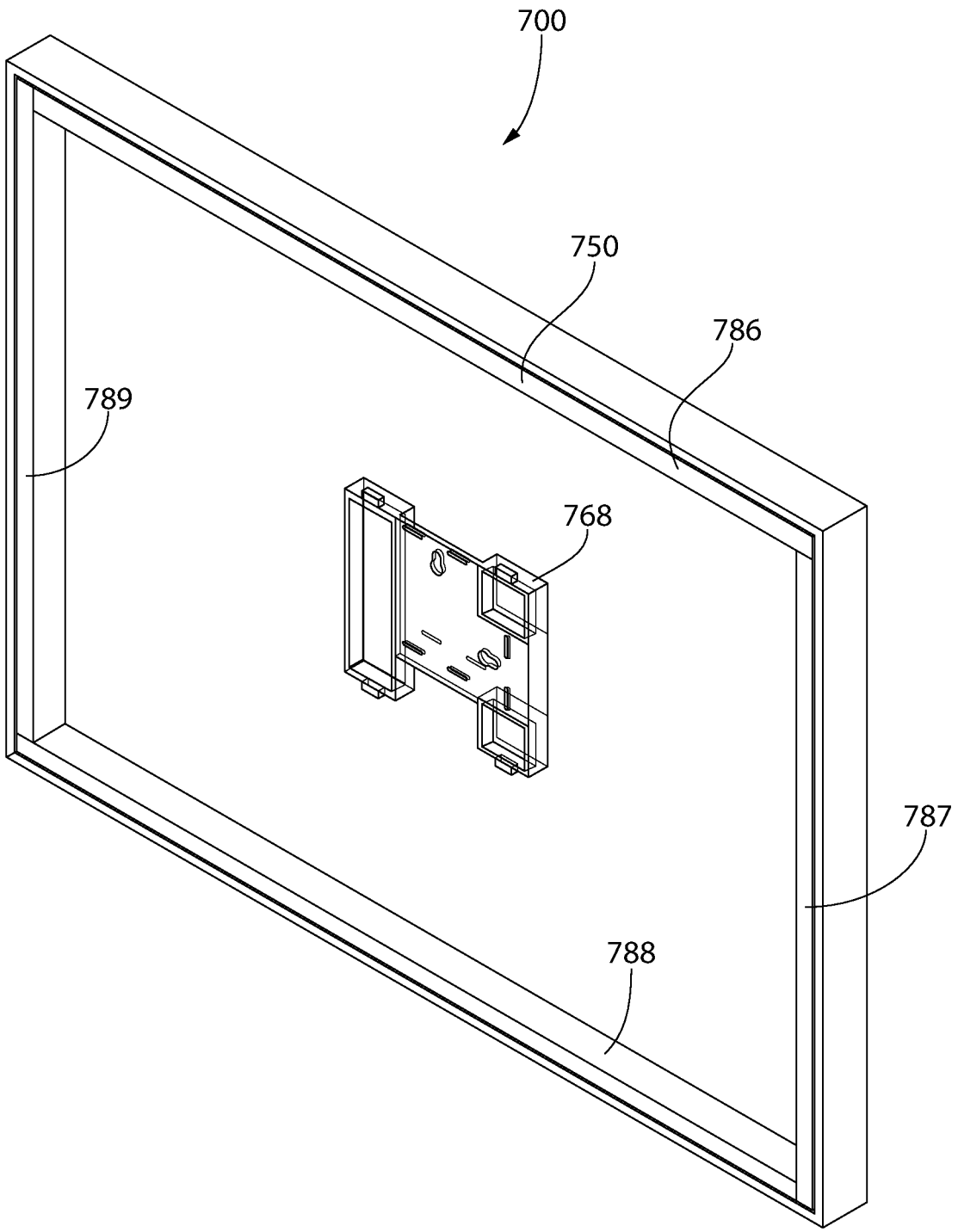
FIG. 35 is a rear perspective view of a frame apparatus according to a seventh embodiment of the present invention.
Figure 36:
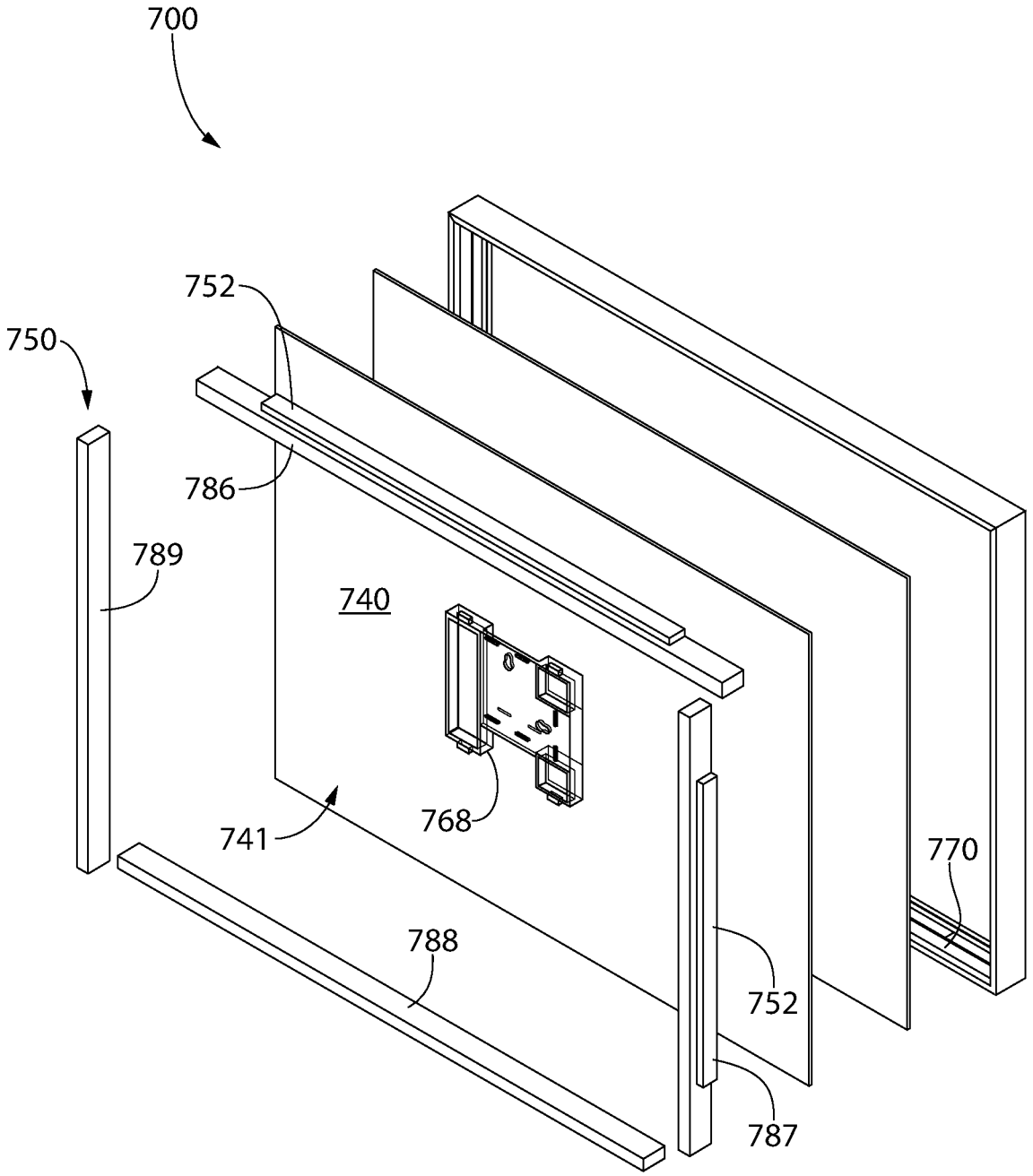
FIG. 36 is an exploded view of the frame apparatus of FIG. 35.
Figure 37:
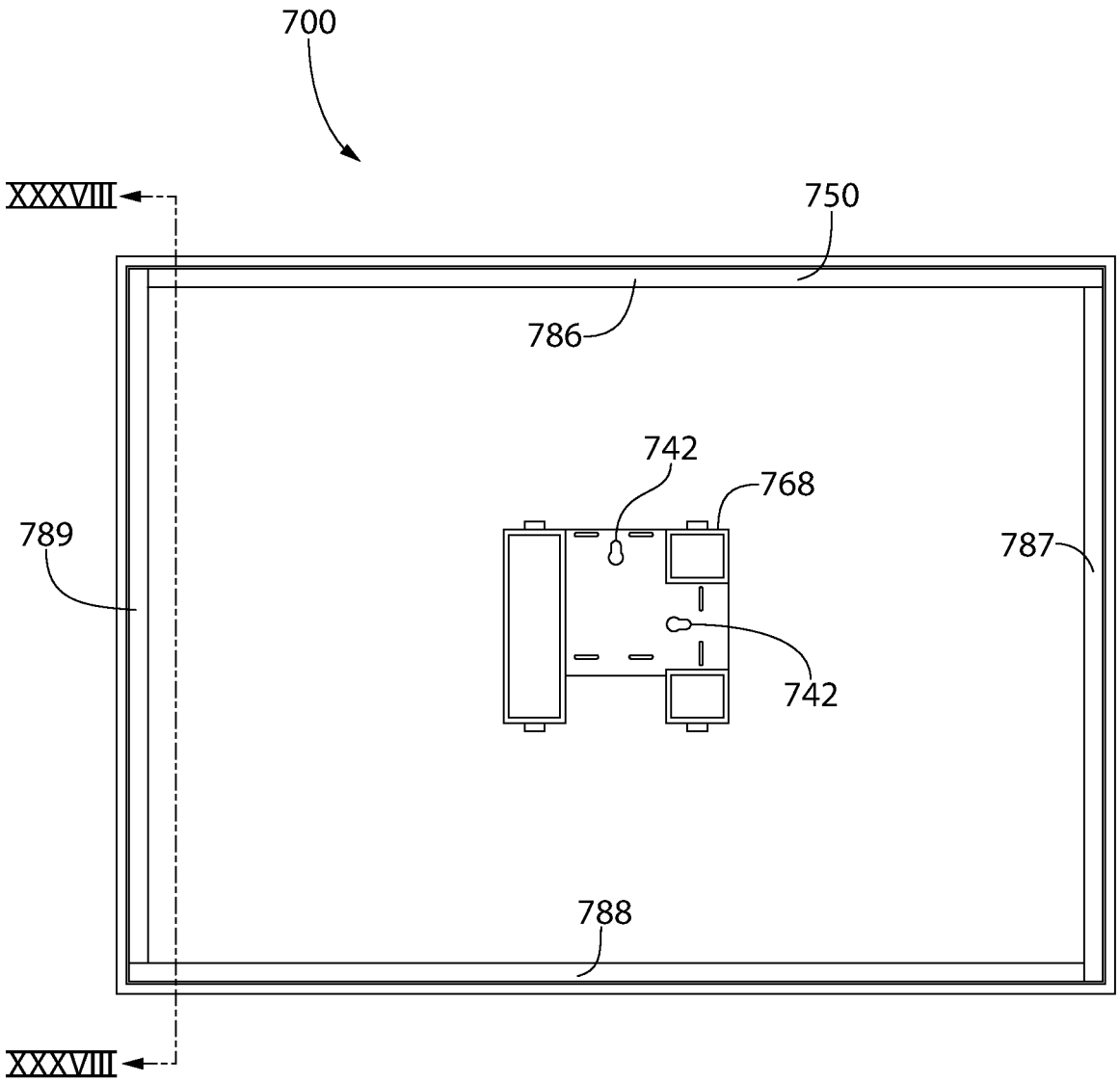
FIG. 37 is a rear view of the frame apparatus of FIG. 35.
Figure 38:
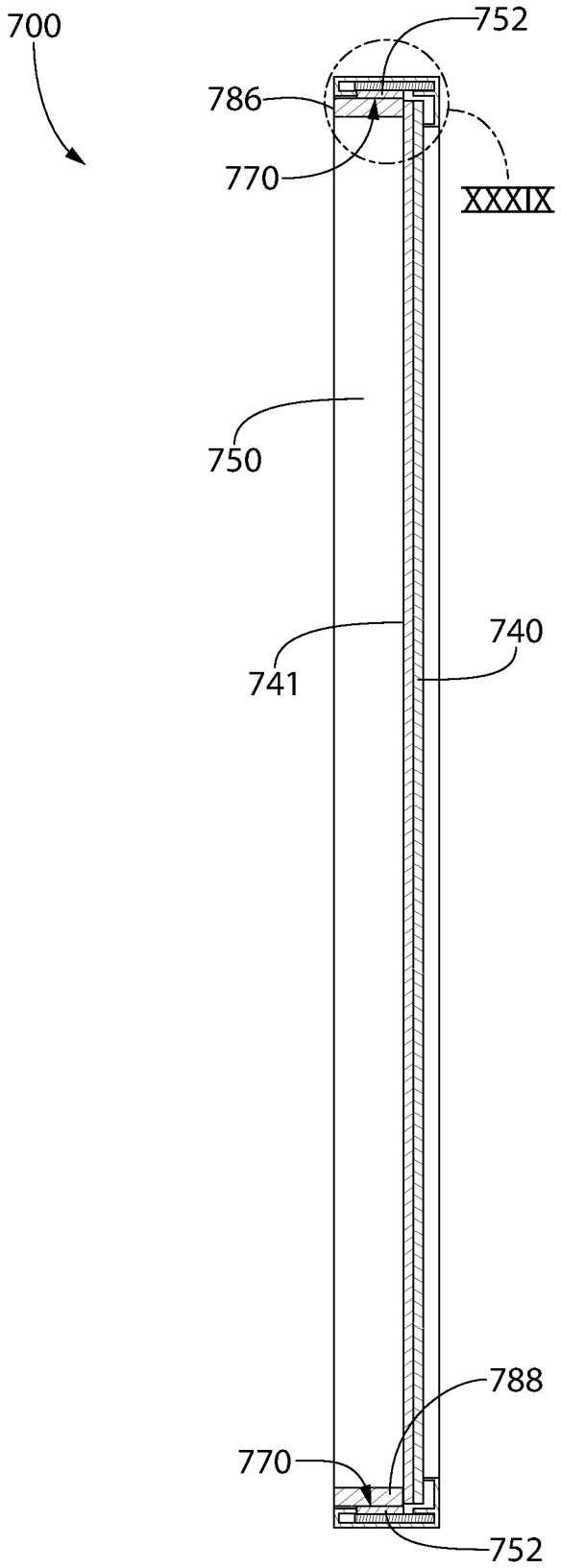
FIG. 38 is a cross-sectional view taken along line XXXVIII-XXXVIII of FIG. 37.
Figure 39:
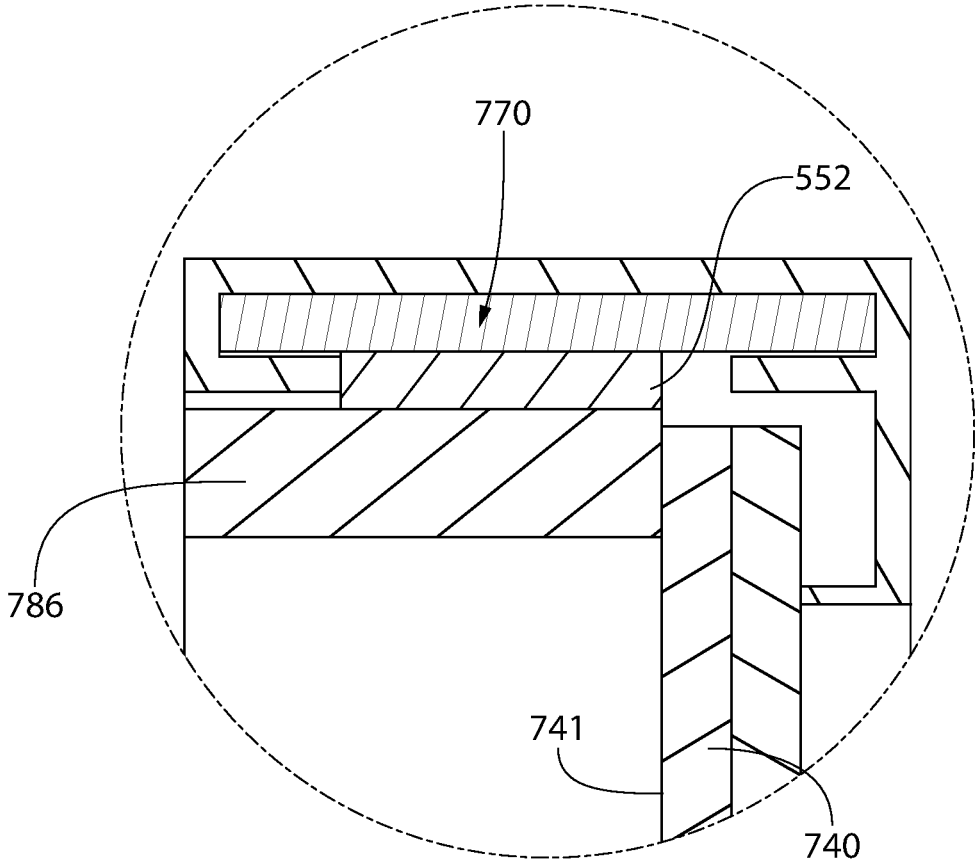
FIG. 39 is an enlarged view of area XXXIX of FIG. 38.
Figure 40:
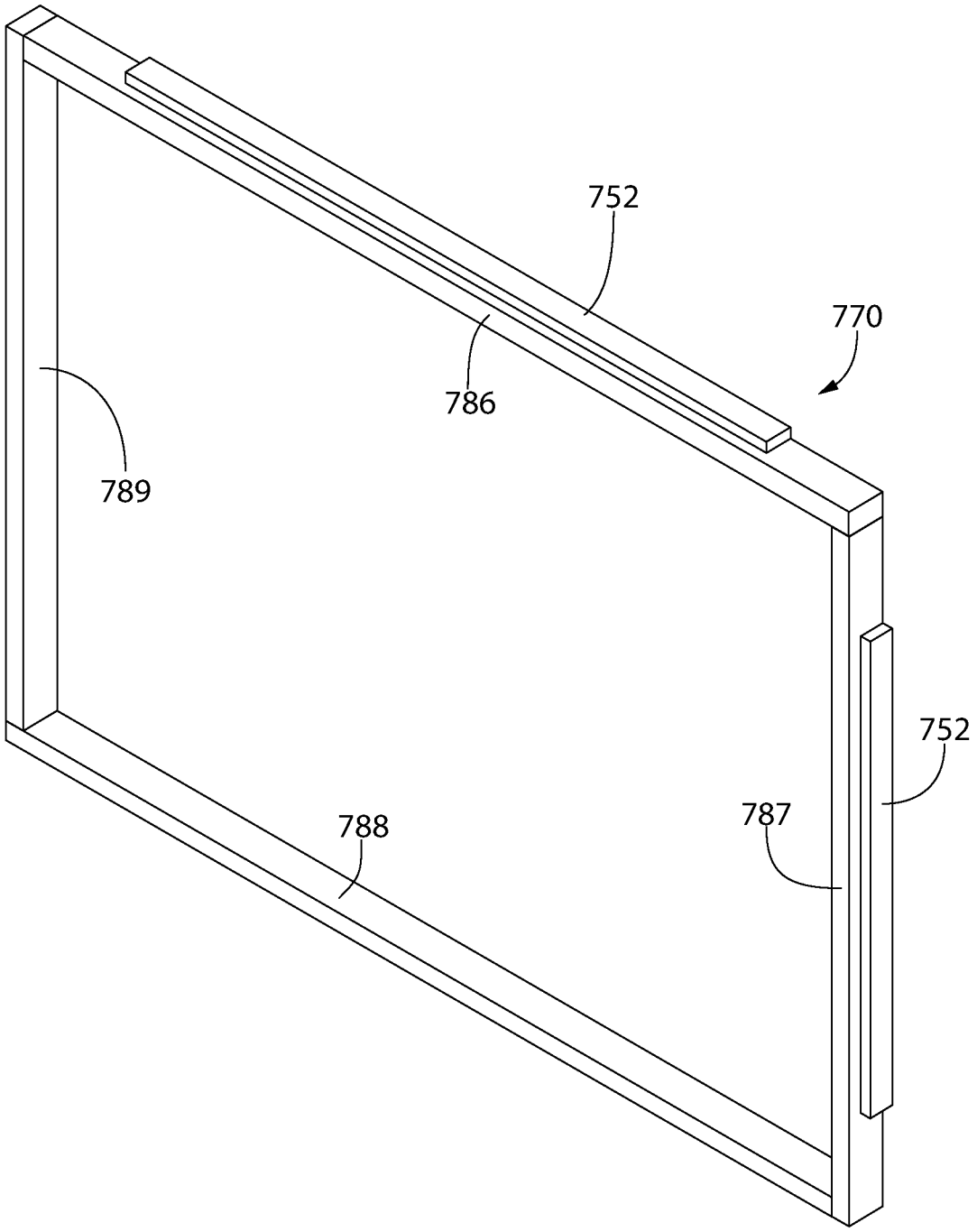
FIG. 40 is a rear perspective view of the annular spacer frame of FIG. 35.

Turning now to FIGS. 32-34, the frame apparatus 600 has an annular spacer frame 650 which has only two locking tabs 652 and two gripping elements 665.

FIGS. 35-39 show a seventh embodiment of the frame apparatus 700. The annular spacer frame 750 is composed of a first, second, third, and fourth spacer bar 786-789. The spacer bars 786-789 may be constructed of wood, MDF, or another rigid material, and may also have a second material applied thereto which has a lower elasticity such that is readily capable of compression. The second material serves as the locking tabs 752, applying pressure to the stack to retain the display article. The spacer bars 786-789 each have a locking tab 752 which holds the spacer bars 786-789 in place, engaging the engagement portions 770. The locking tabs 752 may be constructed of foam, and may be applied to the spacer bars 786-789 with adhesive, mechanical fasteners such as nails or staples, or other methods known in the art.

The rear panel 740 of the present embodiment differs from the rear panel of other embodiments because it incorporates a hanger element 768 attached to a rear face 741 of the rear panel 140. This hanger element 768 permits hanging of the frame apparatus 700, and is located near the center of the rear panel 740 so that it is covered by the article to be displayed when in use, preventing it from being seen in the event that the rear panel 740 is a transparent or translucent material. The hanger element 768 may be attached by ultrasonic welding, adhesive, integral molding, or the like. The hanger element 768 further incorporates mounting features 742 so that the frame apparatus 700 may be hung in a portrait orientation or a landscape orientation. In alternate embodiments, two or more mounting features 742 may be incorporated. Additional hanger elements may also be provided on the annular spacer frame 750.

Figure 41:
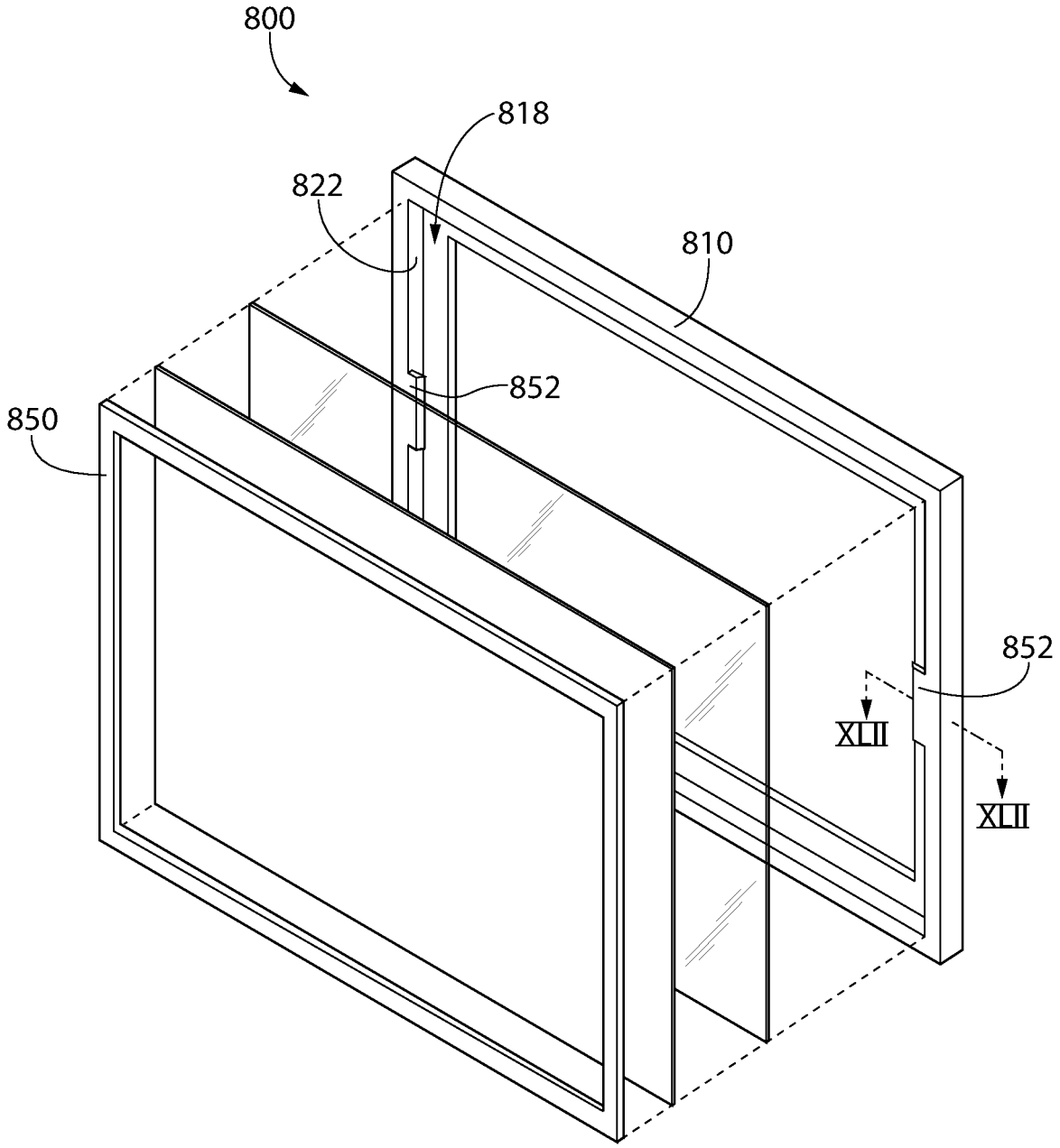
FIG. 41 is an exploded view of a frame apparatus according to an eighth embodiment of the present invention.
Figure 42:
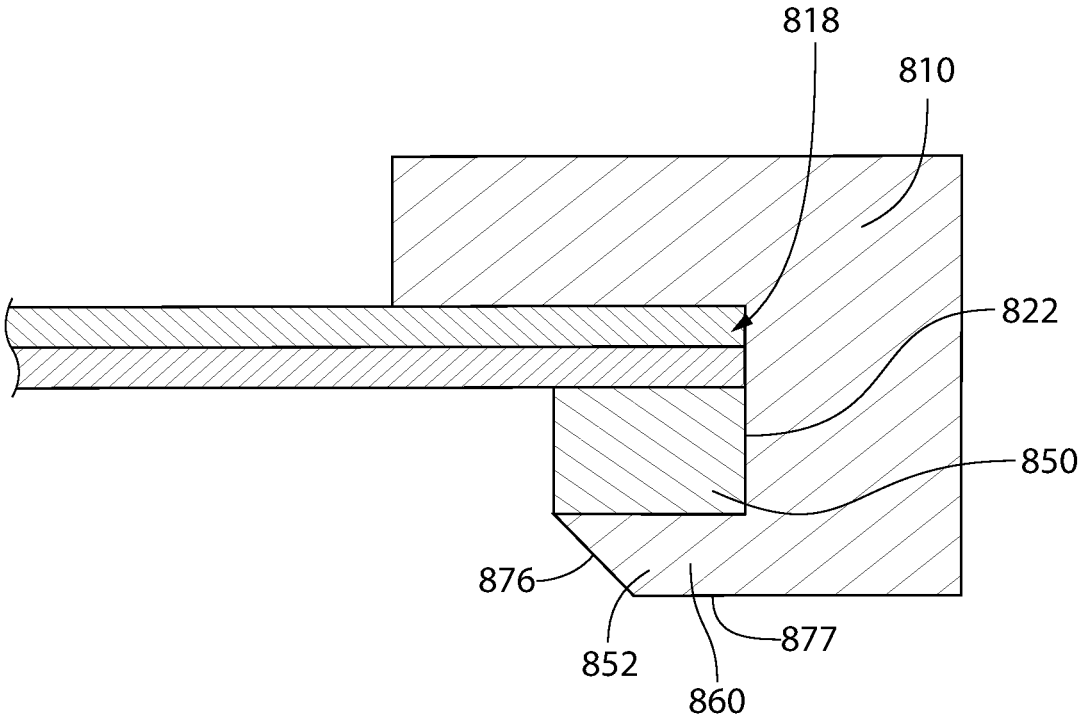
FIG. 42 is a cross-sectional view taken along line XLII-XLII of the frame apparatus of FIG. 41.

The embodiment of the frame apparatus 800 shown in FIGS. 41 and 42 is an alternate configuration for engaging the annular spacer frame 850 with the annular display frame 810. In this embodiment, the locking tabs 852 are provided on the annular display frame 810, and there is no engagement portion provided in the annular display frame 810. Effectively, the arrangement of the locking tabs 852 is reversed from the other embodiments. The annular spacer frame 850 may be constructed with any cross section which enables it to engage with the locking tabs 852. This may include a profile which is a continuous rectangular profile as shown in FIG. 42.

The locking tabs 852 protrude outward from the wall 822 of the rabbet 818. The locking tabs 852 are formed as a first locking section 860 having an insertion aid 876 formed on the top surface 877. The insertion aid 876 is designed to reduce the force required to insert the annular spacer frame 850. The annular spacer frame 850 is then captured underneath the locking tab 852 and compressed against the stack. The locking tabs 852 are designed to apply the required compression by design, and may extend outward from the wall 822 at any angle that is non-parallel with the wall 822. In some embodiments, the locking tabs 852 may be formed as a triangular protrusion, and may have additional features to increase the flexibility of the locking tabs 852 without compromising the rigidity of the annular display frame 810. In this embodiment, the annular spacer frame 850 still has a rigidity which is lower than the annular display frame 810, but in other embodiments it is contemplated that the annular spacer frame 850 may have a similar or greater rigidity, and may rely on the deflection of the locking tabs 852 alone to assemble the frame apparatus 800.

Figure 43:
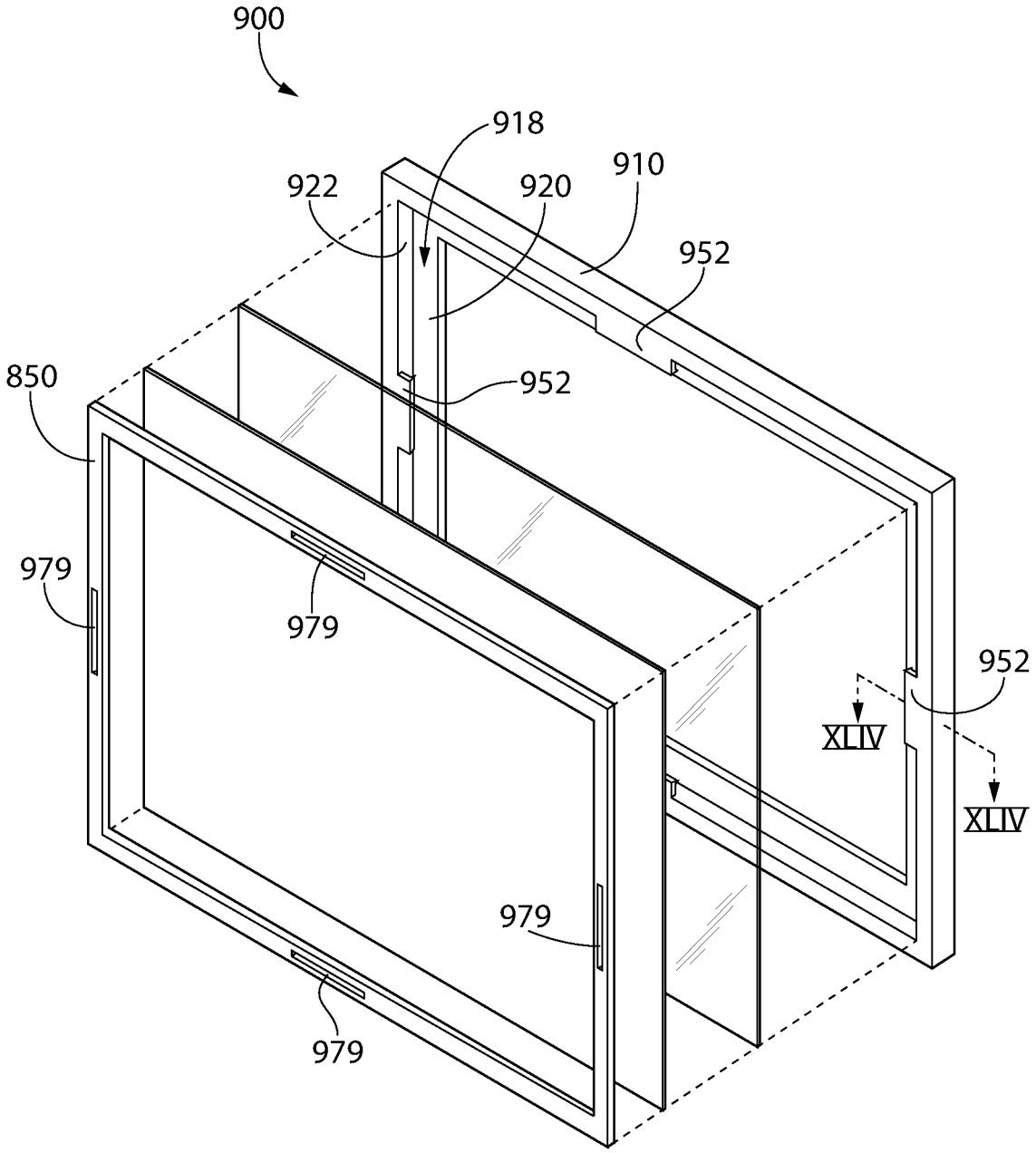
FIG. 43 is an exploded view of a frame apparatus according to a ninth embodiment of the present invention.
Figure 44:
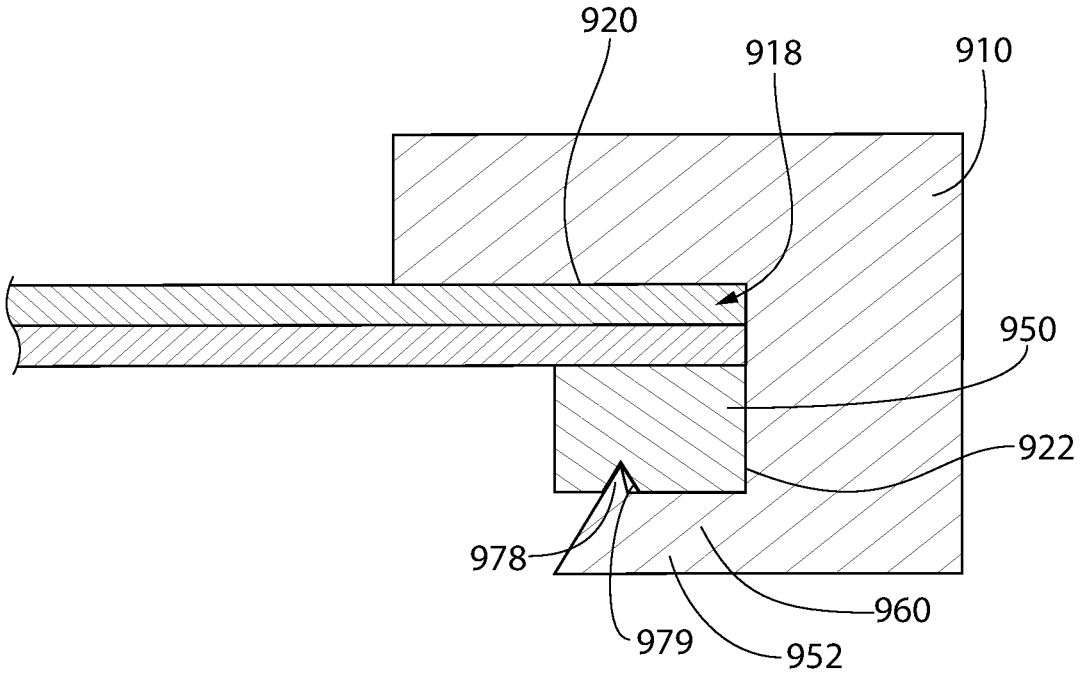
FIG. 44 is a cross-sectional view taken along line XLIV-XLIV of the frame apparatus of FIG. 43.

In a ninth embodiment of the invention shown in FIGS. 43 and 44, the frame apparatus 900 has locking tabs 952 which protrude from the annular display frame 910. As with the frame apparatus 800, the annular spacer frame 950 does not have locking tabs or other engagement feature, and is substantially constructed as a continuous profile. The locking tabs 952 have a first locking section 960 extending in a non-parallel direction from the wall 922 of the rabbet 918. The locking tabs 952 further have a retention feature 978 which extends downward toward the floor 920 of the rabbet 918. These retention features 978 engage v-shaped receiving features 979 formed on the annular spacer frame 950. The retention features 978 and the receiving features 979 interlock to further enhance the retention of the annular spacer frame 950 and maintain the desired compression on the stack, preventing movement of the display article.

Referring to FIGS. 45-53, a frame apparatus 1000 will be described in accordance with another embodiment of the present invention. The frame apparatus 1000 has a lot of overlap in its structure and components with the frame apparatuses previously described in this application. Thus, for features of the frame apparatus 1000 that are not explicitly described herein, reliance on the description above may be appropriate as will be readily appreciated by persons skilled in the art. The description of some such features is intentionally omitted herein in the interest of brevity due to the ready understanding of such features from the prior description.

Figure 45:
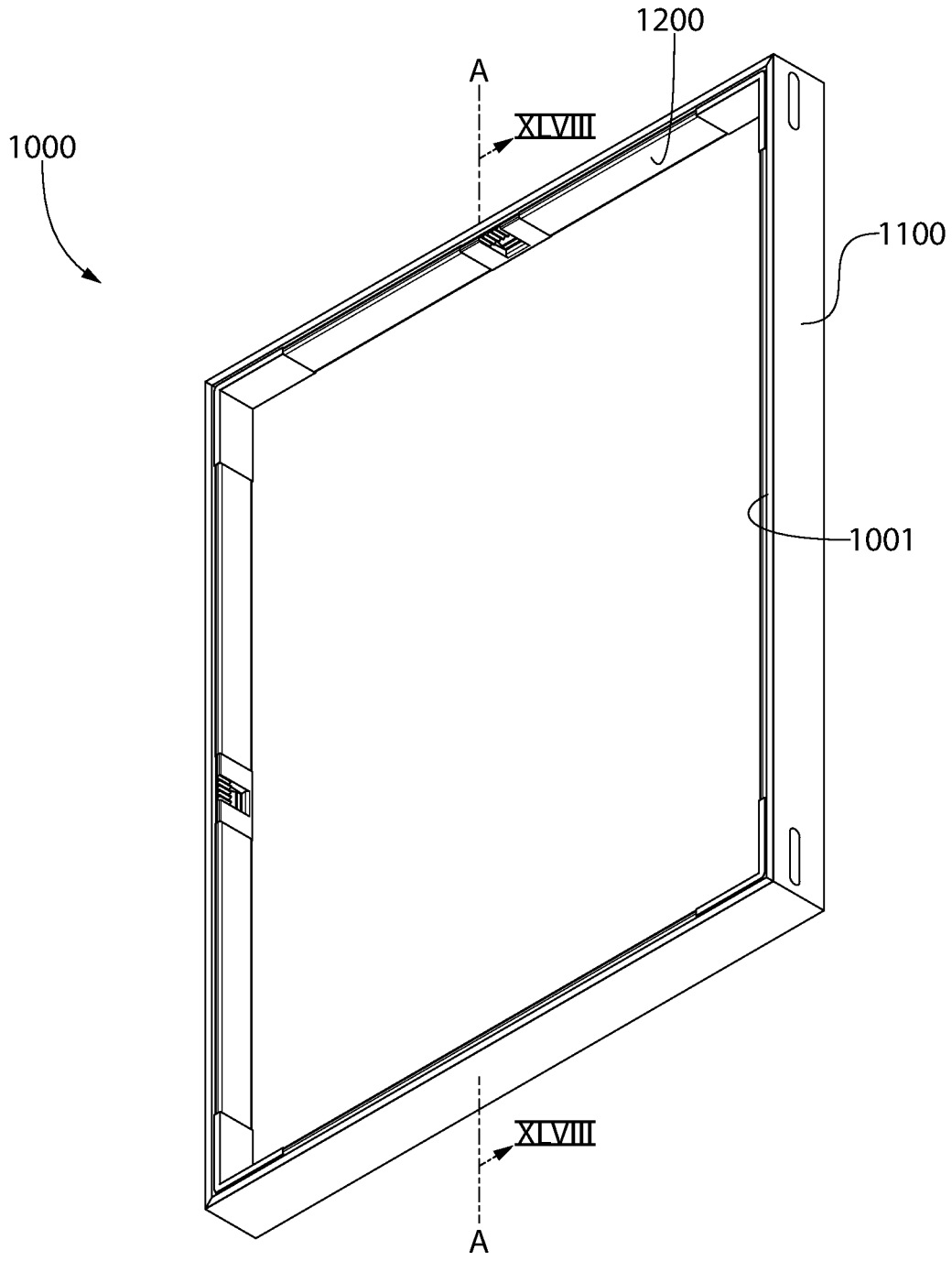
FIG. 45 is a rear perspective view of a frame apparatus in accordance with an embodiment of the present invention.

The frame apparatus 1000 generally comprises an annular display frame (or display frame) 1100 and an annular spacer frame (or spacer frame or spacer apparatus) 1200, much like the embodiments previously described. Moreover, the frame apparatus 1000 also comprises a stack which comprises a front panel 1300 and a rear panel 1400, shown in FIGS. 48-50. The front panel 1300 is preferably transparent to form a window through which a displayed item can be seen. The front panel 1300 forms a glazing and may be formed from glass, plastic, or the like. The rear panel 1400 may also be transparent, but need not be in all embodiments and may also be opaque or translucent. The rear panel 1400 may be formed from glass, plastic, cardboard, or the like in various different embodiments. The front panel 1300 and the rear panel 1400 are omitted from FIG. 46 to avoid covering features of the annular display frame 1100 from being viewed in that figure. An item to be displayed in the frame apparatus 1000 (such as a photograph or the like) is not shown in the figures, but would be sandwiched between the front panel 1300 and the rear panel 1400 in the assembled frame apparatus 1000 when ready for display. The display frame 1100 comprises a longitudinal axis A-A, which also forms a longitudinal axis of the frame apparatus 1000 as shown in FIG. 45.

The display frame 1100 forms the outer part of the frame apparatus 1000 which is visible to a user when the frame apparatus 1000 is either hung from a wall or placed on a surface such as a table or the like for display. The spacer apparatus 1200 is detachably coupled to the display frame 1100, but is not visible from the front viewing side of the display frame apparatus 1000. The spacer apparatus 1200 may be visible when viewed from a rear 1001 of the frame apparatus 1000, but the spacer apparatus 1200 does not serve an aesthetic function. Instead, the purpose of the spacer apparatus 1200 is to securely hold the stack (including the front panel 1300, the rear panel 1400 and the framed item) within the display frame 1100.

Referring to FIGS. 46A, 46B, and 48-50, the display frame 1100 of the frame apparatus 1000 will be described in detail. The display frame 1100 comprises a front surface 1101 from which the frame apparatus 1000 is intended to be viewed and a rear surface 1102 opposite the front surface 1101. The display frame 1100 comprises an outer wall 1110 that forms the periphery of the display frame 1100. In particular, the outer wall 1110 comprises an outer surface 1111 that defines a periphery of the display frame 1100 and an inner surface 1112 opposite the outer surface 1111. The inner surface 1112 defines or surrounds a cavity of the display frame 1100 within which various items such as the front panel 1300, the rear panel 1400 and a display item (not shown) are intended to be positioned.

Figure 50:
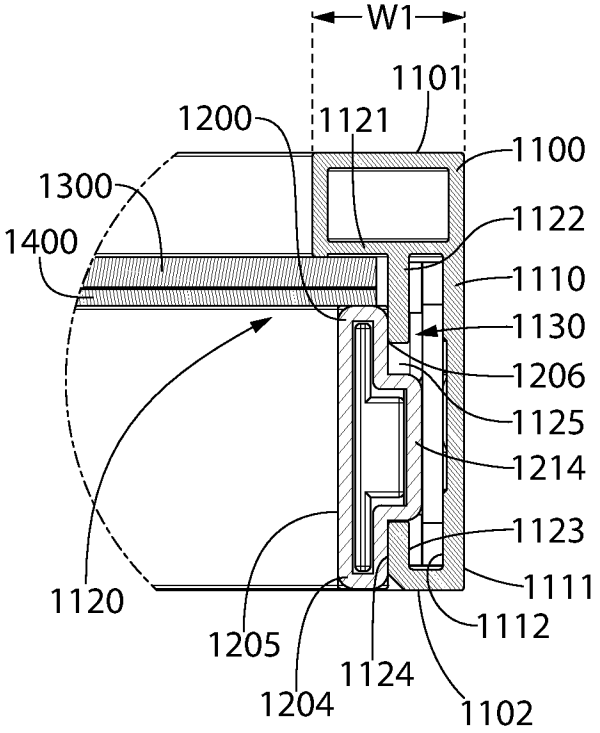
FIG. 50 is a close-up view of area L of FIG. 48.
Figure 49:
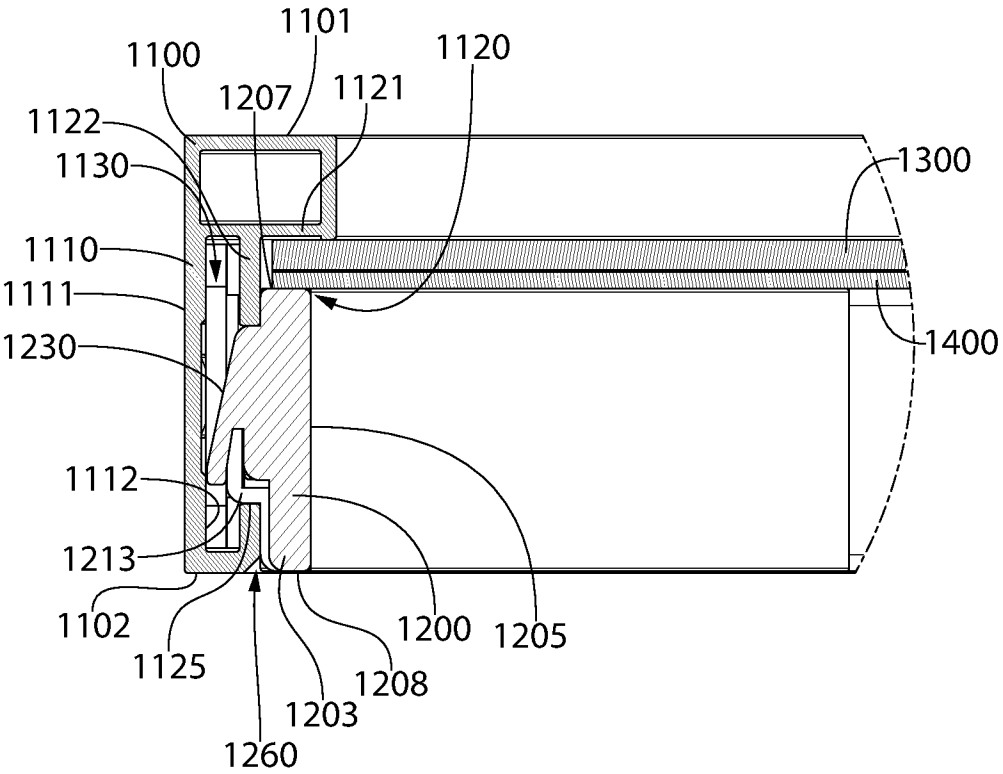
FIG. 49 is a close-up view of area XLIX of FIG. 48.

The display frame 1100 also comprises a rabbet 1120 within which the front and rear panels 1300, 1400 and the display item are positioned. The spacer apparatus 1200 is configured to hold and retain the front and rear panels 1300, 1400 and the display item within the rabbet 1120, as best seen in FIGS. 49 and 50, when the spacer apparatus 1200 is positioned in the rabbet 1120 and coupled to the display frame 1100. The rabbet 1120 comprises a floor 1121 and a wall 1122. The wall 1122 of the rabbet 1120 is spaced apart from the outer wall 1110 of the display frame 1100 to define a channel 1130 between the wall 1122 of the rabber 1120 and the outer wall 1110. That is, the wall 1122 of the rabbet 1120 is located radially inward of the outer wall 1110 so that a space or gap exists between the wall 1122 of the rabbet 1120 and the outer wall 1110 of the display frame 1100. The space or gap forms the channel 1130. The wall 1122 has an outer surface 1123 that faces the outer wall 1110 and an inner surface 1124 opposite the outer surface 1123 which faces the interior of the display frame 1100. The channel 1130 is defined between the outer surface 112 of the wall 1122 of the rabbet 1120 and the outer wall 1110 of the display frame 1100.

The wall 1122 of the rabbet 1120 comprises an opening 1125 that extends through the full thickness of the wall 1122 from the outer surface 1123 of the wall 1122 to the inner surface 1124 of the wall 1122. Thus, the opening 1125 forms a passageway through the wall 1122 into the channel 1130. In the exemplified embodiment, the opening 1125 extends continuously along an entirety of the wall 1122 of the rabbet 1120. However, the invention is not to be so limited in all embodiments and the wall opening 1125 may be discontinuous and segmented in other embodiments, so long as it is configured to interact/engage features of the spacer apparatus 1200 as described below. The opening 1125 is located somewhat centrally along a height of the wall 1122 so that there is a portion of the wall 1122 above the opening 1125 and a portion of the wall 1122 below the opening 1125. The combination of the opening 1125 in the wall 1122 and the channel 1130 forms an engagement feature of the display frame 1100 which is configured to interact or engage with an engagement feature of the spacer apparatus 1200 to facilitate the coupling of the spacer apparatus 1200 to the display frame 1100.

Although the opening 1125 and the channel 1130 form the engagement feature of the display frame 1100 in the exemplified embodiment, the invention is not to be so limited in all embodiments. In other embodiments the engagement feature may be a groove or recess that is formed partially, but not entirely, through the wall 1122 of the rabbet 1120. In still other embodiments, the engagement feature may be a protrusion, protuberance, rib, or the like that extends from the inner surface 1124 of the wall 1122 of the rabbet 1120 to engage an engagement feature of the spacer apparatus 1200. Thus, variations in the structure which forms the engagement feature of the display frame 1100 is possible and may fall within the scope of the invention claimed herein.

Figure 46A:
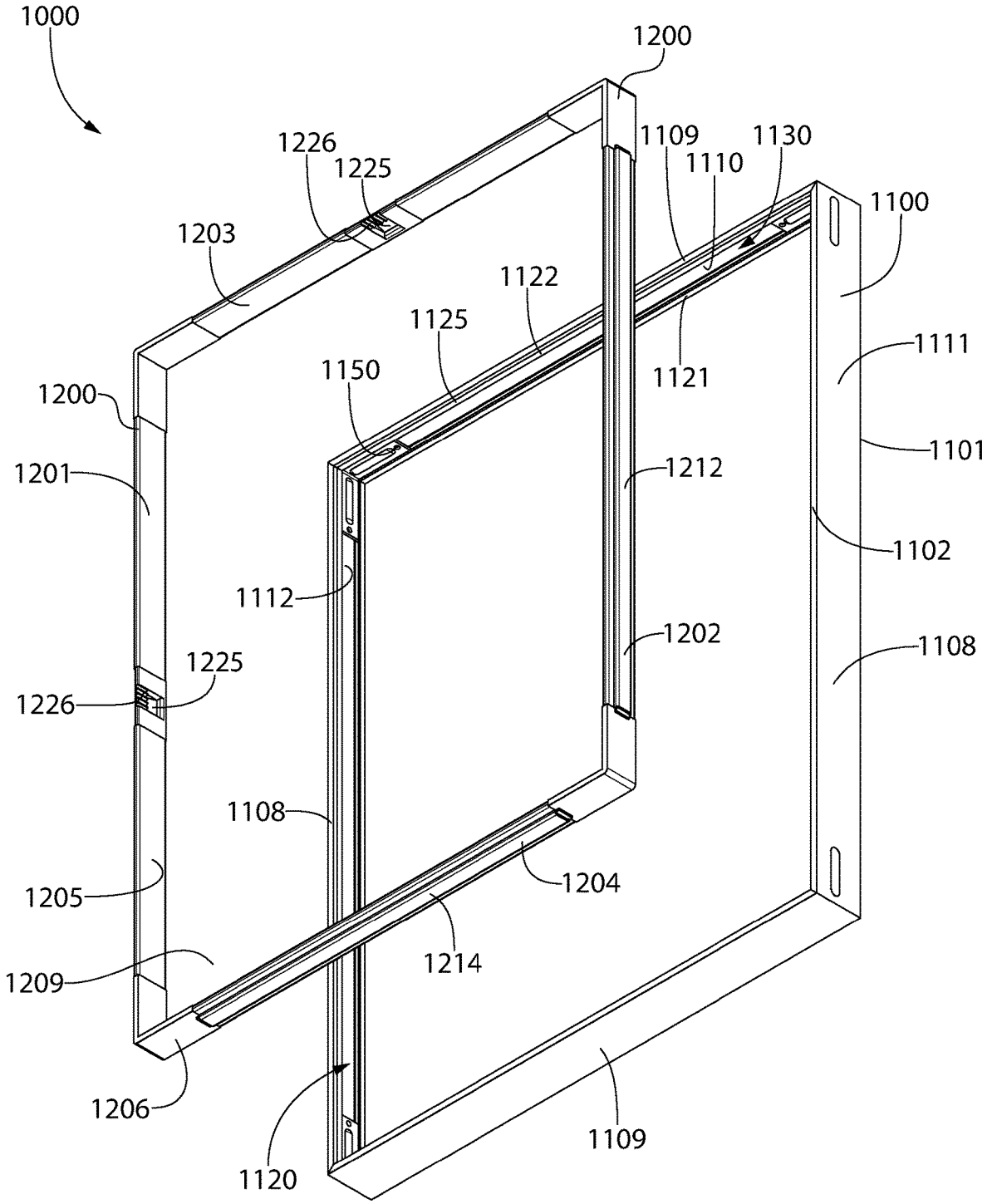
FIGS. 46A and 46B are exploded views of the frame apparatus of FIG. 45, illustrating an annular display frame and an annular spacer frame thereof.
Figure 46B:
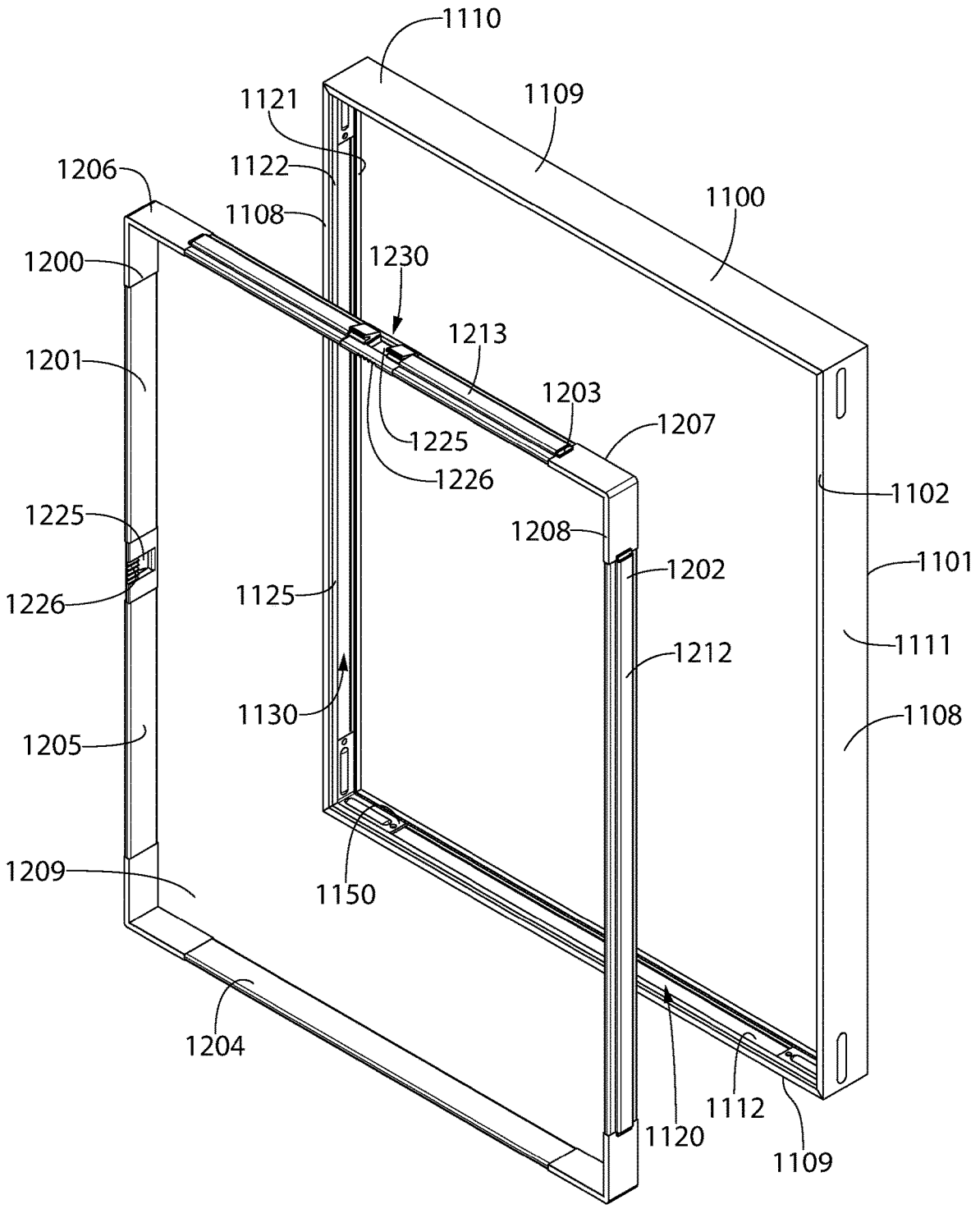

In the exemplified embodiment, the opening 1125 in the wall 1122 of the rabbet 1120 extends along an entirety of the inner surface 1124 of the wall 1122 of the rabbet 1120. Moreover, as seen in FIGS. 46A and 46B, there are brackets 1150 located within the opening 1125 along the corners of the display frame 1100. The brackets 1150 may function to provide strength and rigidity to the display frame 1100. In particular, in some embodiments the display frame 1100 may be extruded as four separate linear segments that are attached together. The four separate linear segments may include two long segments 1108 and two short segments 1109 such that when the four linear segments are attached together they form a rectangle. In such an embodiment, the brackets 1150 may facilitate or assist with the coupling of the adjacent linear segments together. The brackets 1150 may be formed from stampled steel and sized to fit within the opening 1125 and/or the channel 1130 as seen in FIGS. 46A and 46B. Of course, the display frame 1100 may not be extruded, but may instead be formed from plastic, aluminum, wood, MDF, etc. as discussed in detail above. The brackets 1150 may be omitted in some embodiments, and other articles of hardware or adhesives may be used for coupling the various linear segments 1108, 1109 together. Moreover, the display frame 1100 may take on other shapes, including being oval, circular, polygonal in various shapes, irregularly shaped, or the like.

Referring to FIGS. 46A-47B, the spacer apparatus 1200 will be described. The spacer apparatus 1200 is rectangular in the exemplified embodiment, but could take on other shapes in other embodiments. However, the shape of the spacer apparatus 1200 may correlate to the shape of the display frame 1100 in some embodiments. In other embodiments, the spacer apparatus 1200 may be able to have a different shape from the display frame 1100, so long as the spacer apparatus 1200 is configured to be coupled to the display frame 1100 in such a manner so that the spacer apparatus 1200 secures the stack within the rabbet 1120 of the display frame 1100.

In the exemplified embodiment, the spacer apparatus 1200 comprises a plurality of sides including a first side 1201, a second side 1202 opposite the first side 1201, a third side 1203 extending between the first and second sides 1201, 1202, and a fourth side 1204 extending between the first and second sides 1201, 1202. The third and fourth sides 1203 are located opposite one another. Thus, moving clockwise, the sides are arranged first side 1201, third side 1203, second side 1202, fourth side 1204. Each of the sides 1201-1204 is elongated and relatively thin, which provides the spacer apparatus 1200 with some flexibility such that the sides 1201-1204 are capable of being flexed or bent inwardly or outwardly (see, for example, FIG. 53) to facilitate the detachment of the spacer apparatus 1200 from the display frame 1100.

The spacer apparatus 1200 is in the shape of a polygon, and particularly a rectangle in the exemplified embodiment. As noted, other shapes are possible. Moreover, the spacer apparatus 1200 comprises an inner surface 1205 that surrounds an opening 1209. Thus, the spacer apparatus 1200 is not filled in and there is no structure located inward of the inner surfaces 1205 of the various sides 1201-1204 of the spacer apparatus 1200. Thus, the spacer apparatus 1200 has a frame-like shape and structure similar to that of the display frame 1100. Because the spacer apparatus 1200 is in the shape of a frame that surrounds an open area (i.e., the opening 1209) and because the sides 1201-1204 are relatively thin, this enhances the flexibility of the spacer apparatus 1200 such that the sides 1201-1204 can be bent inwardly and outwardly as noted above. The spacer apparatus 1200 also comprises an outer surface 1206 that is opposite the inner surface 1205. The outer surface 1206 of the spacer apparatus 1200 faces the wall 1122 of the rabbet 1120 of the display frame 1100 when the spacer apparatus 1200 is coupled to the display frame 1100, as described in more detail below with reference to FIGS. 48-50.

The spacer apparatus 1200 comprises several different engagement features which are configured to engage the engagement feature (i.e., the opening 1125 and/or the channel 1130) of the display frame 1100 to achieve the coupling of the spacer apparatus 1200 to the display frame 1100. Specifically, the spacer apparatus 1200 comprises a first elongated protuberance 1211 extending along the first side 1201, a second elongated protuberance 1212 extending along the second side 1202, a third elongated protuberance 1213 extending along the third side 1203, and a fourth elongated protuberance 1214 extending along the fourth side 1204. The first, second, third, and fourth elongated protrusions 1211-1214 extend from the outer surface 1206 of the spacer apparatus 1200 along each of the sides 1201-1204 thereof.

In the exemplified embodiment, the second and fourth elongated protuberances 1212, 1214 are continuous protrusions that extend along a majority of the length of the second and fourth sides 1202, 1204, respectively. In particular, the second and fourth elongated protuberances 1212, 1214 extend continuously along the second and fourth sides 1202, 1204 of the spacer apparatus 1200 except along the opposing ends thereof. The second and fourth elongated protuberances 1212, 1214 may extend continuously for greater than 70% of a length of the side on which it is located in some embodiments. However, the second and fourth elongated protuberances 1212, 1214 could extend along a smaller portion of the length of the second and fourth sides 1202, 1204 in other embodiments. Each of the protrusions 1211-1214 has a rectangular shape with a width and a length.

The first and third elongated protuberances 1211, 1213 are slightly different. Specifically, the first elongated protuberance 1211 comprises a first protruding portion 1215 and a second protruding portion 1216 that are spaced apart along the length of the first side 1201 of the spacer apparatus 1200. The third elongated protuberance 1213 similarly comprises a first protruding portion 1217 and a second protruding portion 1218 that are spaced apart along the length of the third side 1203 of the spacer apparatus 1200.

Moreover, the first and third sides 1201, 1203 also include flexible tab structures that extend obliqudly from the outer surface 1206. In particular, the spacer apparatus 1200 comprises a first pair of flexible tabs 1220 protruding from the outer surface 1206 along the first side 1201 and a second pair of flexible tabs 1230 protruding from the outer surface 1206 along the third side 1203. Although in the exemplified embodiment the flexible tabs 1220, 1230 are arranged in pairs, in other embodiments there may just be a single flexible tab protruding from each of the first and third sides 1201, 1203 of the spacer apparatus 1200. The first pair of flexible tabs 1220 is positioned between the first and second protruding portions 1215, 1216 of the first elongated protuberance 1211. The second pair of flexible tabs 1230 is positioned between the first and second protruding portions 1217, 1218 of the third elongated protuberance 1213.

As best seen in FIG. 49, the flexible tabs 1220, 1230 extend obliquely from the outer surface 1206 of the spacer apparatus 1200. More particularly, the spacer apparatus 1200 comprises a lower edge 1207 which engages the stack when the spacer apparatus 1200 is coupled to the display frame 1100 and an upper edge 1208 which is generally flush with the rear surface 1102 of the display frame 1100. The flexible tabs 1220, 1230 extend obliquely from the outer surface 1206 of the spacer apparatus 1200 in a direction towards the upper edge 1207 of the spacer apparatus 1200. The flexible tabs 1220, 1230 are only coupled to the spacer apparatus 1200 along a portion thereof, with another portion of the flexible tabs 1220, 1230 being spaced from the outer surface 1206 of the spacer apparatus 1200. As a result, the flexible tabs 1220, 1230 can flex inwardly towards the outer surface 1206 of the spacer apparatus 1200 when a force is applied thereto. The flexible tabs 1220, 1230 assist with locking the spacer apparatus 1200 to the display frame 1100 and preventing accidental dislodgment between the spacer apparatus 1200 and the display frame 1100.

Referring again to FIGS. 46A and 46B, the spacer apparatus 1200 comprises an aperture 1225 located between the two flexible tabs of each of the first and second pairs of flexible tabs 1220, 1230. Thus, the aperture 1225 extends through the thickness of the spacer apparatus 1200 between the inner and outer surfaces 1205, 1206 thereof. The apertures 1225 are located only along the first and third sides 1201, 1203 of the spacer apparatus 1200 because those are the sides which include the flexible tabs 1220, 1230. Furthermore, the spacer apparatus 1200 comprises a hanging feature 1226 on the inner surface 1205 in alignment with the apertures 1225. That is, the hanging features 12226 and the apertures 1225 are both located along each of the first and third sides 1201, 1203 of the spacer apparatus 1200 and are aligned with one another. In the exemplified embodiment, the hanging feature 1226 is formed by a plurality of ribs or ridges along the inner surface 1205 of the spacer apparatus 1200 that are configured to engage with a stem of an article of hardware such as a nail or a screw (like a sawtooth hanger). In particular, when the frame apparatus 1000 is hung from a wall or other support structure, the head of the nail or screw nests within the aperture 1225 and the stem or neck of the nail or screw which protrudes from the wall or other support structure nests within the grooves between the ridges of the hanging feature 1226. The hanging feature 1226 is located on the first and second sides 1201, 1203 of the spacer apparatus 1200, which are adjacent to one another, thereby enabling the frame apparatus 1000 to be hung from the wall or other support surface in a portrait or landscape orientation.

While the first and third sides 1201, 1203 comprise both elongated protuberances 1211, 1213 and the flexible tabs 1220, 1230, in other embodiments the first and second sides 1201, 1203 may have just the flexible tabs 1220, 1230 without the elongated protuberances 1211, 1213. In still other embodiments, the first and second sides 1201, 1203 may have elongated protuberances 1211, 1213 but omit the flexible tabs 1220, 1230 like the second and fourth sides 1202, 1204. However, it is preferable that the flexible tabs 1220, 1230 are included along the first and third sides 1201, 1203 to provide a sort of safety system to make sure that the display frame 1100 will not slide off of the spacer apparatus 1200 when the frame apparatus 1000 is hung on the wall or other support surface.

Figure 47A:
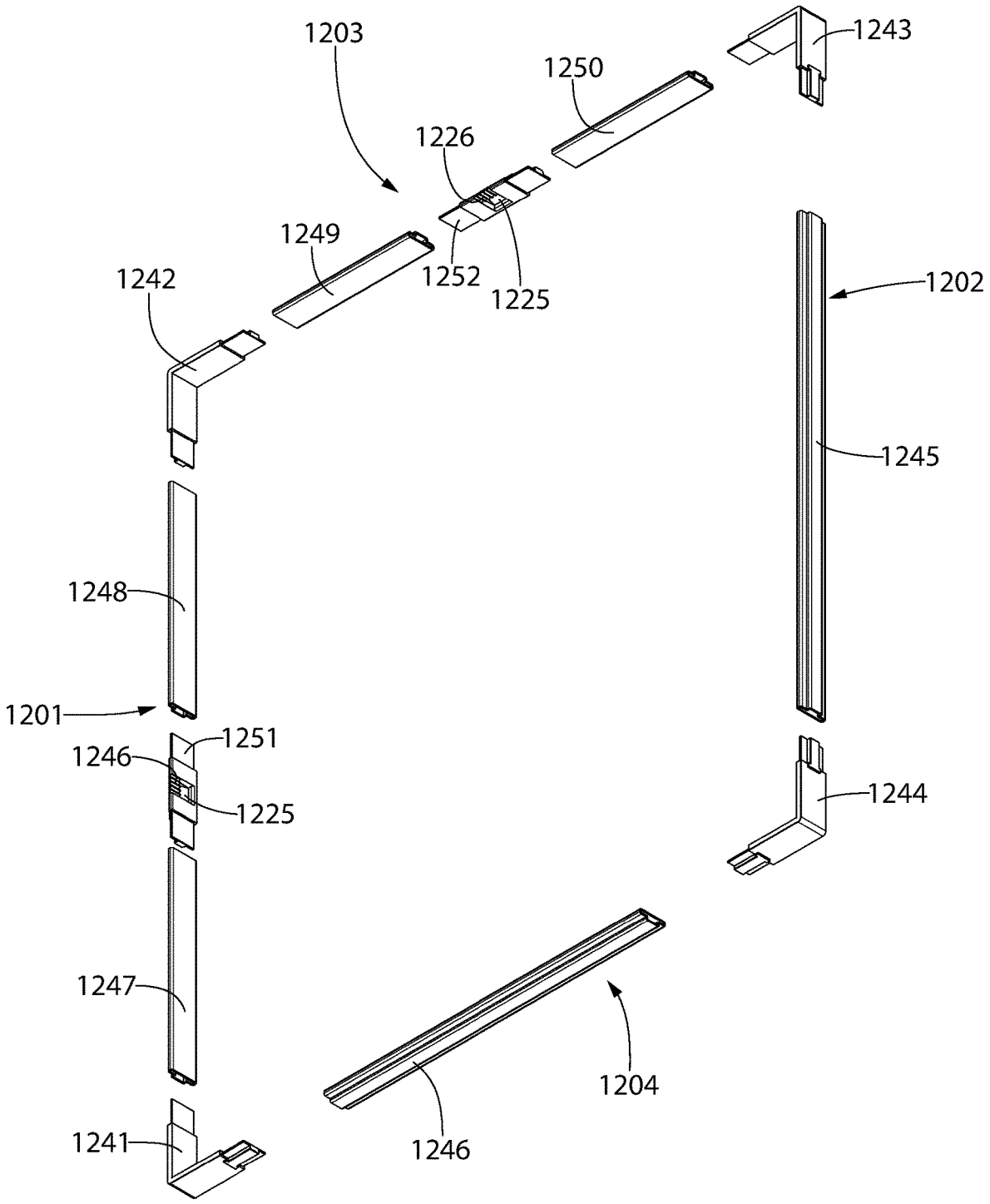
FIG. 47A is an exploded view of the annular spacer frame of the frame apparatus of FIG. 45.
Figure 47B:
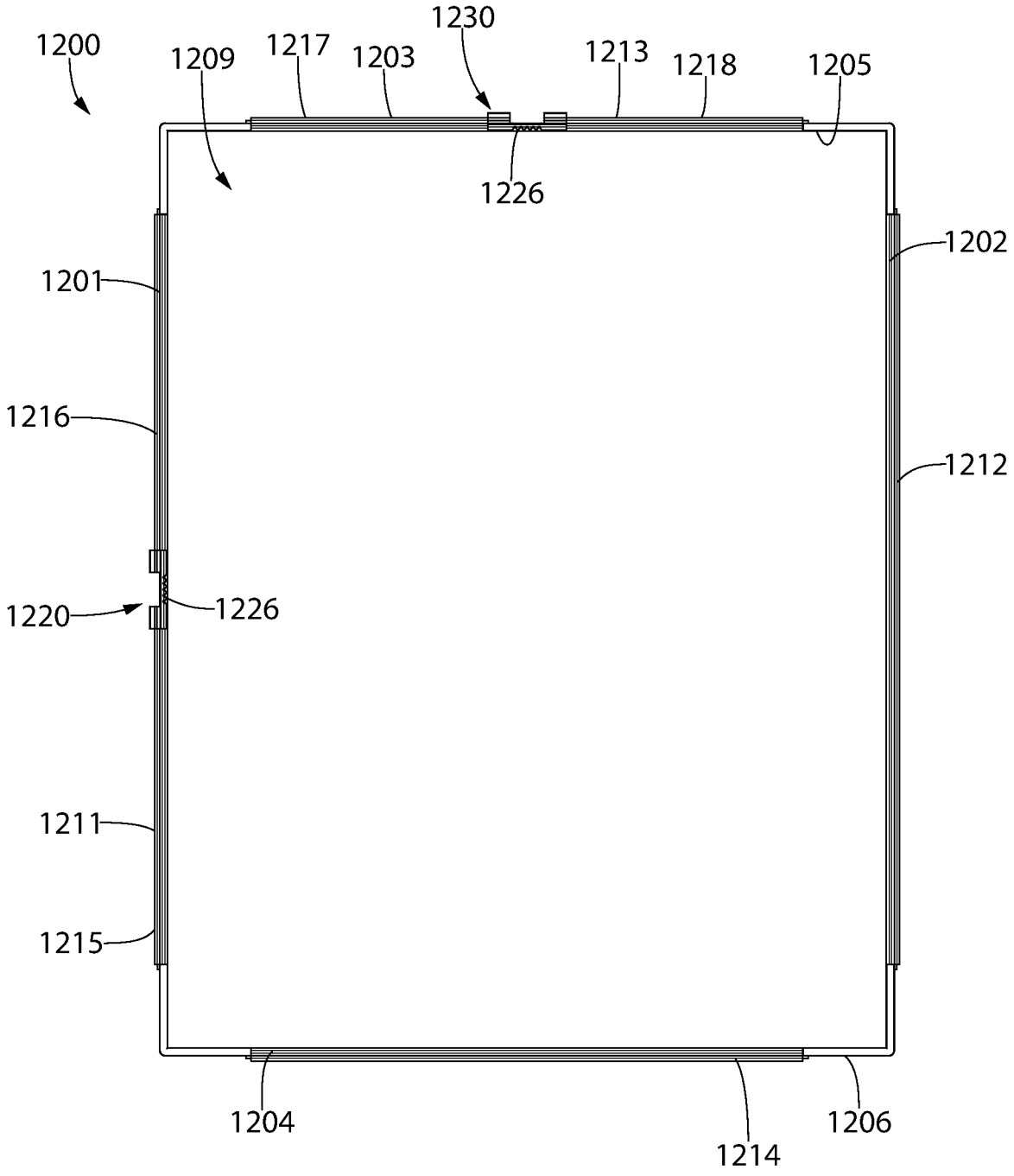
FIG. 47B is a front view of the annular spacer frame of the frame apparatus of FIG. 45.

Referring to FIG. 47A, the spacer apparatus 1200 is formed from several distinct components that are coupled together in the exemplified embodiment. In particular, the components of the spacer apparatus 1200 are assembled together at the factory prior to sale to a consumer. The consumer is not intended to disassemble the spacer apparatus 1200, but rather the multiple components are used to prevent bowing and warping of the spacer apparatus 1200 which is used with the display frame 1100 having a very thin profile. Specifically, the display frame 1100 may have a maximum width W1 (see FIG. 50) measured of 9 mm. Creating a spacer apparatus 1200 to work with the display frame 1100 of that width may require the multiple component arrangement in some embodiments to prevent bowing and warping as mentioned.

In that regard, the spacer apparatus 1200 comprises a plurality of corner pieces (there are four in this embodiment because the spacer apparatus 1200 is rectangular in shape) 1241-1244, a first long elongated piece 1245, a second long elongated piece 1246, a first short elongated piece 1247, a second short elongated piece 1248, a third short elongated piece 1249, a fourth short elongated piece 1250, a first hanger piece 1251, and a second hanger piece 1252. The components/pieces noted above are coupled together to form the assembled spacer apparatus 1200. Once assembled, the spacer apparatus 1200 may not be permitted to be disassembled. Thus, the components may lock together either mechanically or via adhesives, screws, nails, or the like in some embodiments. In other embodiments, the various pieces may not be locked together and thus disassembly may be possible, although it is not necessary or perhaps even desirable to disassemble The first long elongated piece 1245 extends between the third and fourth corner pieces 1243, 1244 to form the second side 1202 of the spacer apparatus 1200. In particular, the first long elongated piece 1245 is hollow and therefore defines an interior cavity along at least a portion of its length. More specifically, the first long elongated piece 1245 is hollow at least along each of its opposing ends, although it may be hollow along its entire length. The third and fourth corner pieces 1243, 1244 comprise portions that nest within the hollow interior of the first elongated piece 1245 to couple the first and second corner pieces 1243, 1244 to the first long elongated piece 1245 and form the second side 1202 of the spacer apparatus 1200. While the first long elongated piece 1245 is described as being hollow, in other embodiments the corner pieces may be hollow and the first long elongated piece 1245 may nest within the hollow interior of the corner pieces instead.

The second long elongated piece 1246 extends between the first and fourth corner pieces 1241, 1244 to form the fourth side 1204 of the spacer apparatus 1200. In particular, the second long elongated piece 1246 is hollow and therefore defines an interior cavity along at least a portion of its length. More specifically, the second long elongated piece 1246 is hollow at least along each of its opposing ends, although it may be hollow along its entire length. The first and fourth corner pieces 1241, 1244 comprise portions that nest within the hollow interior of the second elongated piece 1246 to couple the first and fourth corner pieces 1241, 1244 to the second long elongated piece 1246 and form the fourth side 1204 of the spacer apparatus 1200. While the second long elongated piece 1246 is described as being hollow, in other embodiments the corner pieces may be hollow and the second long elongated piece 1246 may nest within the hollow interior of the corner pieces instead.

The first and third sides 1201, 1203 are formed by sets of components. Specifically, the first side 1201 is formed by a first set of components comprising the first short elongated piece 1247, the second short elongated piece 1248, and the first hanger piece 1251. The third side 1203 is formed by a second set of components comprising the third short elongated piece 1249, the fourth short elongated piece 1259, and the second hanger piece 1252. In particular, along the first side 1201 the first short elongated piece 1247 is connected to the first corner piece 1241, the second short elongated piece 1248 is connected to the second corner piece 1242, and the first hanger piece 1251 is connected to and extends between each of the first and second short elongated pieces 1247, 1248. Moreover, along the third side 1203, the third short elongated piece 1249 is connected to the second corner piece 1242, the fourth short elongated piece 1259 is connected to the third corner piece 1243, and the second hanger piece 1252 is connected to and extends between each of the third and fourth short elongated pieces 1249, 1250.

Each of the short and long elongated pieces 1245-1250 comprises one of the elongated protuberances. Each of the first and second hanger pieces 1251, 1252 comprises one of the pairs of flexible tabs 1220, 1230, the aperture 1225, and the hanging feature 1226. FIG. 47A illustrates how the various parts are coupled together. In particular, each of the elongated pieces 124-1250 is hollow at least along the end regions of those pieces. Moreover, each of the corner pieces 1241-1244 and each of the hanger pieces 1251, 1252 has connector portions which are configured to be inserted into the hollow interior of the elongated piece 1245-1250 which is adjacent to it. By attaching all of the adjacently positioned pieces together in this manner, the spacer apparatus 1200 is formed. As mentioned previously, the pieces may be permanently coupled together via welding, adhesive, or the like, detachably coupled together using screws, or may simply be held together due to a friction fit between the pieces.

Figure 48:
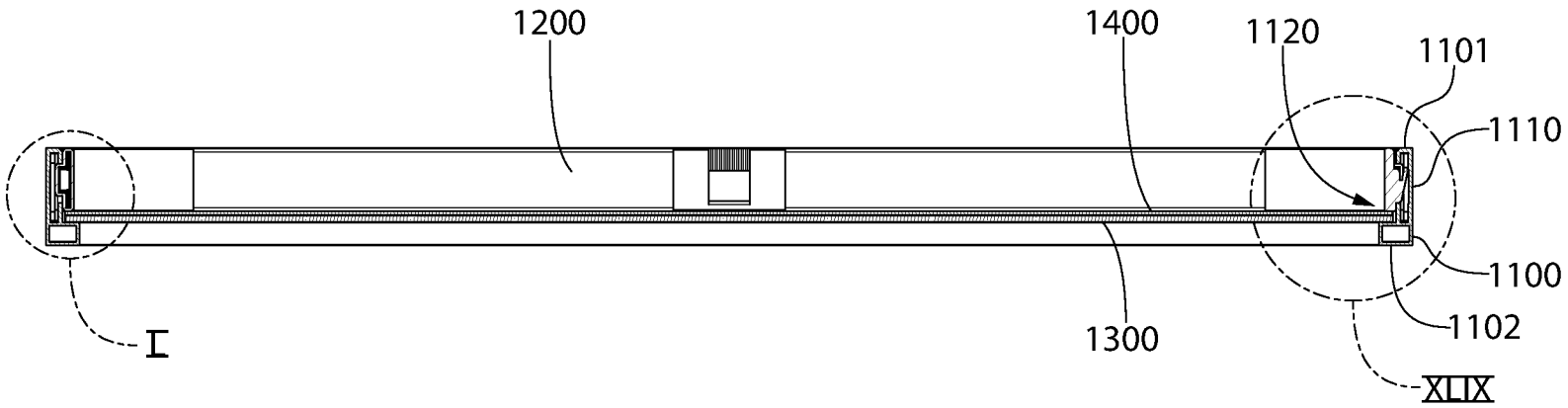
FIG. 48 is a cross-sectional view taken along line XLVIII-XLVIII of FIG. 45.

Referring to FIGS. 48-50, the engagement between the spacer apparatus 1200 and the display frame 1100 which achieves the coupling of those components to one another will be described. FIGS. 48-50 illustrate a cross-section taken through the third and fourth sides 1203, 1204 of the spacer apparatus 1200 (and the sides of the display frame 1100 that are aligned therewith). Thus, the description below will be made with reference to the third and fourth sides 1203, 1204 of the spacer apparatus 1200 and the features thereof, but it should be appreciated that the same exact structures are present on the first and second sides 1201, 1202. That is, the first side 1201 is identical to the third side 1203 and the second side 1202 is identical to the fourth side 1204.

When the spacer apparatus 1200 is located within the rabbet 1120 of the display frame 1100, the outer surface 1206 of the spacer apparatus 1200 faces, and is perhaps in contact with, the inner surface 1124 of the wall 1122 of the rabbet 1120. Furthermore, the fourth elongated protuberance 1214 located along the fourth side 1204 of the spacer apparatus 1200 nests within the opening 1125 in the wall 1122 of the rabbet 1120 and extends into the channel 1130 between the wall 1122 of the rabbet 1120 and the outer wall 1110. As a result, the fourth elongated protuberance 1214 is trapped between the opposing upper and lower portions of the wall 1122 which extend above and below the opening 1125. In some embodiments the fourth elongated protuberance 1214 may extend into the opening 1125 but not into the channel 1130, which still achieving a similar result. However, having the fourth elongated protuberance 1214 (and each of the other elongated protuberances 1211-1213) extend into the channel 1130 creates a more secure attachment between the spacer apparatus 1200 and the display frame 1100.

The same arrangement exists between the first, second, and third elongated protuberances 1211-1213 and the opening 1125 and channel 1130. Because the elongated protuberances 1211-1214 are arranged along all four sides of the spacer apparatus 1200, this creates a secure coupling between the spacer apparatus 1200 and the display frame 1100. Of course, the elongated protuberances 1211-1214 need not be arranged along all four sides of the spacer apparatus 1200 in all embodiments, and may only be positioned along one, two, or three of the sides of the spacer apparatus 1200 in other embodiments. Each of the elongated protuberances 1211-1214 forms an engagement feature of the spacer apparatus 1200.

As shown in FIG. 49, the third elongated protuberance 1211 located along the third side 1203 of the spacer apparatus 1200 nests within the opening 1125 and the channel 1130. Furthermore, the pair of flexible tabs 1230 extend further into the channel 1130 and may in fact abut against the outer wall 1110 of the display frame 1100. In some embodiments, the flexible tabs 1230 may be forced against the inner surface 1112 of the outer wall 1110 such that the flexible tabs 1230 are made to flex or bent when the spacer apparatus 1200 is coupled to the display frame 1100. The flexible tabs 130 extend further into the channel 1130 than the elongated protuberances 1211-1214. Thus, even if the elongated protuberances 1211, 1214 are somehow able to become dislodged from the channel 1130 and the opening 1125, the flexible tabs 1220, 1230 will maintain the coupling between the spacer apparatus 1200 and the display frame 1100.

As seen in FIGS. 49 and 50, the spacer apparatus 1200 is thin and does not extend radially inward beyond an edge of the floor 1121 of the rabbet 1120. Thus, when the frame apparatus 1000 is viewed form the front (i.e., the front surface 1101 of the display frame 1100), the spacer apparatus 1200 is not visible. This can be important in some embodiments particularly where the front and rear panels 1300, 1400 are both transparent. Specifically, in such a scenario if the spacer apparatus 1200 extended beyond the edge of the floor 1121 of the rabbet 1120, the spacer apparatus 1200 would be visible and would detract from the aesthetics of the framed item or article. Thus, the spacer apparatus 1200 is maintained sufficiently thin so that it does not protrude beyond the innermost edge of the floor 1121 of the rabbet 1120.

As seen in FIG. 49, a portion of the outer surface 1206 of the spacer apparatus 1200 adjacent to and extending to the upper edge 1208 of the spacer apparatus 1200 is spaced apart from the inner surface of the wall 1122 of the rabbet 1120 by a gap 1260. However, this does not necessarily occur along an entirety of spacer apparatus 1200. In particular, looking at FIG. 50, there is no similar space or gap between the outer surface 1206 of the spacer apparatus 1200 and the inner surface of the wall 1122 of the rabbet 1120. The space or gap 1260 provides a location at which a user may insert his or her fingers in between the spacer apparatus 1200 and the wall 1122 of the rabbet 1120 of the display frame 1100 to assist with detaching the spacer apparatus 1200 from the display frame 1100.

Figure 53:
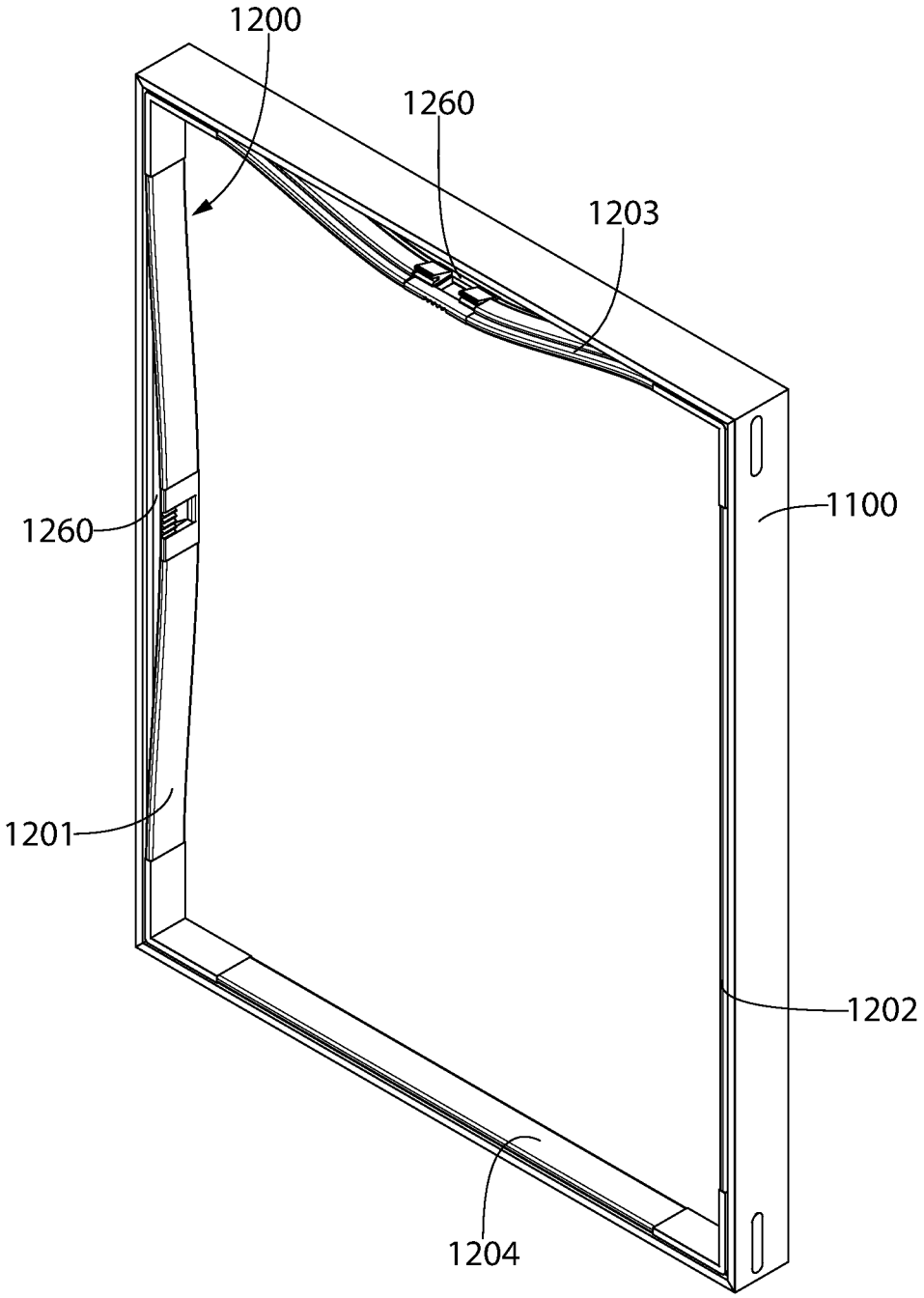
FIG. 53 is a perspective view of the assembled frame apparatus of FIG. 45 illustrating two adjacent sides of the annular spacer frame being bent to facilitate removal of the annular spacer frame from the annular display frame.

Specifically, referring to FIGS. 49 and 53, a user can insert his or her fingers into the gap 1260 between the spacer apparatus 1200 and the wall 1122 of the rabbet 1120 of the display frame 110 and bend the first and third walls 1201, 1203 of the spacer apparatus 1200 inwardly towards a center of the frame apparatus 1000. Once bent in this manner, the user can pivot the spacer apparatus 1200 upwardly away from the display frame 1100. In particular, once the first and third walls 1201, 1203 are bent sufficiently far inwardly, the corner between the first and third walls 1201, 1203 can clear the inside corner of the display frame 1100 so that the spacer apparatus 1200 can be removed from the rabbet 1120 of the display frame 1100. This may be done to change out the item which is being displayed by the frame apparatus 1000.

Figure 51:
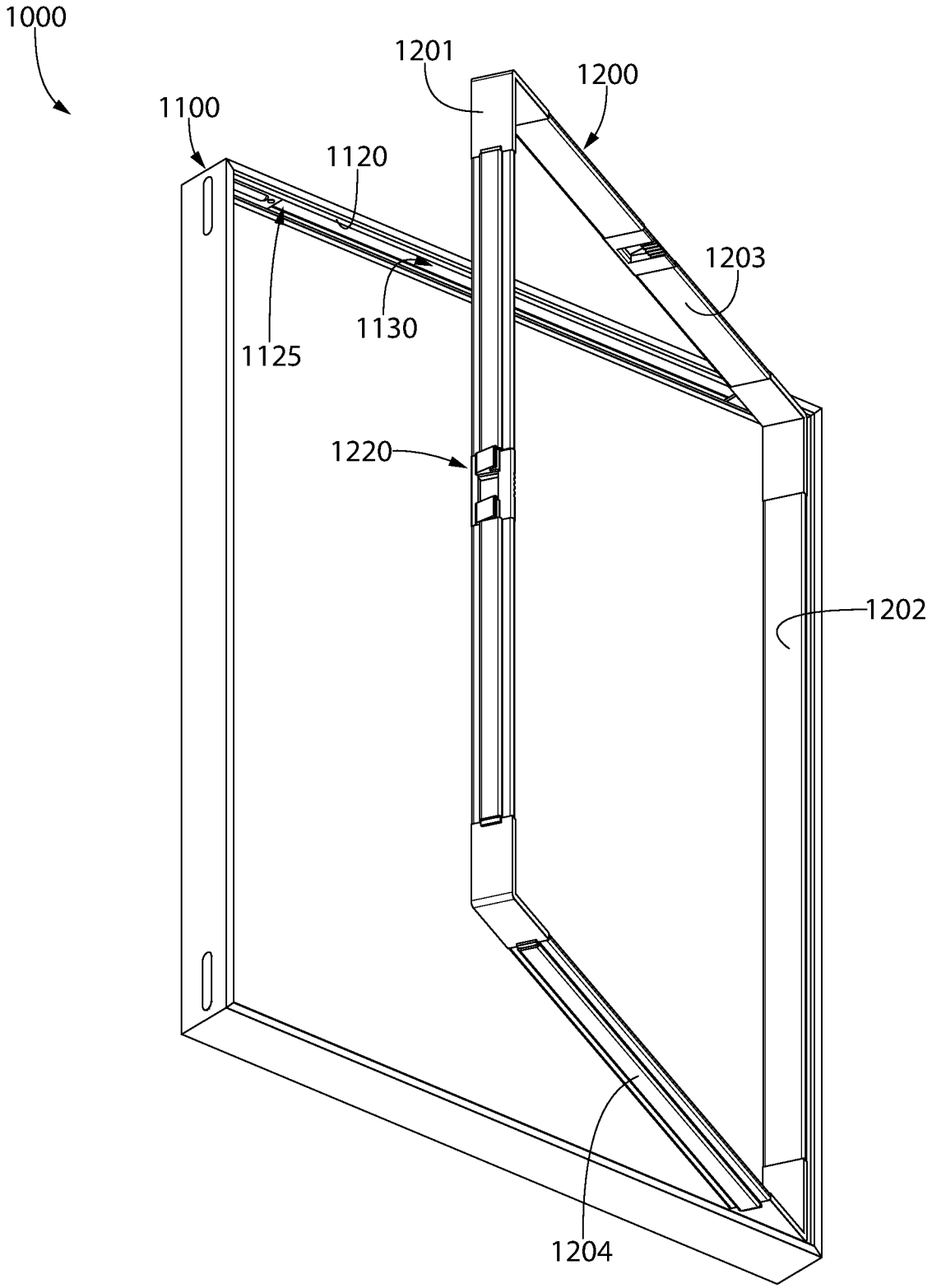
FIGS. 51 and 52 are perspective views illustrating the process of coupling the annular insert frame to the annular display frame.
Figure 52:
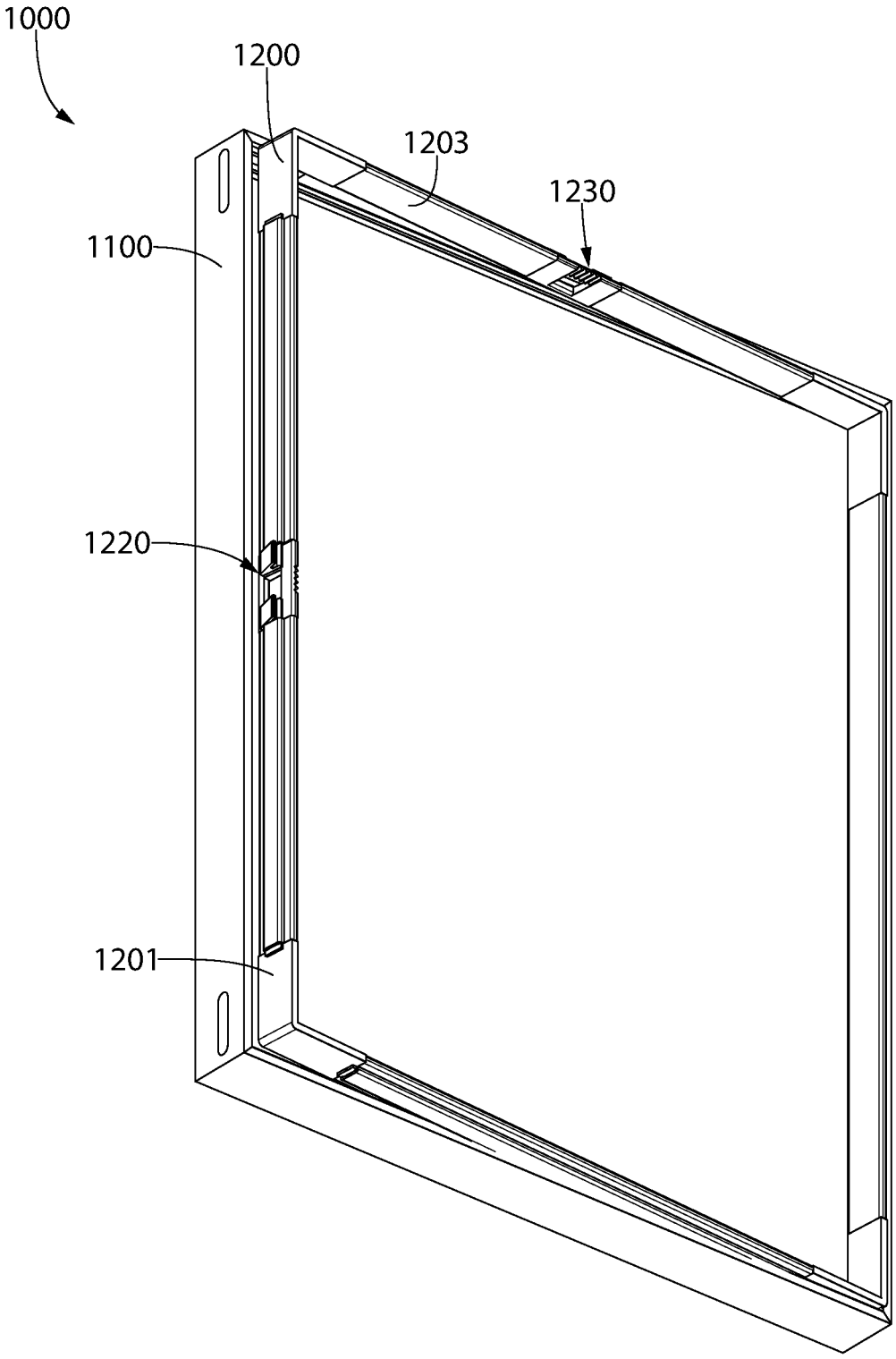

FIGS. 51 and 52 illustrate the manner of coupling the spacer apparatus 1200 to the display frame 1100. In particular, either the second side 1202 or the fourth side 1204 of the spacer apparatus 1200 is inserted into the rabbet 1120 of the display frame 1100 first, with the spacer apparatus 1200 in a tilted orientation. That is, the second and fourth sides 1202, 1204 of the spacer apparatus 1200 do not include the flexible tabs 1220, 1230, so it is one of those sides which is inserted into the rabbet 1120 first. Next, the spacer apparatus 1200 is pivoted downwardly to pivot the first side 1201 of the spacer apparatus 1200 towards the display frame 1100. The spacer apparatus 1200 will continue to be pivoted beyond the position shown in FIG. 52 until the entire spacer apparatus 1200 is disposed within the rabbet 1120 of the display frame 1100. As the first and third sides 1201, 1203 enter into the rabbet 1120, the flexible tabs 1220, 1230 will flex inwardly towards the spacer apparatus 1200 as they come into contact with the wall 1122 of the rabbet 1120. Eventually, the flexible tabs 1120, 1130 will become aligned with the opening 1125 in the wall 1122 of the rabbet 1120 and will flex back outwardly and into the channel 1130 to somewhat lock the spacer apparatus 1200 to the display frame 1100. Again, referring to FIG. 53, the user will insert his or her fingers between the outer surface of the spacer apparatus 1200 and the wall 1122 of the rabbet 11220 of the display frame 1100 and flex/bend the spacer apparatus 1200 inwardly to allow for the spacer apparatus 1200 to be removed from the rabbet 1120 of the display frame 1100.

The spacer apparatus 1200 may not be referred to as such in all embodiments, and particularly in the claims. In some embodiments, the spacer apparatus 1200 may be referred to as an insert apparatus, or a retention device or apparatus, in that it is inserted into the rabbet 1120 of the display frame 1100 to secure the stack therein. Thus, the terms spacer apparatus, insert apparatus, retention device/apparatus, may be used interchangeably in some embodiments.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A frame apparatus comprising:

an annular display frame comprising:

a longitudinal axis;

an outer wall having an outer surface that defines a periphery of the annular display frame and an inner surface; and a rabbet comprising a floor and a wall, the wall of the rabbet spaced apart from the inner surface of the outer wall to define a channel between the wall of the rabbet and the outer wall, the wall of the rabbet comprising an opening that provides a passageway into the channel;

a stack positioned in the rabbet; and a spacer apparatus positioned in the rabbet and detachably coupled to the annular display frame to retain the stack in the rabbet, the spacer apparatus comprising a first engagement feature that nests within at least one of the opening or the channel on a first side of the longitudinal axis and a second engagement feature that nests within at least one of the opening or the channel on a second side of the longitudinal axis;

wherein the spacer apparatus comprises a first side portion, a second side portion opposite the first side portion, a third side portion extending between the first and second side portions, and a fourth side portion extending between the first and second side portions, the fourth side portion being opposite the third side portion, and wherein the first engagement feature is located along the first side portion of the spacer apparatus and the second engagement feature is located along the second side portion of the spacer apparatus; and further comprising a third engagement feature located along the third side portion of the spacer apparatus and a fourth engagement feature located along the fourth side portion of the spacer apparatus, the first and third engagement features being identical, and the second and fourth engagement features being identical, at least a portion of the first and third engagement features being structurally different than the second and fourth engagement features.

2. The frame apparatus according to claim 1 wherein the spacer apparatus comprises:

a first corner piece, a second corner piece, a third corner piece, and a fourth corner piece;

a first short elongated piece, a first hanger piece, and a second short elongated piece extending between the first and second corner pieces to form the first side portion of the spacer apparatus;

a first long elongated piece extending between the third and fourth corners pieces to form the second side portion of the spacer apparatus;

a third short elongated piece, a second hanger piece, and a fourth short elongated piece extending between the second and third corner pieces to form the third side of the spacer apparatus; and a second long elongated piece extending between the first and fourth corner pieces to form the fourth side portion of the spacer apparatus.

3. The frame apparatus according to claim 2 wherein each of the short and long elongated pieces comprises an elongated protuberance that is configured to nest within at least one of the opening in the wall of the rabbet or the channel defined between the wall of the rabbet and the outer wall of the annular display frame, the elongated protuberance of the first long elongated piece forming the second engagement feature of the spacer apparatus, and wherein each of the first and second hanger pieces comprises at least one flexible tab that nests within the channel of the annular display frame and a hanging feature configured to engage a piece of hardware for hanging the frame apparatus from a support surface, the at least one flexible tab of the first hanger piece forming the first engagement feature of the spacer apparatus.

4. The frame apparatus according to claim 1 wherein the first, second, third, and fourth side portions of the spacer apparatus define a polygonal shape that surrounds a frame opening, each of the first second, third, and fourth side portions having an outer surface that faces the wall of the rabbet and an inner surface that faces the frame opening, and wherein each of the first, second, third, and fourth side portions of the spacer apparatus is configured to bend inwardly into the opening when a bending force is applied thereto to remove the first and second engagement features from the channel and the opening in the wall of the rabbet to facilitate detachment of the spacer apparatus from the annular display frame.

5. The frame apparatus according to claim 1 wherein the spacer apparatus comprises an outer surface that faces an inner surface of the wall of the rabbet when the spacer apparatus is positioned in the rabbet, and wherein a first portion of the outer surface of the spacer apparatus is in contact with the inner surface of the wall of the rabbet and a second portion of the outer surface of the spacer apparatus is spaced apart from the inner surface of the wall of the rabbet to facilitate inward bending of the spacer apparatus for purposes of detaching the spacer apparatus from the annular display frame.

6. A frame apparatus comprising:

an annular display frame comprising:

a longitudinal axis;

an outer wall having an outer surface that defines a periphery of the annular display frame and an inner surface; and a rabbet comprising a floor and a wall, the wall of the rabbet spaced apart from the inner surface of the outer wall to define a channel between the wall of the rabbet and the outer wall, the wall of the rabbet comprising an opening that provides a passageway into the channel;

a stack positioned in the rabbet; and a spacer apparatus positioned in the rabbet and detachably coupled to the annular display frame to retain the stack in the rabbet, the spacer apparatus comprising a first engagement feature that nests within at least one of the opening or the channel on a first side of the longitudinal axis and a second engagement feature that nests within at least one of the opening or the channel on a second side of the longitudinal axis; and wherein the first engagement feature comprises an elongated protuberance that protrudes from an outer surface of the spacer apparatus along one side of the spacer apparatus, and wherein the second engagement feature comprises at least one flexible tab protruding obliquely from the outer surface of the spacer apparatus along another side of the spacer apparatus.

7. The frame apparatus according to claim 6 wherein the first engagement feature consists of the elongated protuberance, and wherein the second engagement feature comprises a first elongated protuberance, a second elongated protuberance, and the at least one flexible tab located between the first and second elongated protuberances, wherein the at least one flexible tab of the second engagement feature comprises a first flexible tab and a second flexible tab, and wherein the spacer apparatus comprises an aperture located between the first and second flexible tabs and a sawtooth hanging feature aligned with the aperture for hanging the frame apparatus from a nail or a screw protruding from a wall.

8. A frame apparatus comprising:

an annular display frame comprising:

a longitudinal axis;

an outer wall having an outer surface that defines a periphery of the annular display frame and an inner surface; and a rabbet comprising a floor and a wall, the wall of the rabbet spaced apart from the inner surface of the outer wall to define a channel between the wall of the rabbet and the outer wall, the wall of the rabbet comprising an opening that provides a passageway into the channel;

a stack positioned in the rabbet;

a spacer apparatus positioned in the rabbet and detachably coupled to the annular display frame to retain the stack in the rabbet, the spacer apparatus comprising a first engagement feature that nests within at least one of the opening or the channel on a first side of the longitudinal axis and a second engagement feature that nests within at least one of the opening or the channel on a second side of the longitudinal axis;

wherein the spacer apparatus comprises a first side portion and a second side portion opposite the first side portion, the first side portion comprising the first engagement feature and the second side portion comprising the second engagement feature, the second engagement feature being structurally different than the first engagement feature.

9. The frame apparatus according to claim 8 wherein the spacer apparatus comprises a hanging feature located along the first side portion for hanging the frame apparatus from a support surface.

10. A frame apparatus comprising:

a display frame comprising a rabbet comprising a floor and a wall, the wall of the rabbet comprising an engagement feature;

a stack positioned in the rabbet; and a spacer apparatus positioned in the rabbet and detachably coupled to the display frame to retain the stack in the rabbet, the spacer apparatus comprising:

a plurality of corner pieces;

first and second sets of components each comprising a first short elongated piece, a hanger piece, and a second short elongated piece, each of the first and second sets of components coupled together and extending between and coupled to two adjacent ones of the corner pieces to form first and third sides of the spacer apparatus; and first and second long elongated pieces each extending between and coupled to two adjacent ones of the corner pieces to form second and fourth sides of the spacer apparatus.

11. The frame apparatus according to claim 10 wherein each of the first and second short elongated pieces and each of the first and second long elongated pieces comprises an elongated protuberance that interact with the engagement feature of the wall of the rabbet to facilitate coupling the spacer apparatus to the display frame.

12. The frame apparatus according to claim 10 wherein the hanger pieces comprise at least one flexible tab extending obliquely from an outer surface of the hanger piece that interact with the engagement feature of the rabbet to prevent unintentional detachment of the spacer apparatus from the display frame.

13. A frame apparatus comprising:

a display frame comprising a rabbet comprising a floor and a wall, the wall of the rabbet comprising an engagement channel;

a stack positioned in the rabbet; and a spacer apparatus positioned in the rabbet and detachably coupled to the display frame to retain the stack in the rabbet, the spacer apparatus comprising a first side, a second side opposite the first side, and third and fourth sides extending between the first and second sides, each of the first, second, third, and fourth sides comprising an elongated protuberance that nests within the engagement channel to couple the spacer apparatus to the display frame, and wherein the first and third sides further comprise at least one flexible tab that nests within the engagement channel.

14. The frame apparatus according to claim 13 wherein the at least one flexible tab located along each of the first and third sides protrudes a greater distance from an outer surface of the spacer apparatus than the elongated protuberance located along the first and third sides.

15. The frame apparatus according to claim 13 wherein the first and third sides comprise a first elongated protuberance and a second elongated protuberance, the at least one flexible tab being located between the first and second elongated protuberances.

16. The frame apparatus according to claim 13 wherein the at least one flexible tab extends obliquely from an outer surface of the spacer apparatus along the first and third sides of the spacer apparatus.

17. The frame apparatus according to claim 13 wherein the spacer apparatus comprises a sawtooth hanging feature located along each of the first and third sides.

18. The frame apparatus according to claim 17 wherein the spacer apparatus comprises an aperture that is aligned with the sawtooth hanging feature so that a head of a screw or nail nests within the aperture when the sawtooth hanging feature is engaged with a rod portion of the screw or nail which protrudes from a support surface upon which the frame apparatus is hung.

* * * * *